US008215041B2

(12) United States Patent
Hill

(10) Patent No.: US 8,215,041 B2
(45) Date of Patent: Jul. 10, 2012

(54) STRUCTURAL ASSEMBLY WITH A TIED, FLEXURALLY DEFORMED PANEL

(75) Inventor: G. Roland Hill, Stockport (GB)

(73) Assignee: Contra Vision Limited, Stockport (GB)

( * ) Notice: Subject to any disclaimer, the term of this patent is extended or adjusted under 35 U.S.C. 154(b) by 718 days.

(21) Appl. No.: 12/064,129

(22) PCT Filed: Aug. 21, 2006

(86) PCT No.: PCT/IB2006/003667

§ 371 (c)(1),
(2), (4) Date: Feb. 19, 2008

(87) PCT Pub. No.: WO2007/052156

PCT Pub. Date: May 10, 2007

(65) Prior Publication Data

US 2008/0226846 A1 Sep. 18, 2008

Related U.S. Application Data

(60) Provisional application No. 60/709,431, filed on Aug. 19, 2005.

(51) Int. Cl.
*G09F 17/00* (2006.01)
*G09F 15/00* (2006.01)

(52) U.S. Cl. ..... 40/603; 40/606.12

(58) Field of Classification Search ..... 40/124.01, 40/124.07, 650, 603, 738, 661.08, 606.12, 40/611.11, 737, 661

See application file for complete search history.

(56) References Cited

U.S. PATENT DOCUMENTS

| | | | |
|---|---|---|---|
| 16,767 | A | 3/1857 | Worthen |
| 1,687,850 | A | 10/1928 | Shodron |
| 1,762,363 | A | 6/1930 | Sergent |
| 2,160,724 | A | 5/1939 | Fletcher |
| 2,237,226 | A | 4/1941 | High |

(Continued)

FOREIGN PATENT DOCUMENTS

| | | |
|---|---|---|
| DE | 43 14 654 | 11/1994 |

(Continued)

OTHER PUBLICATIONS

International Search Report from PCT/IB2006/003667, Jun. 22, 2007, 3 pages.

(Continued)

*Primary Examiner* — Joanne Silbermann

(74) *Attorney, Agent, or Firm* — Pillsbury Winthrop Shaw Pittman LLP

(57) ABSTRACT

An assembly includes a flexurally deformed panel, which is connected to a membrane tie by a linear connector and is tied by the membrane tie to form a geometrically stable pre-stressed structure. More than one panel may be flexurally deformed and tied together in an assembly and more than one membrane tie may be present within an assembly. Panels are typically semi-rigid sheet materials, for example metal sheets, plastic sheets, or sheets of composite materials, such as glass or carbon fibre reinforced plastics or resins. Membrane tie members are typically flexible, for example plastic films, fabrics or nets or arrays of rods or cables. The assemblies have many different geometric forms and many different practical applications. Assemblies may be relatively large, for example demountable and reusable shelters or flat-pack point-of-purchase display assemblies, or may be relatively small, for example a photograph or postcard display system.

66 Claims, 106 Drawing Sheets

U.S. PATENT DOCUMENTS

| | | | | |
|---|---|---|---|---|
| 2,287,370 | A | 6/1942 | Becker | |
| 2,360,285 | A | 10/1944 | Sherman | |
| D149,294 | S | 4/1948 | Newman | |
| 2,611,427 | A | 9/1952 | Mais et al. | |
| 2,862,322 | A | 12/1958 | Ziegler | |
| 2,887,154 | A | 5/1959 | Morningstar | |
| 2,911,038 | A | 11/1959 | Frommelt | |
| 3,057,119 | A | 10/1962 | Kessler | |
| 4,433,700 | A | 2/1984 | Dohet | |
| 4,536,997 | A | 8/1985 | Heescher | |
| 4,749,011 | A | 6/1988 | Rylander | |
| D302,911 | S | 8/1989 | Pei-ai | |
| 4,865,111 | A | 9/1989 | Perutz | |
| D306,537 | S | 3/1990 | Swanson et al. | |
| 4,979,554 | A | 12/1990 | Nelson | |
| 4,991,813 | A | 2/1991 | Beaulieu | |
| D325,307 | S | 4/1992 | Cojan | |
| D328,206 | S | 7/1992 | Lewis | |
| D340,533 | S | 10/1993 | Beaulieu et al. | |
| D346,867 | S | 5/1994 | Montilla | |
| 5,313,666 | A | 5/1994 | Bax et al. | |
| D350,245 | S | 9/1994 | Branz et al. | |
| D369,924 | S | 5/1996 | Werner et al. | |
| 5,595,203 | A | 1/1997 | Espinosa | |
| 5,619,816 | A | 4/1997 | Ellison | |
| D395,968 | S | 7/1998 | Shappell | |
| 5,826,639 | A | 10/1998 | Miller | |
| D405,628 | S | 2/1999 | Terrana et al. | |
| D423,250 | S | 4/2000 | Wolff | |
| 6,065,512 | A | 5/2000 | Munn, II | |
| D427,809 | S | 7/2000 | Osborn et al. | |
| 6,212,805 | B1 | 4/2001 | Hill | |
| RE37,186 | E | 5/2001 | Hill | |
| 6,276,084 | B1 | 8/2001 | Lanier | |
| 6,293,037 | B1 * | 9/2001 | Spada et al. | 40/638 |
| 6,311,709 | B1 | 11/2001 | Louie et al. | |
| 6,722,069 | B1 | 4/2004 | Lanier | |
| 7,596,896 | B2 | 10/2009 | Crowell et al. | |
| 2006/0107571 | A1 * | 5/2006 | Steer | 40/606.12 |
| 2007/0051024 | A1 | 3/2007 | Fuchs | |

FOREIGN PATENT DOCUMENTS

| | | |
|---|---|---|
| JP | 1263377 | 10/1989 |
| WO | 97/25213 | 7/1997 |
| WO | 98/13813 | 4/1998 |
| WO | 2005/031682 | 4/2005 |
| WO | 2007052156 A2 | 5/2007 |

OTHER PUBLICATIONS

Notification of Written Opinion and Search Report, International Search Report, and Written Opinion issued in PCT/IB2007/003620, Aug. 21, 2008, 14 pages.

United States Office Action for U.S. Appl. No. 29/317,920, mailed Sep. 14, 2010.

* cited by examiner

PRIOR ART Fig.2T

Fig.15D
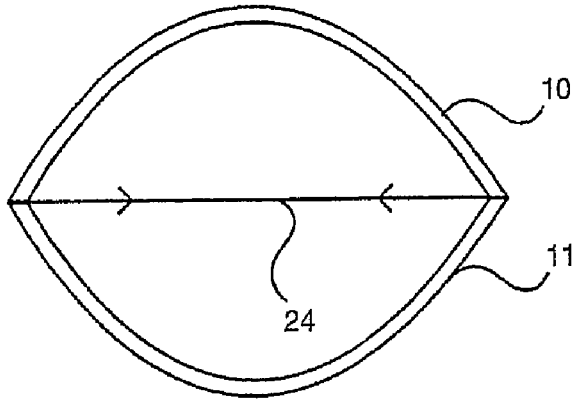
Fig.15E
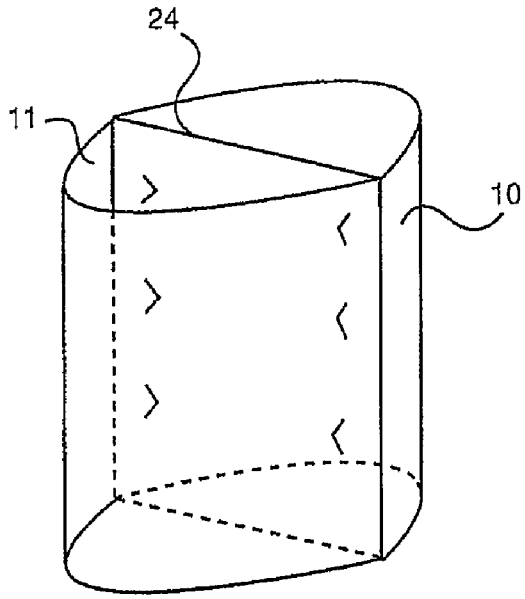
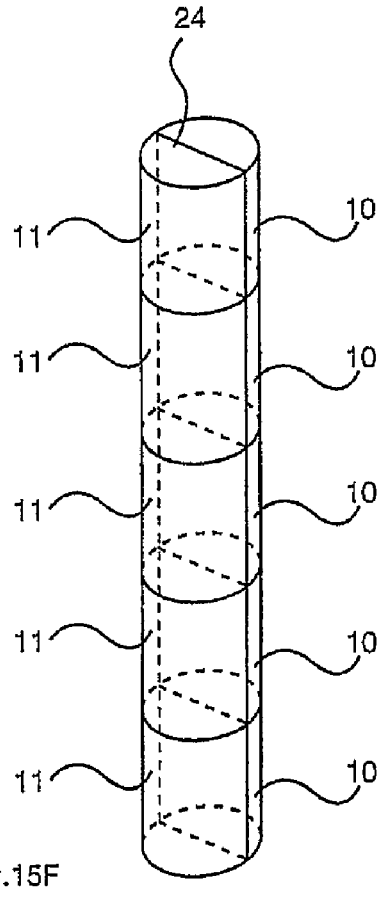
Fig.15F

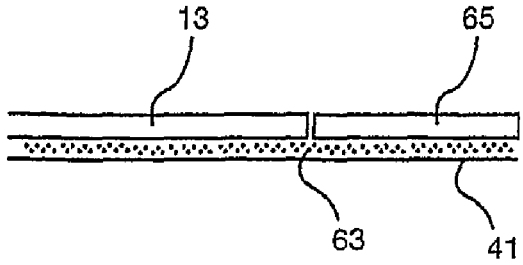
Fig.22V
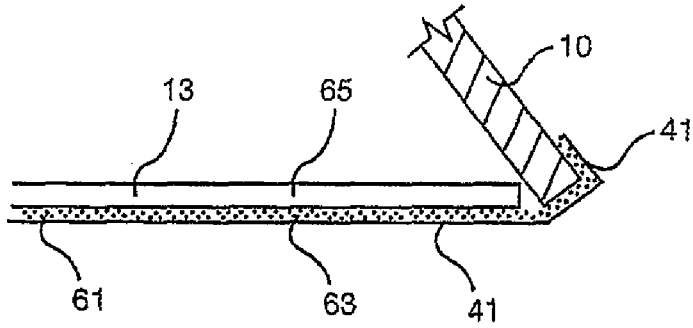
Fig.22W
Fig.22X
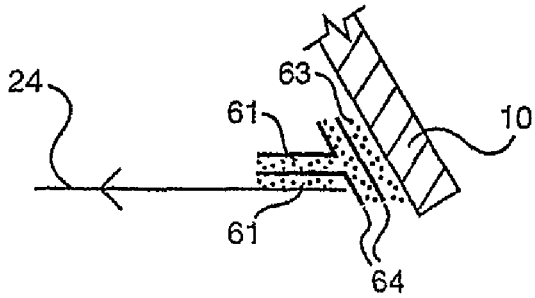
Fig.22Y
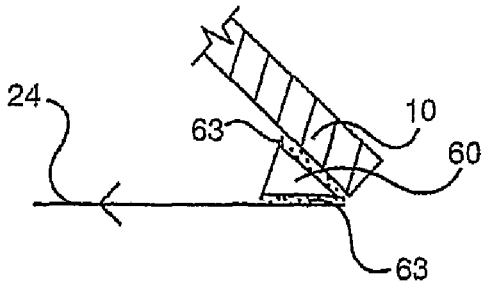

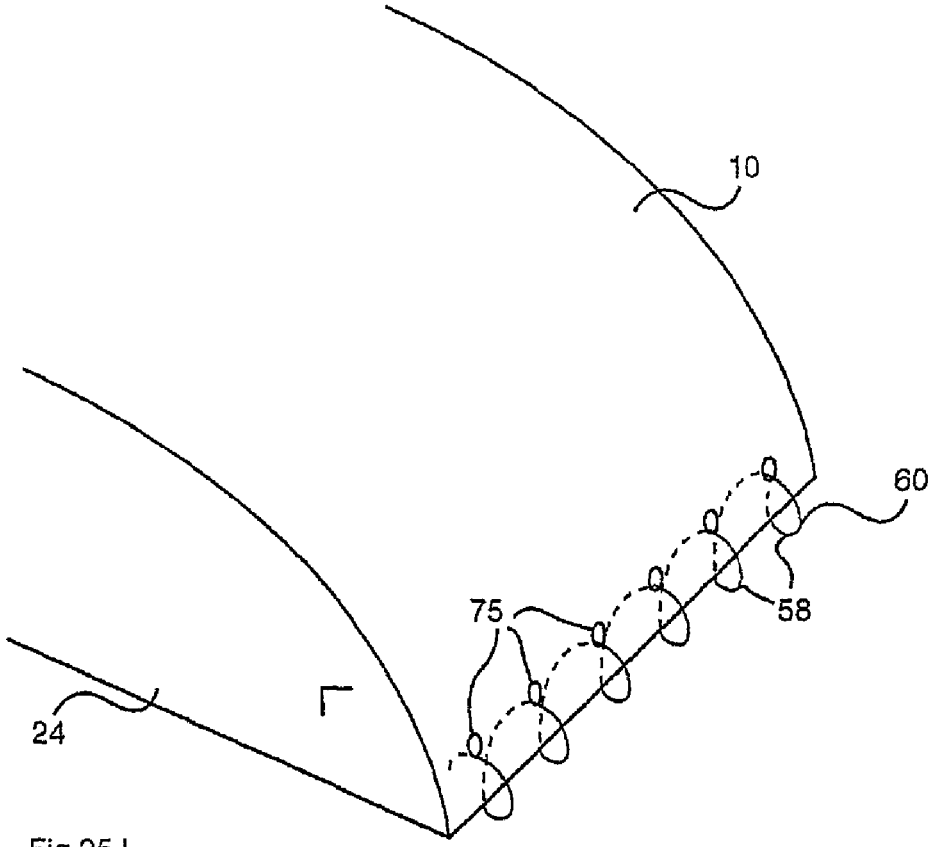
Fig.25J
Fig.25K
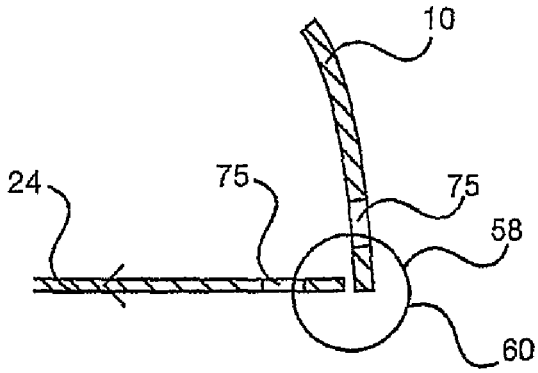

Fig.26G
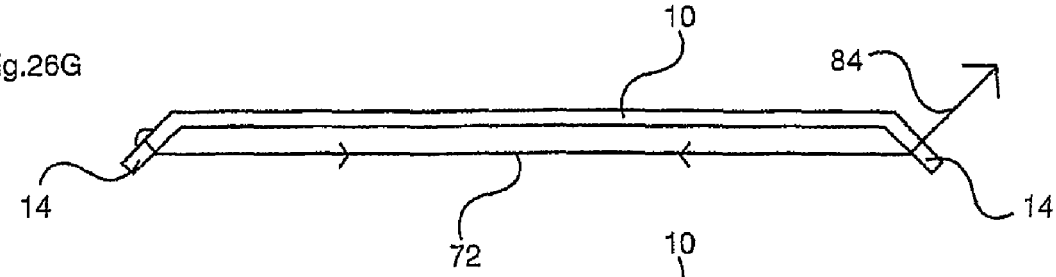
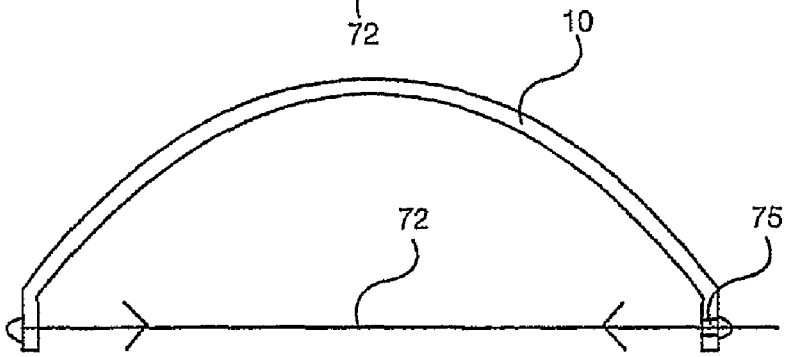
Fig.26H
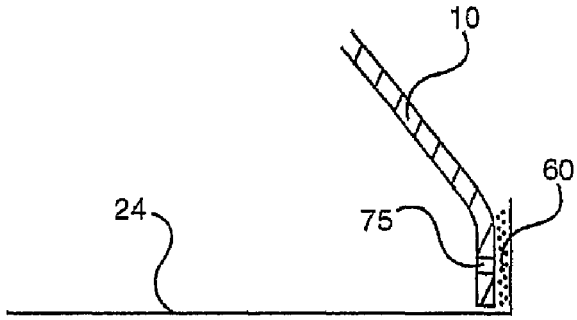
Fig.26J
Fig.26K
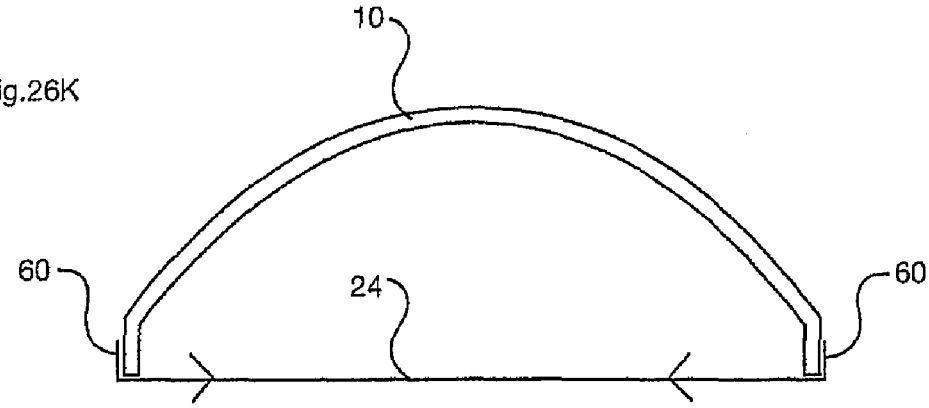

Fig.29H
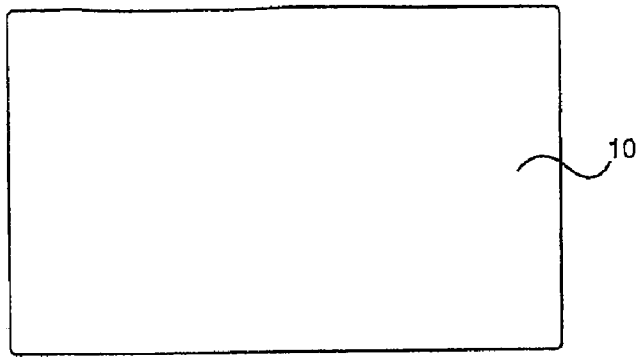
Fig.29J
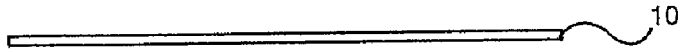
Fig.29K
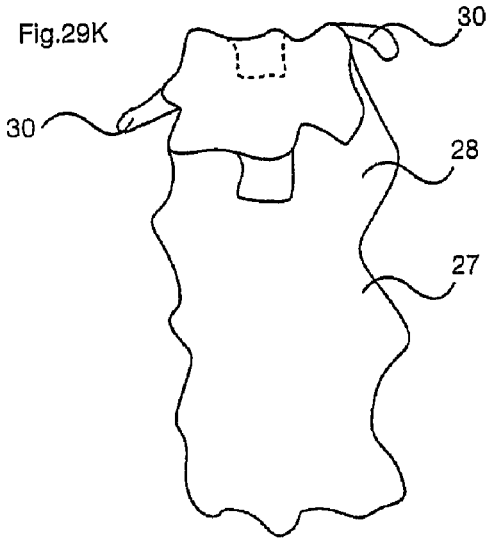
Fig.29L
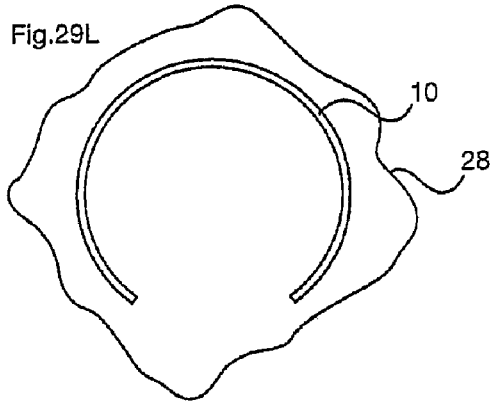
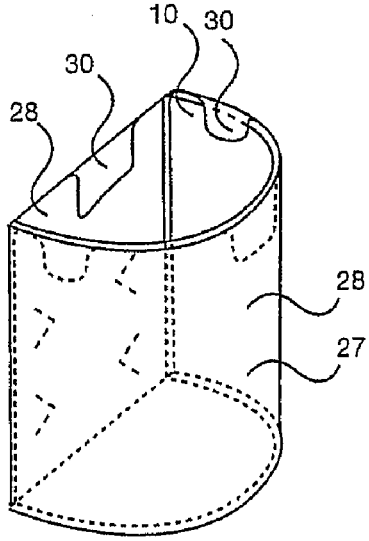
Fig.29M Fig.30D
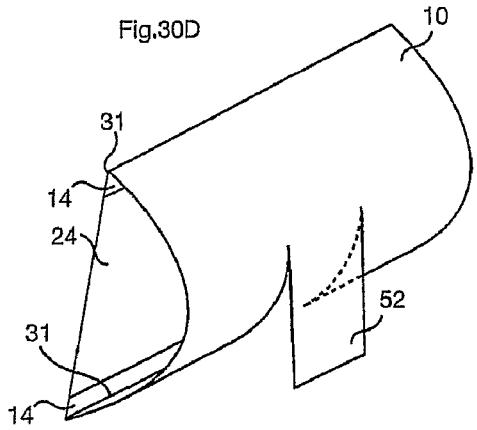
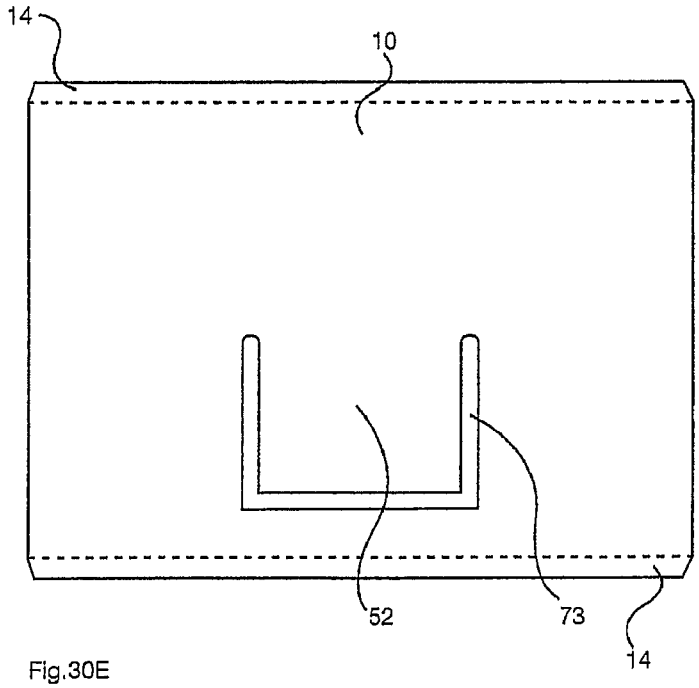
Fig.30E

STRUCTURAL ASSEMBLY WITH A TIED, FLEXURALLY DEFORMED PANEL

CROSS REFERENCE TO RELATED APPLICATIONS

This is the U.S. National Phase of PCT/IB2006/003667, filed Aug. 21, 2006, which in turn claims priority to U.S. provisional application Ser. No. 60/709,431, filed Aug. 19, 2005, the contents of both of which are incorporated herein in their entirety by reference.

BACKGROUND

1. Field of the Invention

Embodiments of the present invention relate to structural systems or structures comprising a flexurally deformed panel.

2. Description of Related Art

Structural systems involving more than one panel connected together are commonplace, for example folded plate roofs, boxes, etc. Connecting two originally planar elements together, one of which is substantially deformed, is also known. For example, corrugated paper or card comprises a sheet of plane paper or card which is deformed by means of pressure, heat and water content (but not flexural stress) into a corrugated shape, for example of sinusoidal cross-section, and is then adhered by gluelines to one or two plane sheets of paper or card. However, in the case of corrugated paper or card, the corrugated element is typically deformed in a material state and under conditions such that, were it not attached to the one or more planar sheets, it would still be corrugated in repose. Corrugated plastic constructions, such as Correx® a trademark of Kaysersberg Plastics, a part of D S Smith (UK) Ltd. are made by extrusion, not flexural deformation of the core.

Tied members which are deformed within the elastic range are also known, for example the common bow for projecting arrows, which typically comprises a substantially linear member of wood or a laminate of several materials, which is flexurally deformed and tied at each end by the string of the bow.

Point-of-purchase display devices are also known in which a substantially vertical filmic display is tensioned by one or more bowed linear prop members, typically fixed to and flexed between a heavy base, to which the bottom of the display film is also attached, and a cross-member at the top of the display panel. The bowed prop members are made slightly longer than the display film and are flexurally deformed to induce tension in the display film to keep it flat or plane. A heavy base is required for lateral stability of these systems.

Panels flexed and restrained between two points of a relatively very rigid member are also known, for example, flexed acrylic or other plastic sheets within some light fittings.

British Patent Application No. 8510775 "Constructional Member of Variable Geometry" (Hill and Higgins) discloses substantially linear members comprising interlocked, substantially linear components that can be flexurally deformed and fixed in their deformed geometry by means of discrete mechanical fixings.

In the field of building structures, tied arches and vaults are known, as are flitch beams, slabs, arches and vaults with pre-stressed ties, none of which structures are known to feature an arch or vault that has been flexurally deformed before attaching a tie or ties.

U.S. Pat. No. 2,160,724 and U.S. Pat. No. 2,862,322 both disclose small postcard or photograph or other opaque displays in an assembly comprising an opaque curved card element and a plane element which is "D" shaped on plan, to provide a stable display assembly. The curved and plane components are connected by means of folded card tabs, which will inevitably open up in use and cause reduction of any tension in the plane element.

Zips to join two pieces of plastic together are known. U.S. Pat. No. 6,540,085 (Davies) discloses plastic zips comprising teeth attached to side panels and a sliding connector, the side panels typically being heat bonded to a plastic film material being joined.

BRIEF SUMMARY OF THE INVENTION

According to one embodiment of the present invention, an assembly comprises a panel, a membrane tie, and a linear connector, the panel being flexurally deformed from an initial geometry and restrained in a flexurally deformed geometry the membrane tie and the linear connector.

Embodiments of the invention can have many different geometric forms and many different practical applications. Assemblies may be relatively large, for example demountable and reusable shelters or flat-pack point-of-purchase display assemblies, or may be relatively small, for example a photograph or postcard display system, or extremely small for example an element of a small spring mechanism.

Components of embodiments of the invention typically are packable and transportable flat, to be assembled remote from the point of manufacture.

A "panel" typically has two plane, parallel surfaces and is relatively thin in relation to its overall size. The thickness or minimum dimension of a panel is typically less than one tenth and preferably less than one twentieth and more preferably less than one fiftieth and even more preferably less than one hundredth and even more preferably less than five thousandths of its overall length. Panels are typically semi-rigid in that they may be flexurally deformed through an angle of at least 10° and preferably through 20° and more preferably 90° and even more preferably 180° within the short term, substantially elastic range of the panel parent material or composite material, such that they will substantially regain their original geometry if released immediately after flexure. Panel materials have a stress/strain curve with a substantially elastic range, such as steel, or are materials which 'creep' with time under load, such as plastic materials. Panels may be of any shape, for example square, rectangular, triangular, circular, petal shaped (sometimes referred to as petaloid or petalate) or any free-form, irregular shape. A panel is optionally of uniform thickness or tapered or otherwise of varying thickness throughout its area. Panel materials are optionally grossly deformed in the initial geometry, for example by the creation of "plastic hinges" in which a material is locally deformed beyond its elastic range, in some materials referred to as folds or creases, before the initially grossly deformed panel is flexurally deformed within its substantially elastic range according to the invention. A panel optionally is of initial single or double (bi-axial) curvature before being flexurally deformed. Such panels are pre-folded or pre-curved in their initial geometry, in order to achieve the desired final, flexurally deformed geometry. Examples of panel materials, typically semi-rigid sheets, for example of plastics materials, are acrylic, polycarbonate, polyester, copolyester, acetate, polyvinyl chloride (PVC) or composite materials, for example glass fibre reinforced or carbon fibre reinforced plastics or resins, or metals, for example steel, stainless steel or aluminum, or laminates, for example paper or card encapsulated by two plastic laminating films, for example of polyethelene, polyester, polypropylene, nylon or pvc, for example either cold-laminated using pressure-sensitive adhesive or hot-laminated using heat-activated adhesive, or so-called "stressed skin" panels comprising two outer layers and an inner cellular or foamic cores, for example aluminum stressed skin panels as used in aircraft construction, or natural materials or processed natural materials, for example timber boards, plywood or chipboard. Optionally, the panel member is of substantially greater flexural stiffness than the membrane tie member. Panels are optionally opaque, translucent or transparent or partially transparent and/or partially translucent, for example see-through graphic panels according to US RE37,186 or U.S. Pat. No. 6,212,805. A panel can typically support its own weight on one edge.

A "membrane tie" is typically a flexible membrane, for example a plastic film material, for example of polyester, copolyester, acrylic, polycarbonate, PVC or polyethylene, or a thin sheet of metal, for example of steel, stainless steel or aluminum, or a thin sheet of plywood or paper or card or a fabric, including woven and non-woven fabric, or a laminate, for example paper or card encapsulated by two plastic films, for example of polyester, polypropylene, nylon or pvc, either cold-laminated using pressure-sensitive adhesive or hot-laminated using heat-activated adhesive. Membrane tie members are optionally nets or grids, such as square, triangular, hexagonal or other reticulated nets, or perforated materials, for example perforated steel, aluminum or plastic materials, the perforations being optionally punch-perforated or laser-perforated.

Membrane ties are optionally of super elastic materials, for example rubber elastic or wound elastic material or elasticated fabric material, for example to create assemblies with large deformation and restitution capabilities. Membrane ties are optionally of hybrid construction, for example filmic ties may have cable or fiber reinforcing elements within them and/or around their perimeter, to add strength where required. Linear elements, for example open rings of cable, are optionally used to distribute the load in membrane ties, for example at discrete connection points to a panel, where there are points of stress concentration. The term "membrane tie" also includes an array of linear elements. A linear element includes a rod, for example of steel or plastic, a cable, such as a steel cable, wire, a rope, string, a monofilament, for example a polyester filament, or a spun natural or artificial fiber, for example thread, twine or a polyester multi-filament fiber. Linear elements of a membrane tie preferably spaced at less than twenty times the thickness of the panel. Membrane ties are optionally plane, which may be referred to as planar ties, or be curved in one direction, of so-called single curvature, for example as a single curve or, as another example, in a multiple curve, for example in the form of a sinusoidal wave in cross-section, the primary tie function (direction of tensile stress) typically being perpendicular to such curvature or membrane ties are optionally of double or biaxial curvature. Membrane ties are optionally opaque, translucent or transparent, or partially transparent or translucent, for example vision control panels according to US RE37,186 or U.S. Pat. No. 6,212,805. Optionally, the membrane tie is more flexible than the panel.

Definitions related to flexibility vary in different arts. Stiffness can be regarded as the inverse of flexibility. For the purpose of this invention, the Flexural Stiffness at one end of an elastic member of uniform cross-section which is pin-jointed at both ends:

$$\text{Flexural Stiffness}=EI/L$$

where E is the Modules of Elasticity

I is the second moment of area (Moment of Inertia)

L is the effective length

The Flexural Rigidity of a member cross-section is considered to be:

$$\text{Flexural Rigidity}=EI$$

For a rectangular cross-section, such as is commonly selected for the panel and/or a filmic membrane tie, $$I=ht^3/12$$

where h is the width and t is the thickness of the member.

Typical values for the Modules of Elasticity ($kN/mm^2$) of some of the materials which may be used for the present invention are:

| | |
|---|---|
| Pvc | 2.4-3.0 |
| Acrylic | 2.7-3.2 |
| PTFE | 0.3-0.6 |
| Polycarbonate | 2.2-4.0 |
| Nylon | 2.0-3.5 |
| Rubber | 0.002-0.1 |
| Neoprene | 0.7-2.0 |

Preferably the Flexural Rigidity of the membrane tie is less than the Flexural Rigidity of the panel, more preferably less than one hundredth of the Flexural Rigidity of the panel and even more preferably less than one thousandth of the Flexural Rigidity of the panel.

A "linear connector" typically connects a side or edge of a panel to a side or edge of a membrane tie. The term "linear connector" includes an adhesive layer or "glueline", a weld or a pre-formed element, for example of plastics or metal, for example an extruded aluminum or plastics "profiled section" or a cold-formed steel section or any novel or known mechanical fixing such as a piano hinge, restraints utilizing friction, or interlocking closure systems, such as VELCRO®, a trademark of Velcro Industries B.V. or Dual Lock™ a trademark of 3M, and zips of any type. In order to connect a semi-rigid sheet of plastic to a plastic film by means of a zip, a transition tape or intermediate tape between the semi-rigid sheet and the side panel of the zip is typically required. The transition tape can be bonded by heat-activated adhesive, pressure-sensitive adhesive or solvent adhesive. Some connection details will be described which have been devised specifically for the invention. A linear connector may comprise frictional, magnetic or electrostatic force. A linear connector is optionally discontinuous, for example a plurality of discrete areas of adhesive material, or a layer of adhesive material with a plurality of discrete areas of adhesive material, or a layer of adhesive material with a plurality of areas without adhesive material, a line of discrete spot welds or rivets. The term "linear connector" includes a cable, for example in a ring or loop, which distributes localised stress, for example of the connection of a membrane tie to a corner of a panel. Preferably the linear connector has a direct bond to an elongate area of the panel and/or an area of the membrane tie, the bond for example being provided by a weld or an adhesive layer, a magnetic force or an electrostatic force. Preferably, the direct bond covers an elongate area substantially parallel to an edge of the panel and/or membrane tie, of a width preferably not less than 3 mm and more preferably not less than 10 mm. Optionally, the linear connector is transparent, for example of extruded polycarbonate.

A "transparent material" in the context of this invention is "water clear" or tinted and allows through vision such that:

(i) if a transparent material comprises two plane, parallel sides, it is possible for an observer on one side of the transparent material to focus on objects located directly in contact with or spaced from the other side of the transparent material, and/or (ii) if a transparent material is laminated to an object comprising 10 point indicia, the indicia are clearly legible.

The connection of the panel to the membrane tie preferably approximates to what is referred to in the art of structural engineering as a pinned joint or pinned connection, having a bending moment resistance approximating to or tending towards zero. In one embodiment of the invention, a rectangular, plane panel, for example a semi-rigid acrylic sheet is flexurally deformed about one axis and the two opposite sides parallel to this axis are connected by a membrane tie member. For example, a semi-rigid acrylic sheet is flexed and tied by a polyester film material, typically of much lower flexural stiffness than the panel. The panel and the membrane tie are typically connected by a linear connector, for example an adhesive layer between the plastic sheet and the plastic film along the two opposite sides. Alternatively, for example, the flexurally deformed or "flexed" panel is a plywood sheet flexed and then tied by another, typically thinner, plywood sheet. In the case of the plywood assembly, for example, a steel angle is connected by screws or gluelines to the plywood panel and the plywood membrane tie. The resultant structural assemblies are dimensionally stable, for example if placed on a horizontal support surface with one of the flexurally curved edges resting on the horizontal support surface, or with the four corners of the panel resting on individual supports or a horizontal support surface. Alternatively, the four corners of such an assembly can be supported on four elevated level supports. For example, the plywood assembly forms a novel form of tied barrel vault roof, an efficient structural roofing system, especially if the open ends of the structure are closed by a "shear diaphragm" stiffening members, for example of further sheets of plywood, which help to maintain the dimensional stability of the structure upon subsequent "dead loading" of any other constructional materials or "live loading", for example of people on the roof formed by the tied, flexurally deformed panel.

Such structural assemblies may be referred to as "tied, flexurally deformed panel" or "tied, flexed panel" structures. A principal advantage of the invention is that the structural assembly is typically fabricated from planar and optionally linear components which can be easily manufactured and subsequently processed, for example printed with a design. The components can be packaged flat or rolled, and can be transported more easily and economically than 3 dimensional structural members that are pre-formed (for example cast concrete structures or conventional steelwork structural members) and can be assembled temporarily semi-permanently or permanently at sites remote from the component manufacturing site or sites. Temporary or semi-permanent embodiments of the invention can be designed to be easily dismantled and re-used or be conveniently transported to recycling or waste disposal centers.

The flexed panel or panels and tensioned membrane tie or tie members combine to provide a structural assembly that is typically more stable and has more load-bearing capability than the individual members or the same elements combined in their non-flexed or non-tensioned state.

Panels are typically plane before being flexed and typically have sufficiently high in-plane tensile strength so as not to accommodate double curvature. However, a variety of geometric shapes can be achieved by single curvature of plane panels, for example a variety of single curves or repetitive or varied wave shapes can be achieved, as well as a variety of "shell" structures.

Transparent panels and tie membranes are used, for example, to make transparent or partially transparent display assemblies with no independent framing or other such obstruction to through vision. Such assembles are, in particular, suited to support or comprise one-way vision or other see-through vision control panels, for example as disclosed in US RE37,186 or U.S. Pat. No. 6,212,805. Optionally, the linear connector or connectors are also transparent, for example comprising transparent gluelines or transparent profiled sections, for example of clear, extruded polycarbonate.

Assemblies of the invention are optionally designed to be of variable geometry, typically by enabling the tie member or members to be altered in length, for example by means of tie rods that can be varied in length, for example by means of a turnbuckle, or wound elastic tie members that can be further wound or un-wound. The capability to amend the geometry of an assembly has many potential benefits, for example from minor adjustments to accommodate tolerances or errors in building construction, to substantial changes in geometry, for example to amend the effective area of a tied, flexed panel, for example acting as a sail on a boat or wind-powered electricity generating device.

Assemblies of the invention are optionally extremely flexible, to allow substantial deflection under load, such deflection being reversible if both the panel and tie elements are not loaded beyond their short-term elastic range. In structural engineering terms, assemblies of the invention typically have a very high coefficient of restitution after short-term loading, even those incorporating plastic materials. A membrane tie member optionally performs a rebound or trampoline function, taking advantage of the stored energy and elastic deformation capability of a suitably designed assembly of the invention. Such properties are useful in the manufacture of many products, from very small spring assemblies to sprung platforms, for example as may be used in "bouncy castles". The invention is optionally used to create energy through changing, repeated flexure of a panel and tensile strain of a membrane tie member, for examples if the invention comprises materials which create an electric current upon flexure, for example buoys at sea are capable of being illuminated by wave action upon an assembly of the invention comprising such flexurally activated material.

Additional elements are optionally used to adapt a tied, flexed panel assembly. For example, further ties or infill material such as flexible foam are used to make a tied, flexed panel assembly into a shock absorbing structure. While most tied, flexed panel structures will be designed to perform within their short-term elastic range, they are optionally designed to 'fail', for example by the creation of plastic hinges in a panel, as part of an impact absorption system, for example on a vehicle or as 'buffers' or in safety or security barriers.

Assemblies are optionally combined "tiled" or otherwise used together, for example a canopy structure can be replicated to produce a building or canopy of a larger size within a required maximum roof profile height.

The ability to use lightweight materials and transport components flat or in roll form means the invention can be efficiently packaged and transported by air, sea or land to remote locations and assembled to fulfil needs on a temporary or permanent basis, for example enclosures or other protective structures against sun, wind, sand, precipitation or other natural elements.

Depending primarily on the size of panel member, the flexural deformation of the panel is achieved by purely manual means or requires mechanical means of deforming the panel before being tied to form a stable, tied, flexed panel assembly. For example, temporary clamps can be applied to a panel or holes, slots or recesses may be formed in a panel to enable temporary ties to pull the panel into an "intermediate panel geometry" before attaching the permanent membrane tie member(s) of the invention. Optional mechanical assistance in deforming panels includes, for example, scissor mechanisms or a ratchet cable device, typically lever operated for example a Tirfor™ "grip hoist" by the Tractel Group; USA. Scissor mechanisms, akin to a scissor lift, typically comprise two parallel members which can be moved towards or away from each other but which typically maintain the parallel relationship of the panel sides being drawn together. Flexure is optionally achieved by means of one or more tie straps, which are placed around the panel, initial deflection induced manually or, for example, by a friction buckle or ratchet device, the straps being successively tightened until the required intermediate panel geometry is obtained. After fixing the membrane tie in place and applying the linear connector or connectors, the panel is released, transferring the tensile force to the membrane tie, then any temporary restraints are removed, to leave the finished tied, flexurally deformed assembly.

Optionally, clamps enable an eccentric tie force to be applied to the panel, for example by means of a cable, to initiate and then complete flexure. Flexural deformation is optionally assisted by the provision of a temporary framework or jig to restrain the panel in an "intermediate panel geometry". The final tied, flexurally deformed geometry results from the membrane tie member taking up its tension force, typically allowing some "relaxation" of the "intermediate panel geometry" into the "tied, flexurally deformed panel geometry" of the finished assembly.

In some embodiments, some initial and/or intermediate flexural deformation may be achieved by differential heating or cooling of the two principal surfaces of the panel.

An assembly optionally comprises a means of edge stiffening, for example the edge of the panel being permanently deformed, for example by an acrylic panel subject to hot wire bending, or one or more stiffening members being inserted into the assembly.

Assemblies optionally comprise both a membrane tie and a linear tie.

Temporary enclosures manufactured according to the invention have a number of potential advantages over prior art enclosures, for example purely fabric tent enclosures, for example in providing a sheltered observation post with clarity of vision through a transparent flexed panel, for example a clear, transparent polycarbonate sheet. Conversely, vision into the shelter can be a desirable benefit, for example for security reasons, by the human eye or camera. Panel or membrane tie members of the assembly optionally comprise so-called vision control products, for example one-way vision products, for example as disclosed in US RE37,186, for example if a good view out of an enclosure is required in conjunction with obscuration of vision into the enclosure.

Assemblies of the invention encompass a wide range of size, from large building structures, down to very small scale structures, for example panels of less than 1 mm overall width contained within tubes of less than 1 mm diameter, for example to form a mass of low density, high porosity, sprung elements, for example as an energy absorbing medium.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

All the figures are diagrammatic, not to scale and typically not in the correct proportion of thickness of members in relation to their overall dimensions. In numbering the figures, the suffix letter characters I, O, II and OO have been omitted. Referring now to the drawings which form a part of this original disclosure:

FIG. 2AA is a plan of a panel with two curved edges.

FIG. 2BB is a perspective of an assembly comprising a panel with two curved edges.

FIG. 2CC is a plan of a panel with two curved edges.

FIG. 2DD is a perspective of an assembly comprising a panel with two curved edges.

FIGS. 2EE-GG are perspectives of suspended assemblies.

FIG. 2HH is a perspective of a "mobile" comprising three assemblies.

FIG. 2JJ is a diagrammatic cross-section showing the effects of creep deflection and restitution of a panel.

FIG. 2LL is a cross-section of an assembly showing reversal of curvature of a panel.

FIG. 2MM is an elevation of an assembly supported on the crown of the flexurally deformed panel.

FIG. 15D is a cross-section through an assembly with two flexed panels and a mutual membrane tie.

FIG. 15E is a perspective of an assembly with two flexed panels and a mutual membrane tie.

FIG. 15F is a perspective of a tower comprising several assemblies with two flexed panels and a mutual tie.

FIG. 16C is a cross-section through a panel tied towards the centre of the panel.

FIG. 17A is an assembly with two flexed panels and a mutual membrane tie.

FIG. 17B is a perspective of an assembly an assembly with two flexed panels and a mutual membrane tie.

FIG. 17C is a perspective of an assembly with two flexed panels and a mutual membrane tie.

FIG. 18A is a cross-section through a flexed panel.

FIG. 18B is a cross-section through a tied, flexed panel.

FIG. 18C is a cross-section through a tied, flexed panel with infill between the panel and the membrane tie.

FIG. 18D is a cross-section through a tied, flexed panel with infill between the panel and the membrane tie.

FIG. 18E is a cross-section through a tied, flexed panel with infill between the panel and the membrane tie.

FIG. 18F is a cross-section through a tied, flexed panel with infill between the panel and the membrane tie.

FIG. 19A is a vertical cross-section of a concrete formwork system.

FIG. 19B is a horizontal cross-section through a concrete formwork system.

Figure 19A:
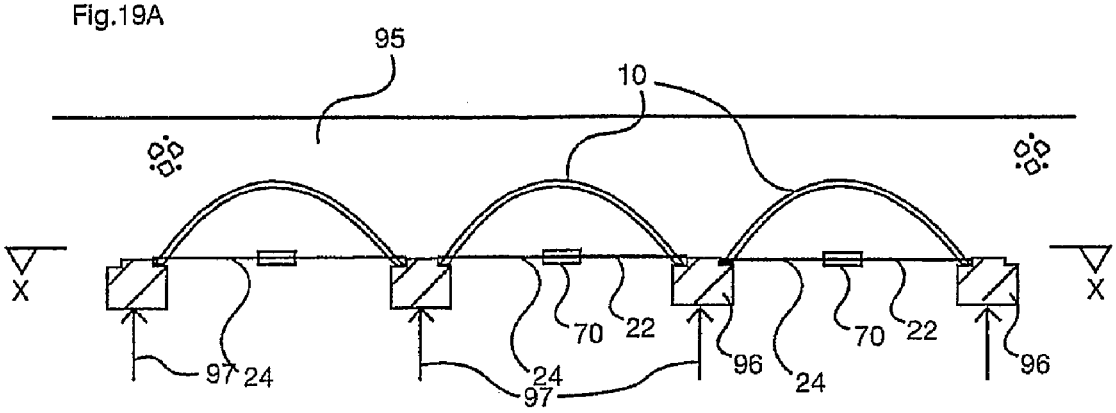
Figure 19B:
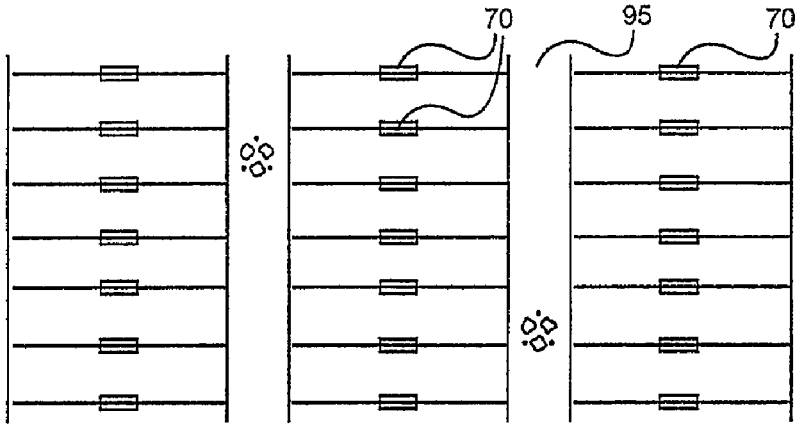
Figure 19C:
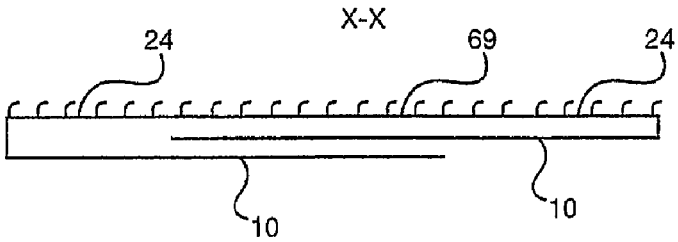

FIG. 19C is a cross-section of a stored headrest.

Figure 19D:
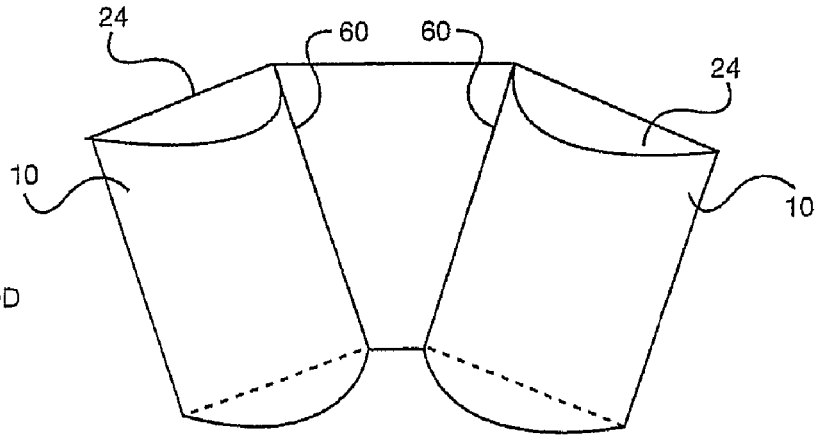

FIG. 19D is a perspective of a headrest.

Figure 19E:
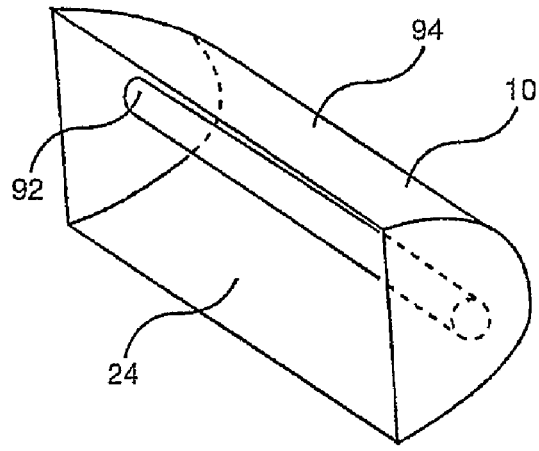

FIG. 19E is a perspective of a luminaire.

Figure 19F:
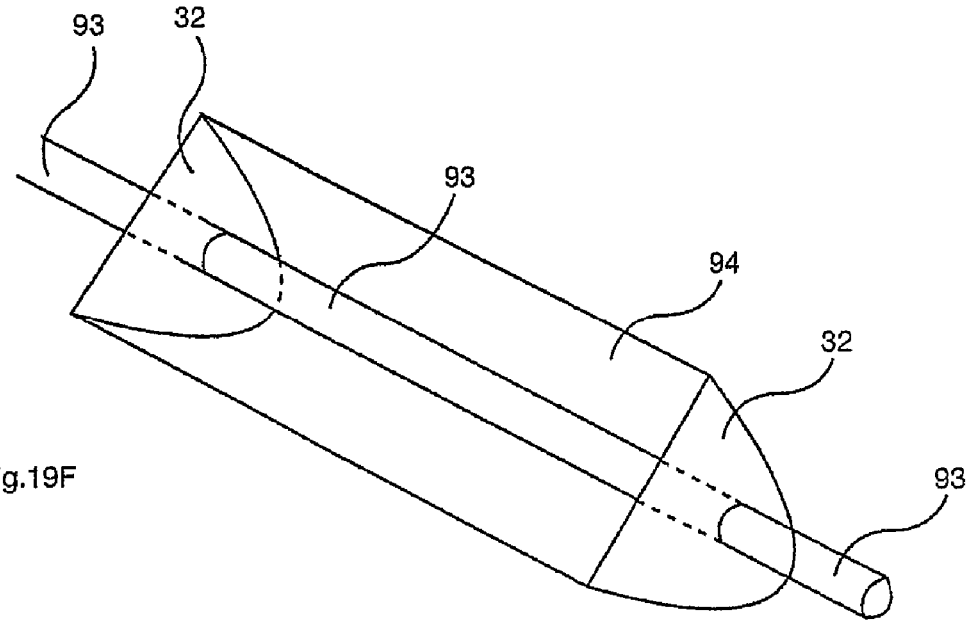

FIG. 19F is a perspective of a solar collector.

Figure 19G:
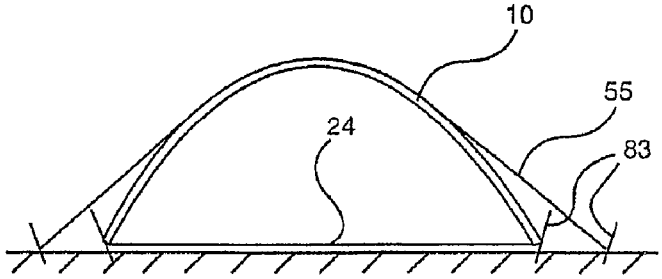

FIG. 19G is a cross-section through a tent-like shelter.

Figure 19H:
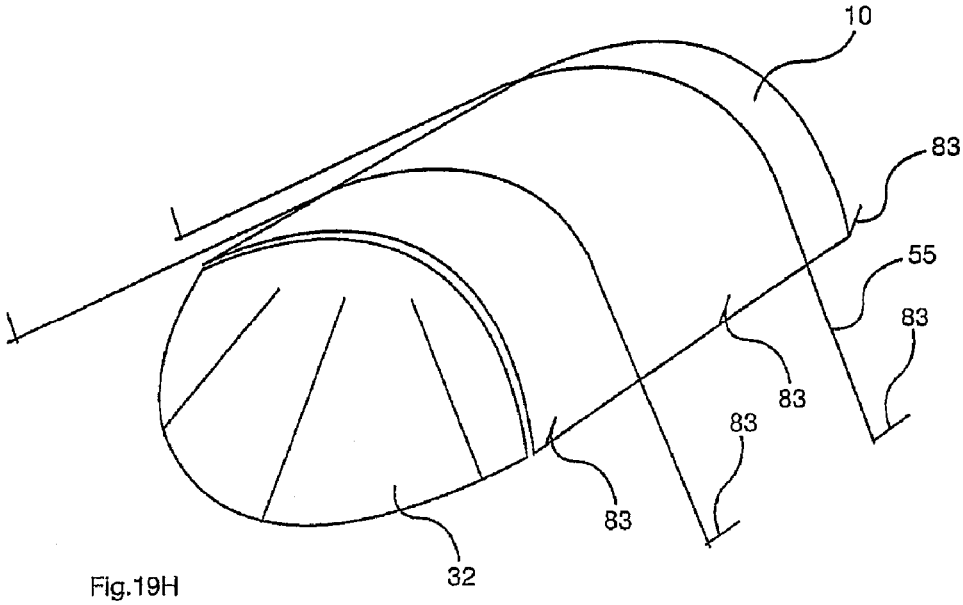

FIG. 19H is a perspective of a tent-like shelter.

Figure 19J:
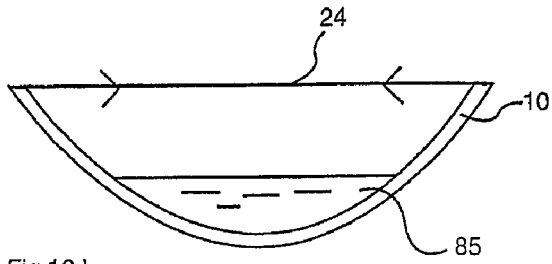

FIG. 19J is a cross-section through a water duct.

Figure 19K:
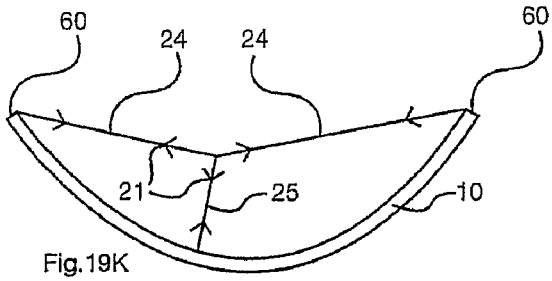

FIG. 19K is a cross-section through a lounger seat structure.

Figure 19L:
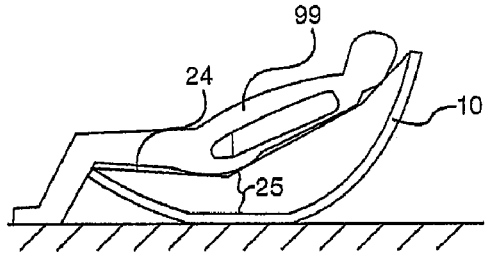

FIG. 19L is a cross-section through a deformed lounger seat structure in use.

Figure 19M:
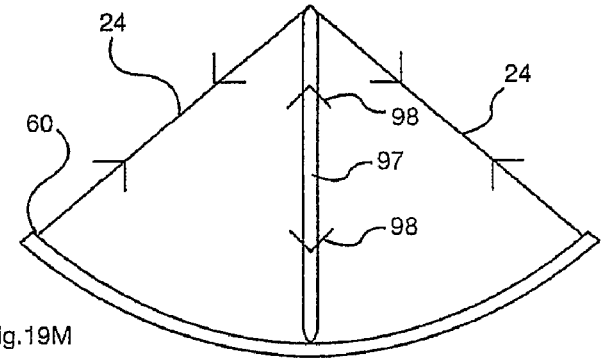

FIG. 19M is a cross-section through a tied, flexed panel with an intermediate prop member.

Figure 19N:
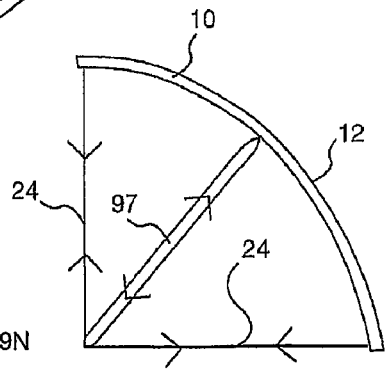

FIG. 19N is a cross-section through a tied, flexed panel with an intermediate prop member used for display.

Figure 19P:
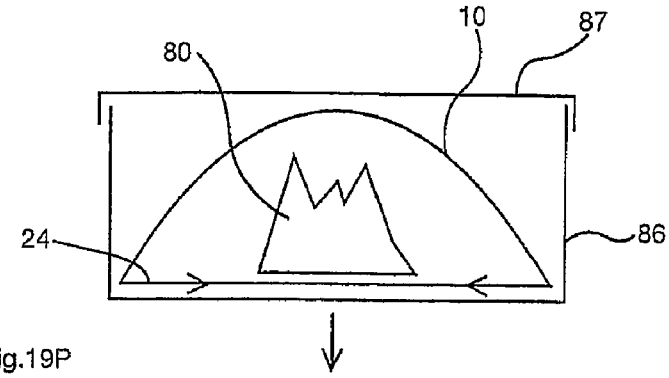

FIG. 19P is a cross-section through a box containing an assembly which contains an object.

Figure 19Q:
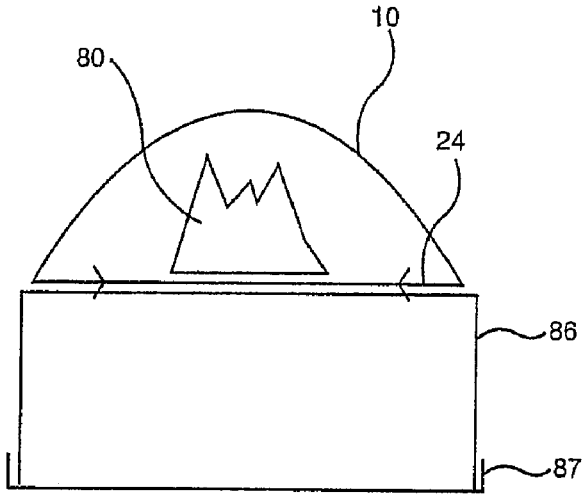

FIG. 19Q is a cross-section of the assembly containing an object displayed on an upturned box.

Figure 19R:
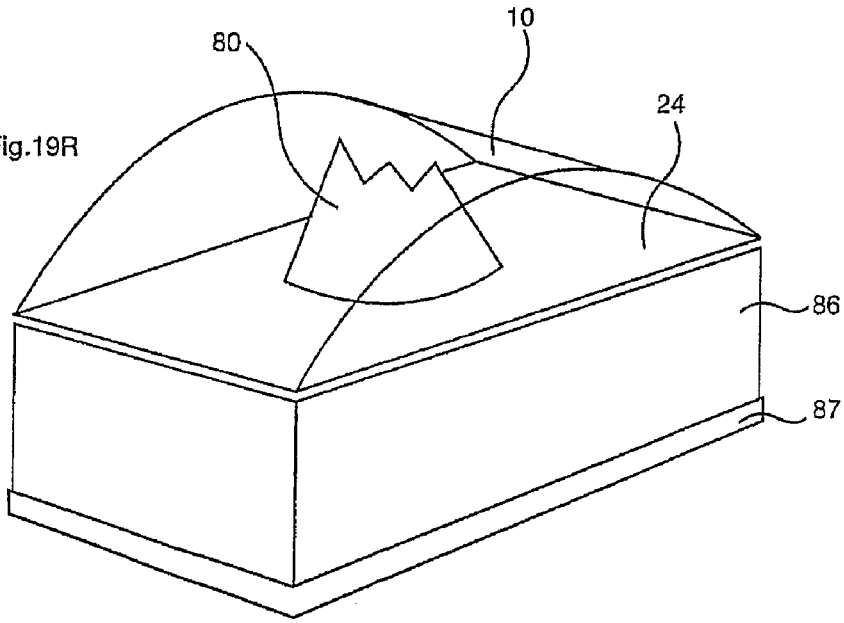

FIG. 19R is a perspective of the assembly containing an object displayed on an upturned box.

Figure 19S:
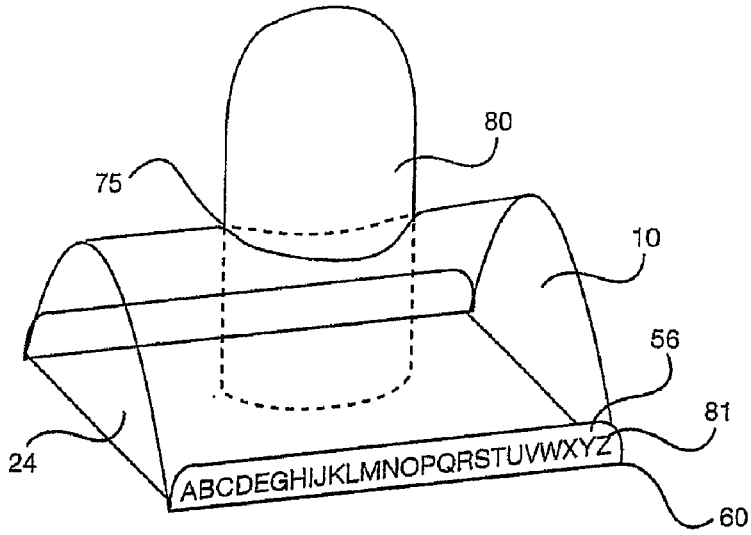

FIG. 19S is a perspective of a display assembly with a hole in the panel through which a displayed object projects.

Figure 19T:
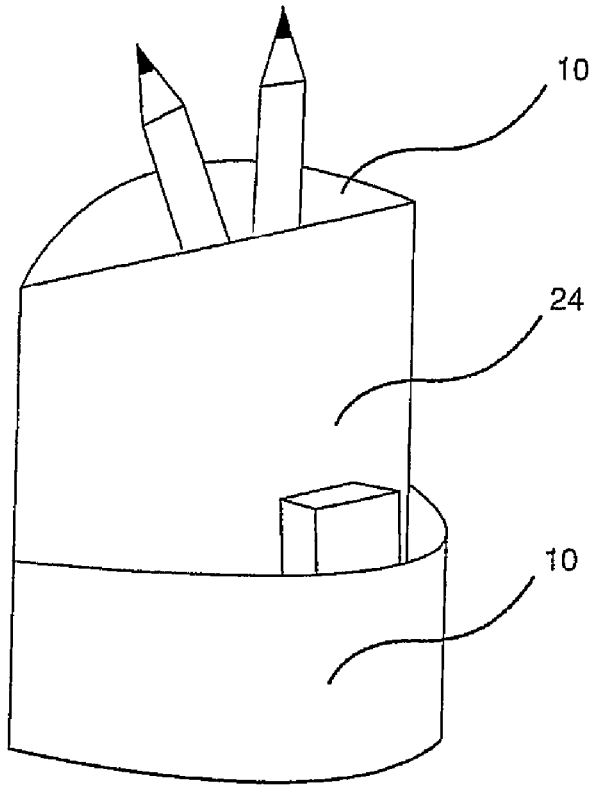

FIG. 19T is a perspective of "desk tidy".

Figure 19U:
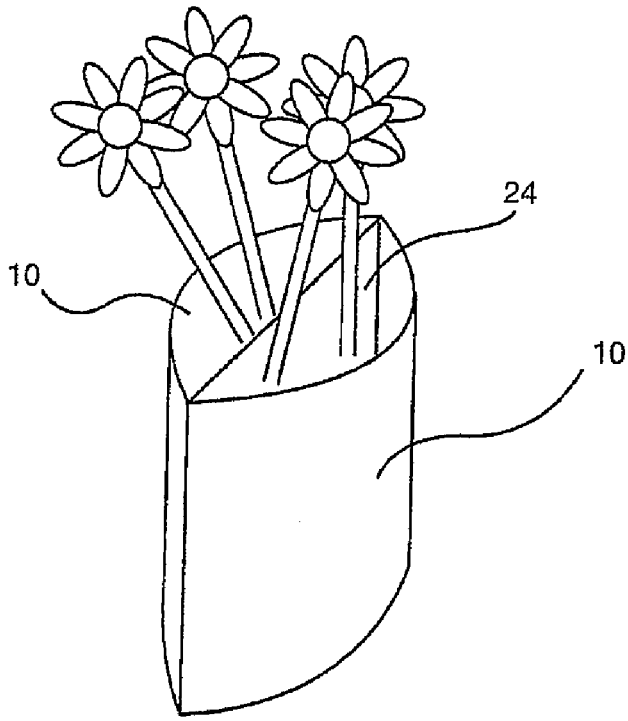

FIG. 19U is a perspective of a vase.

Figure 19V:
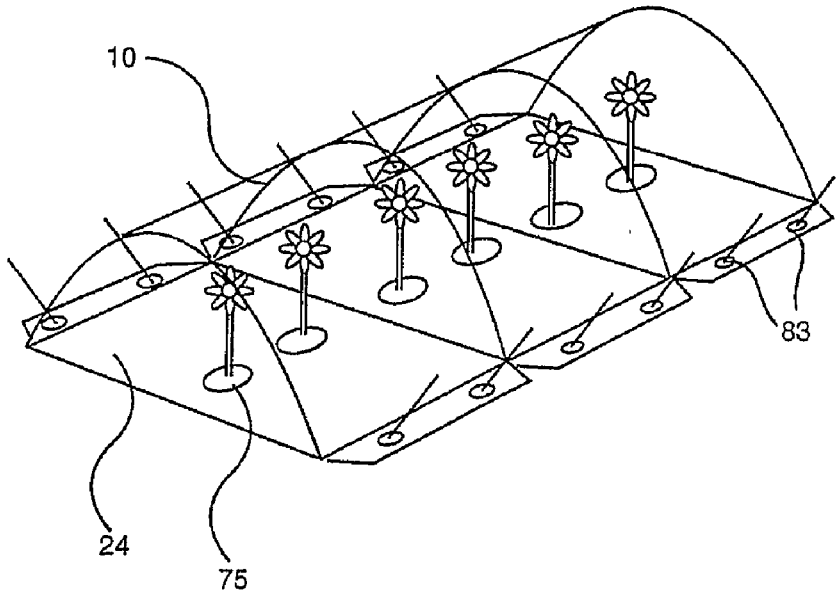

FIG. 19V is a perspective of a garden cloche system.

Figure 19W:
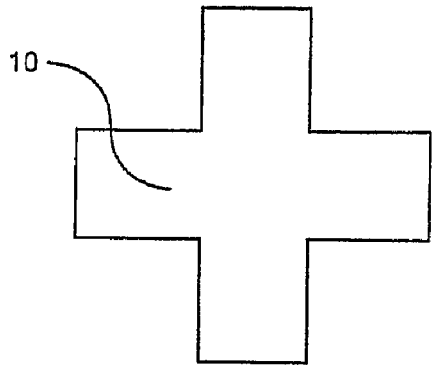

FIG. 19W is a plan of a cruciform panel.

Figure 19X:
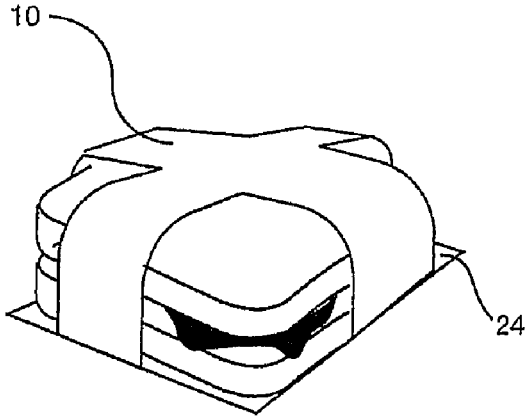

FIG. 19X is a perspective of a packed sandwich.

Figure 19Y:
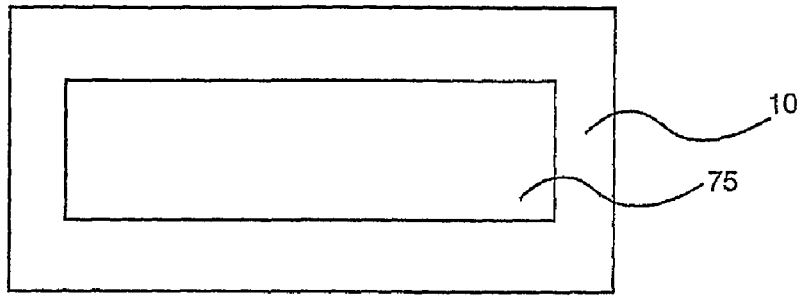

FIG. 19Y is a plan of a rectangular panel with a rectangular hole.

Figure 19Z:
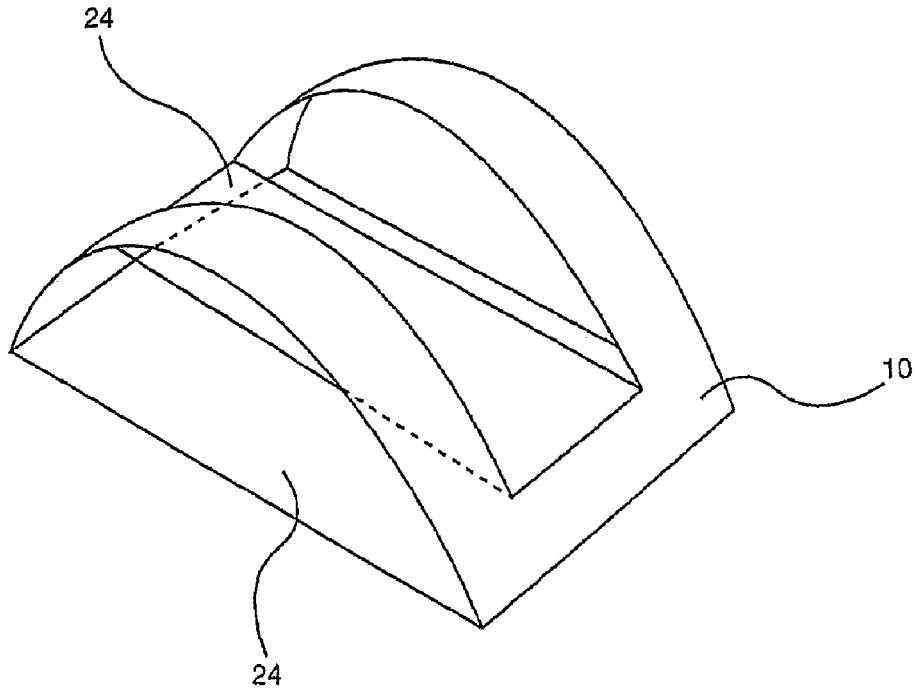
Figure 19A:
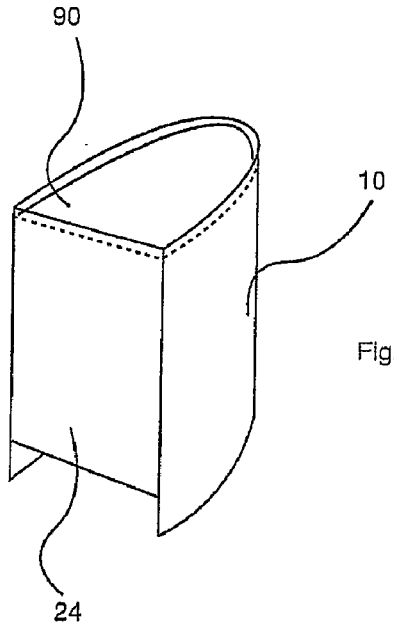
Figure 19B:
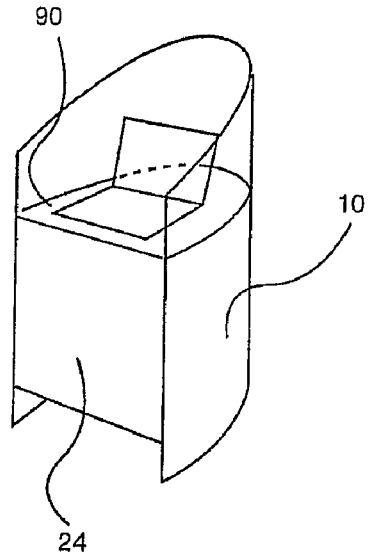
Figure 19C:
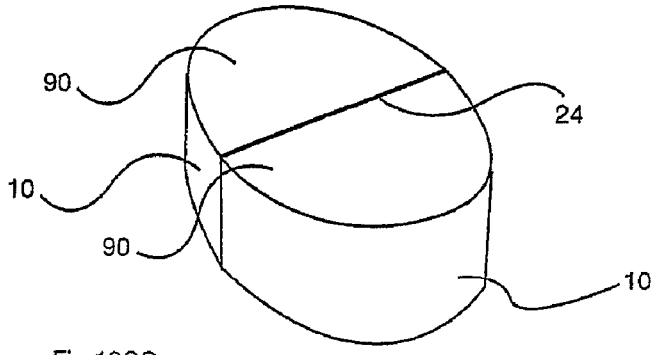
Figure 19D:
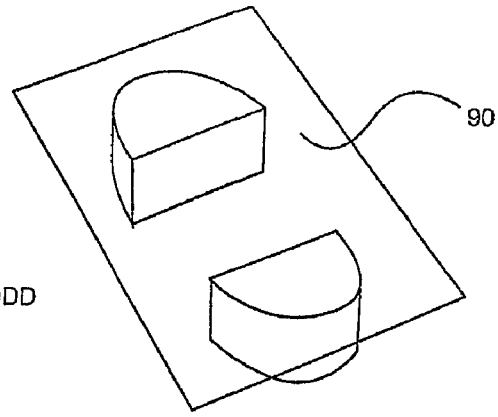
Figure 19E:
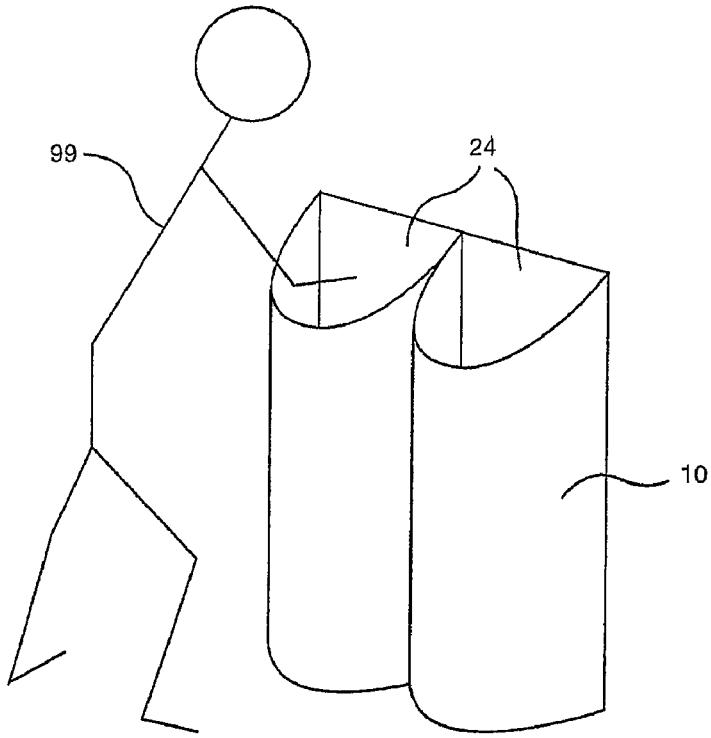
Figure 19F:
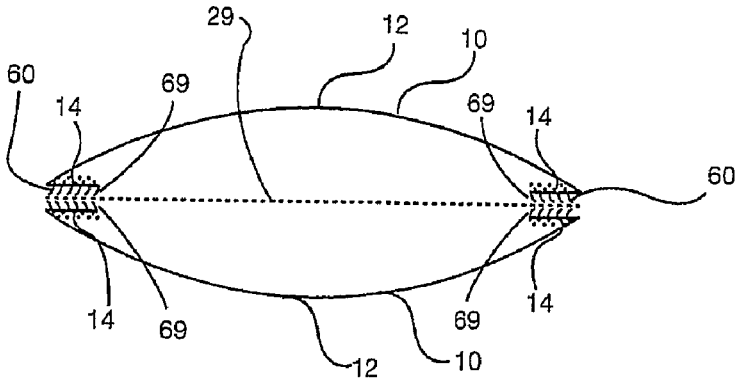
Figure 19G:
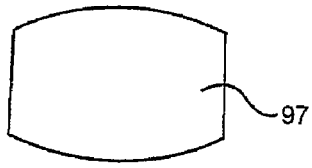
Figure 19H:
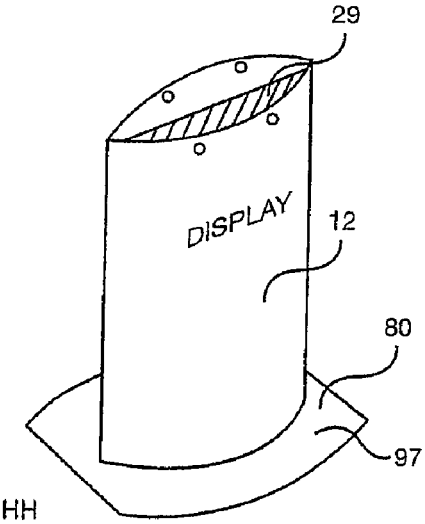
Figure 19J:
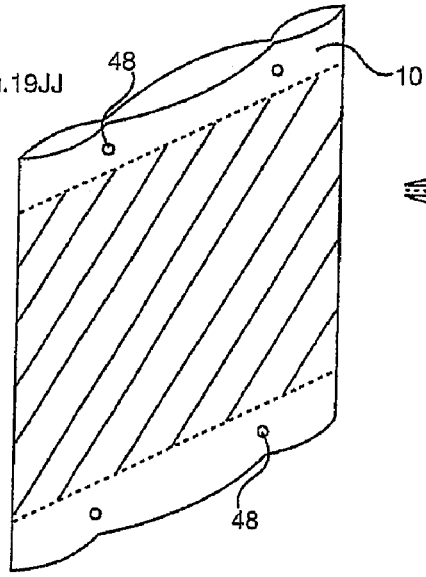
Figure 19K:
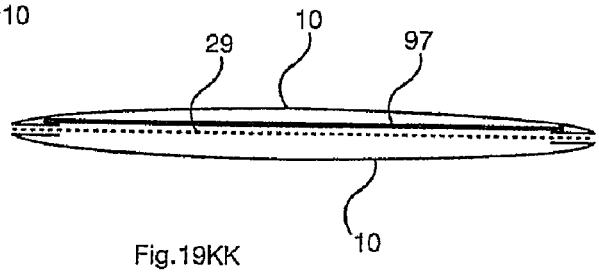
Figure 19L:
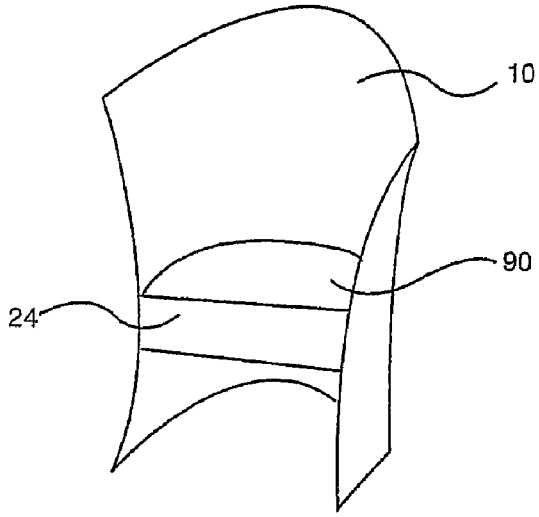
Figure 19M:
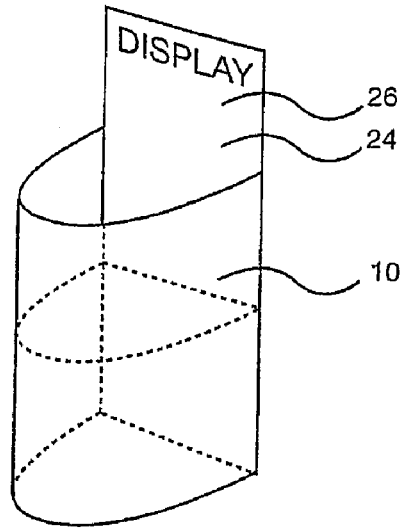
Figure 19N:
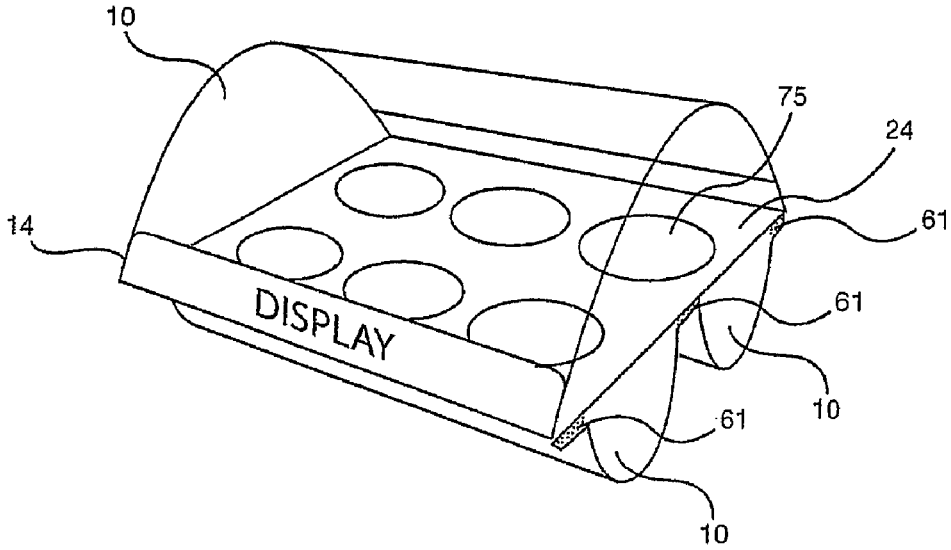
Figure 19P:
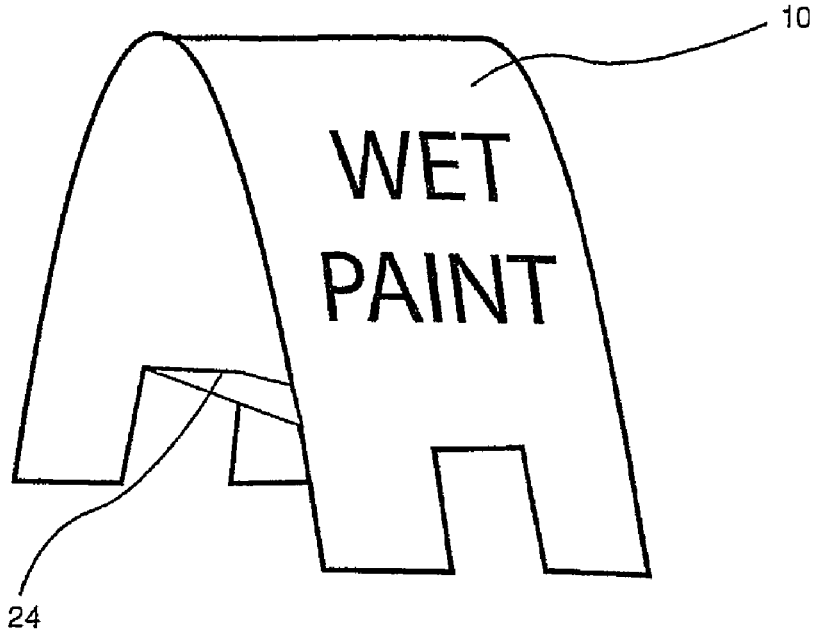

FIG. 19Z is a perspective of a flexed rectangular panel with a rectangular hole with two membrane ties.

FIG. 19AA is a perspective of a podium.

FIG. 19BB is a perspective of a podium.

FIG. 19CC is a perspective of a plinth comprising two assemblies.

FIG. 19DD is a perspective of a table comprising two assemblies.

FIG. 19EE is a perspective showing two bin assemblies.

FIG. 19FF is a cross-section through a display assembly comprising two flexed panels with a mutual, fabric membrane tie.

FIG. 19GG is a plan of a flat base member.

FIG. 19HH is a perspective of a display assembly.

FIG. 19JJ is a perspective of a stored display assembly.

FIG. 19KK is a cross-section through a stored display assembly.

FIG. 19LL is a perspective of a chair.

FIG. 19MM is a perspective of a retail display unit.

FIG. 19NN is a perspective of an egg packaging assembly.

FIG. 19PP is a perspective of a floor mounted sign.

Figure 20A:
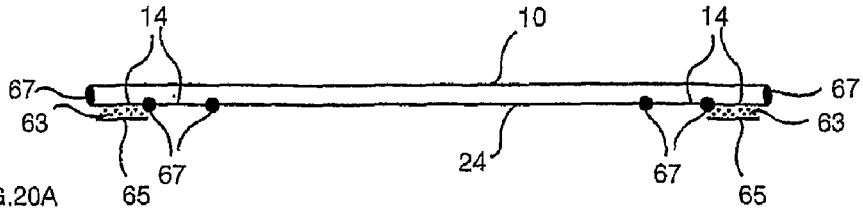

FIG. 20A is a cross-section through a stored assembly.

Figure 20B:
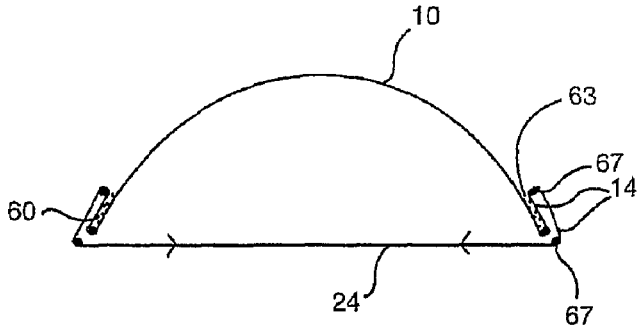

FIG. 20B is a cross-section through a tied, flexed panel assembly.

Figure 20C:
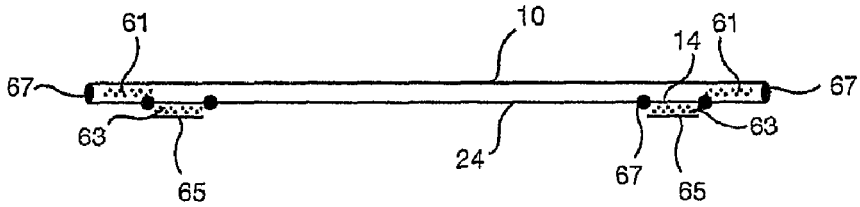

FIG. 20C is a cross-section through a stored assembly.

Figure 20D:
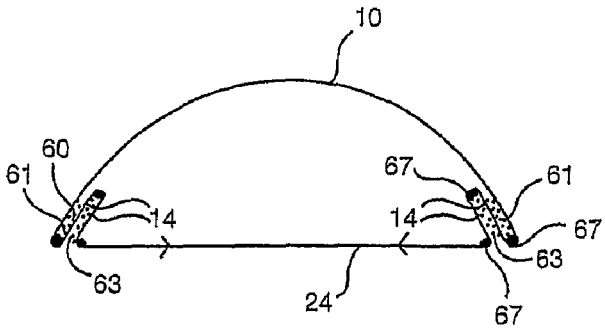

FIG. 20D is a cross-section through a tied, flexed panel assembly.

FIGS. 21A-E are cross-sections through linear connectors.

FIGS. 22A-H, 22J-N, and 22P-Y are cross-sections through linear connectors.

FIGS. 23A-H, 23J-N, and 23P-W are cross-sections through linear connectors.

FIGS. 24A-H, 24J-N, and 24P-R are cross-sections through linear connectors.

Figure 24A:
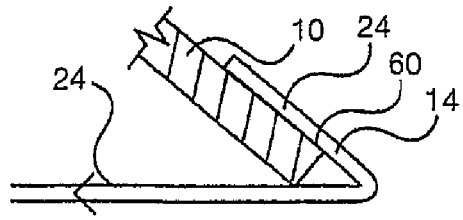
Figure 24B:
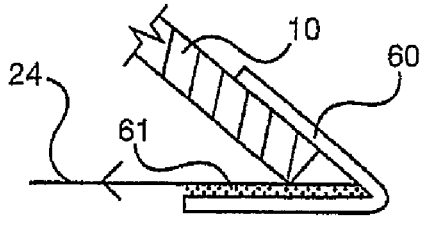
Figure 24C:
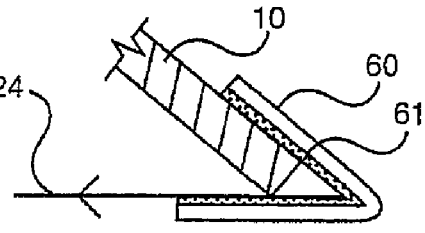
Figure 24D:
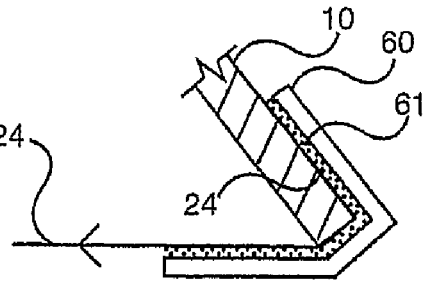
Figure 24E:
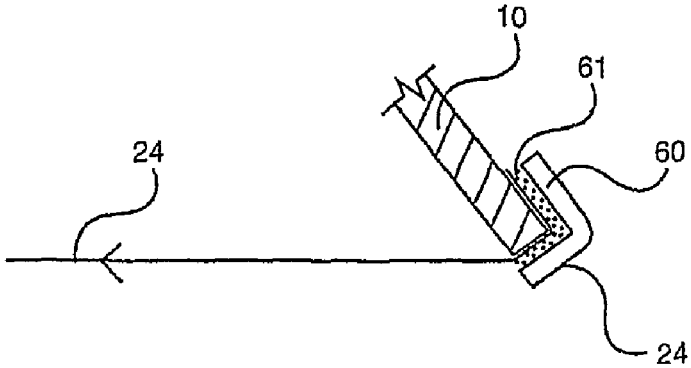
Figure 24F:
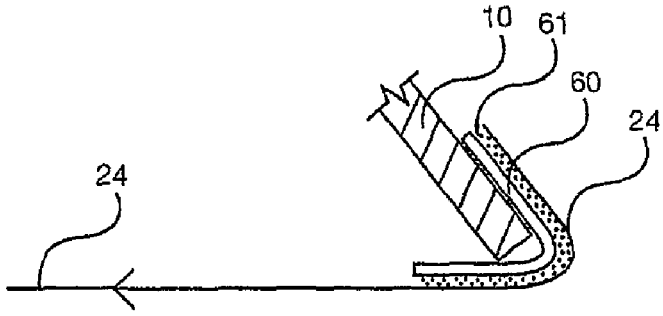
Figure 24G:
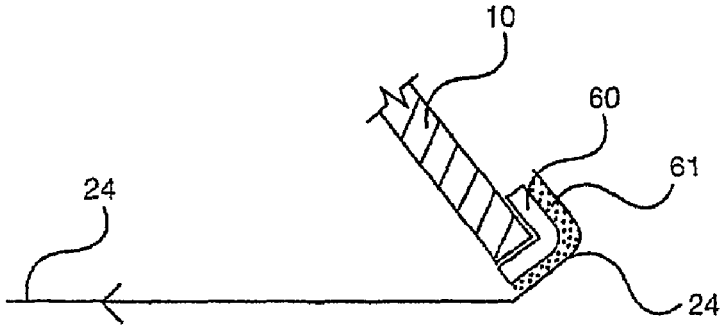
Figure 24H:
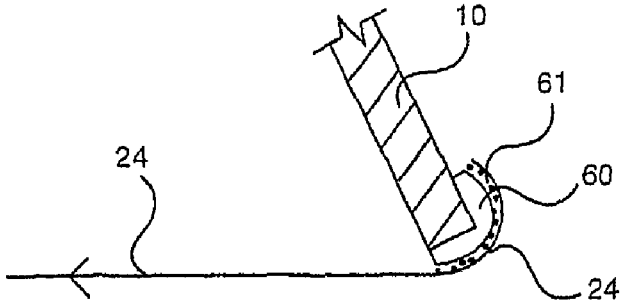
Figure 24J:
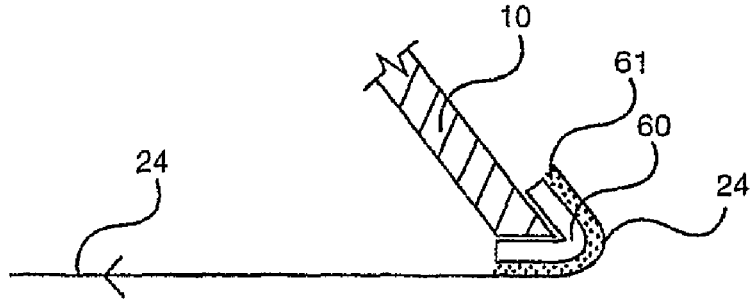
Figure 24K:
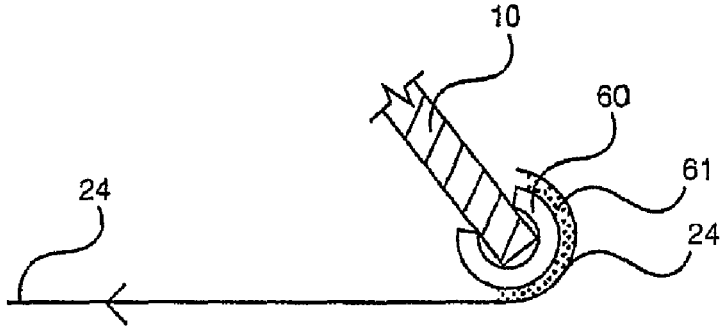
Figure 24L:
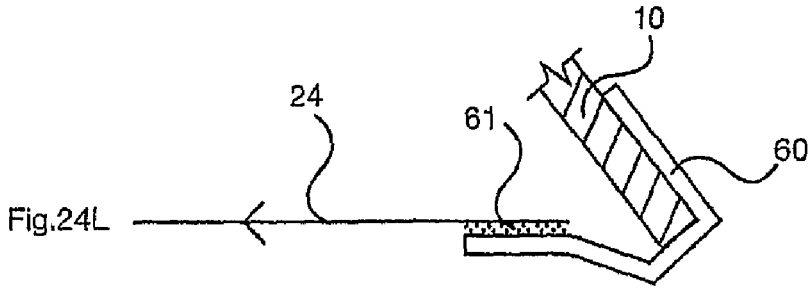
Figure 24M:
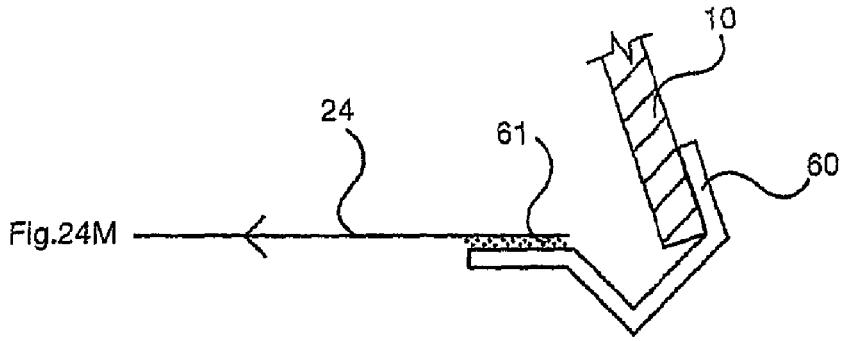
Figure 24N:
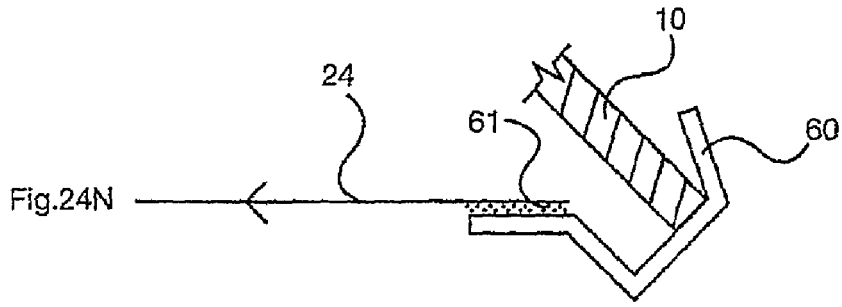
Figure 24P:
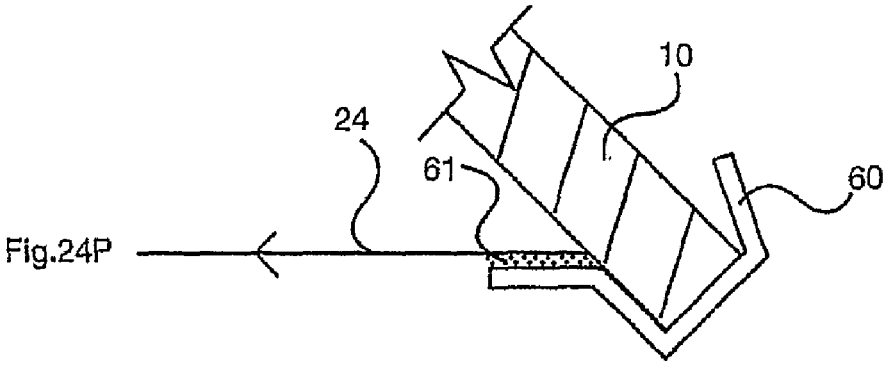
Figure 24Q:
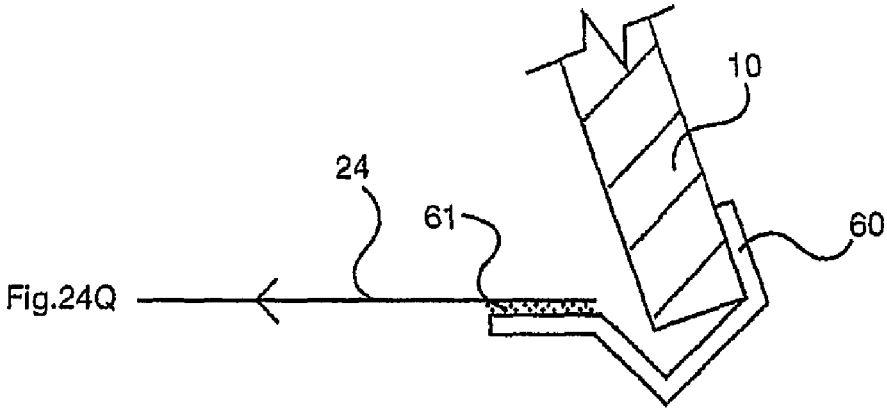
Figure 24R:
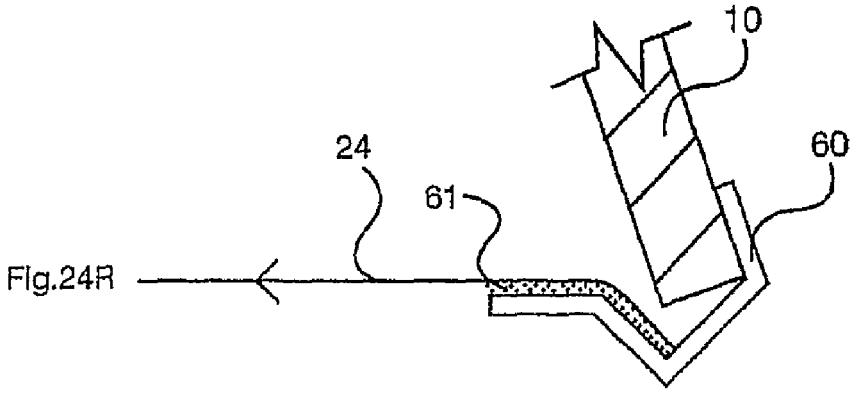
Figure 24S:
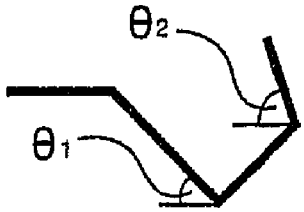
Figure 24T:
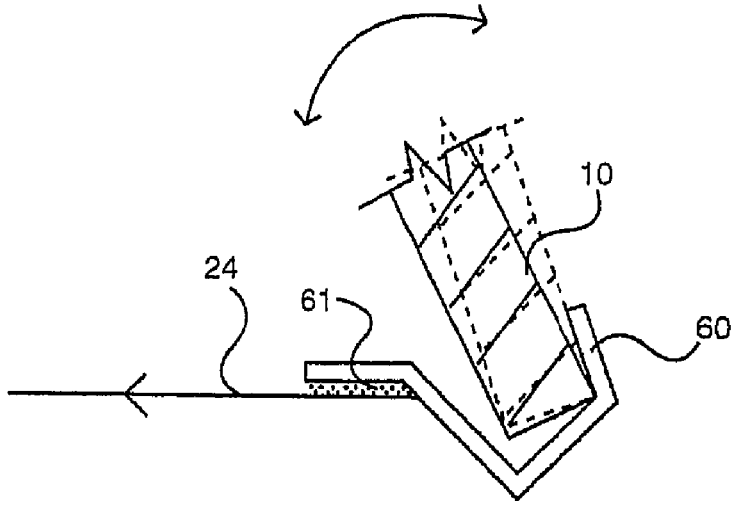

FIG. 24S is a diagrammatic cross-section of the inside surface of a linear connector.

FIGS. 24T-Z are cross sections through linear connectors.

FIGS. 25A-H, 25J, and 25K are cross-sections through linear connectors.

Figure 26A:
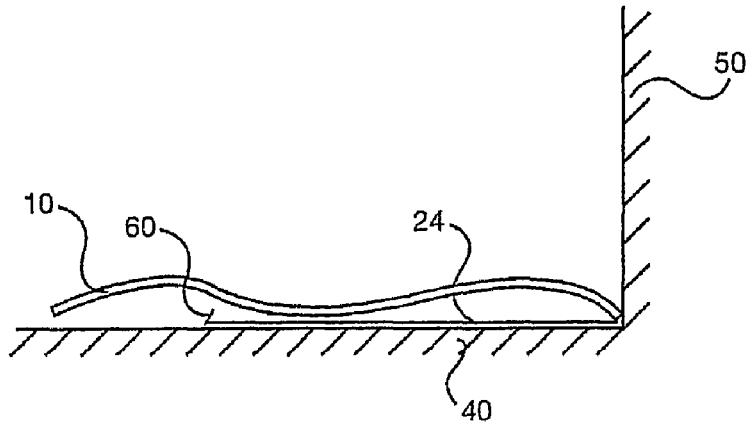
Figure 26B:
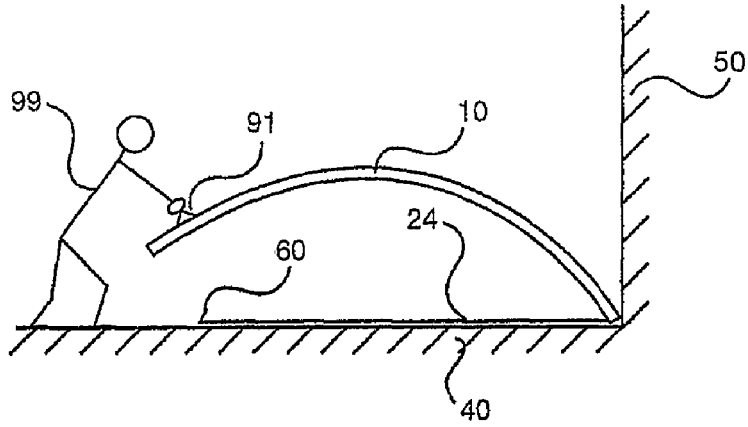
Figure 26C:
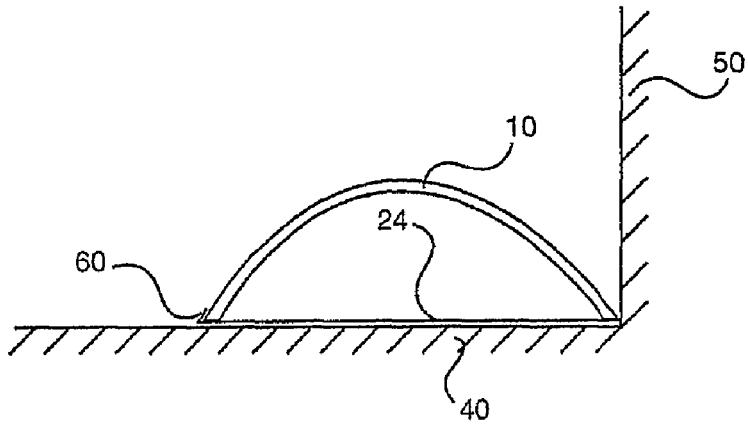

FIGS. 26A-C are cross-sections showing steps in the assembly of a tied, flexed panel structure.

Figure 26D:
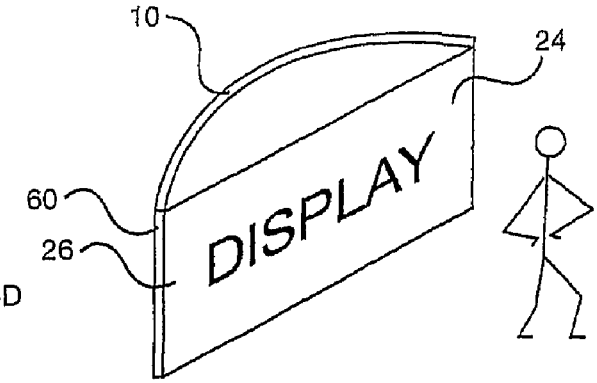

FIG. 26D is a perspective of a tied, flexed panel structure.

Figure 26E:
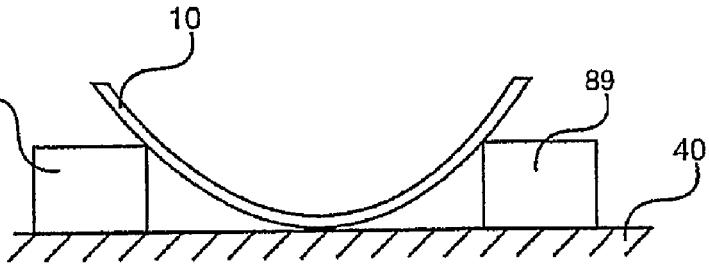

FIGS. 26E and F are cross-sections through steps in the assembly of a tied, flexed panel structure.

FIGS. 26G-H and 26J-K are cross-sections through steps in the assembly of a tied, flexed pane structure.

Figure 26F:
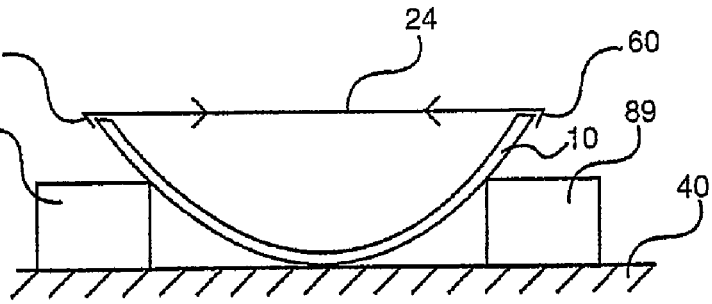
Figure 26L:
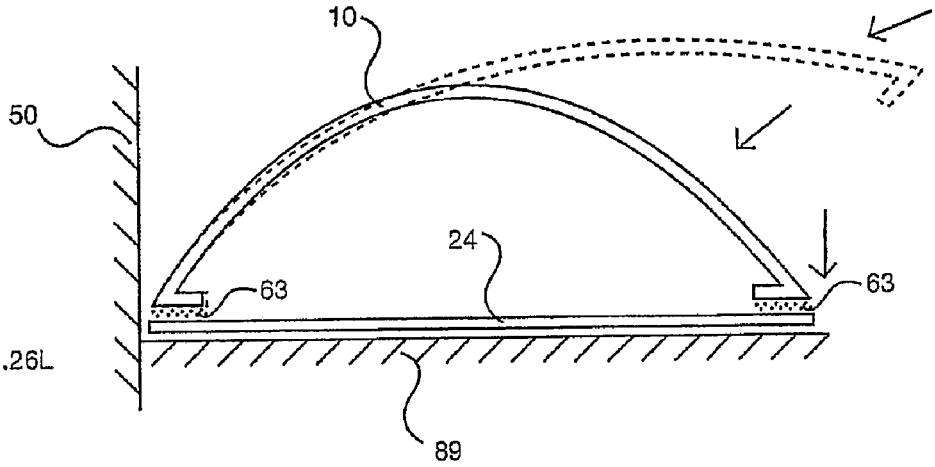

FIG. 26L is a cross-section illustrating the assembly of a tied, flexed panel structure.

Figure 26M:
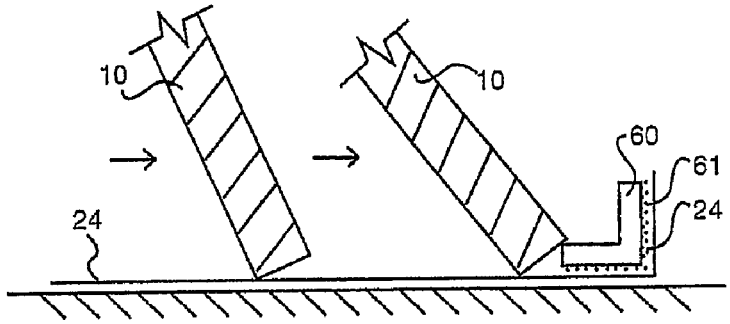

FIGS. 26M and N are cross-sections through steps in the assembly of a tied, flexed panel structure.

Figure 26N:
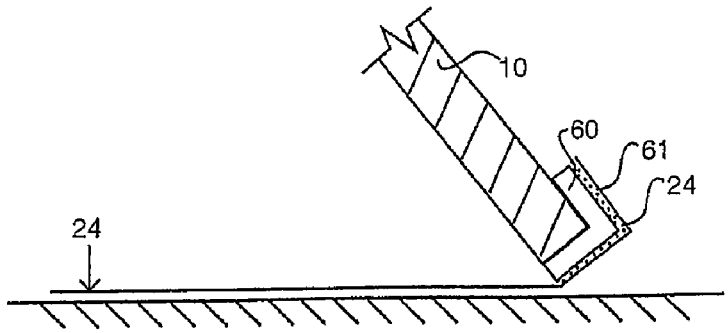
Figure 26P:
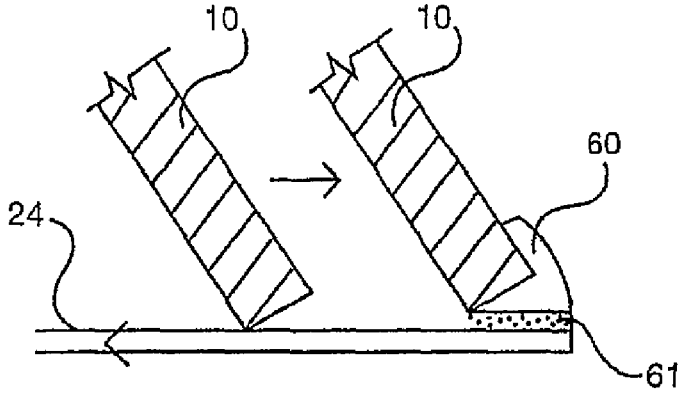

FIGS. 26P and Q are cross-sections through steps in the assembly of a tied, flexed pane structure.

Figure 27A:
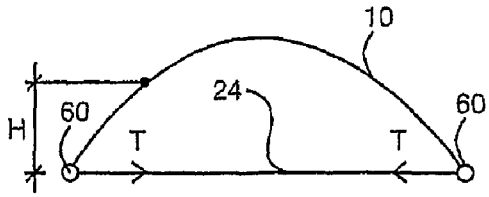

FIG. 27A is a diagrammatic cross-sectional representation of a tied, flexed panel structure.

Figure 27B:
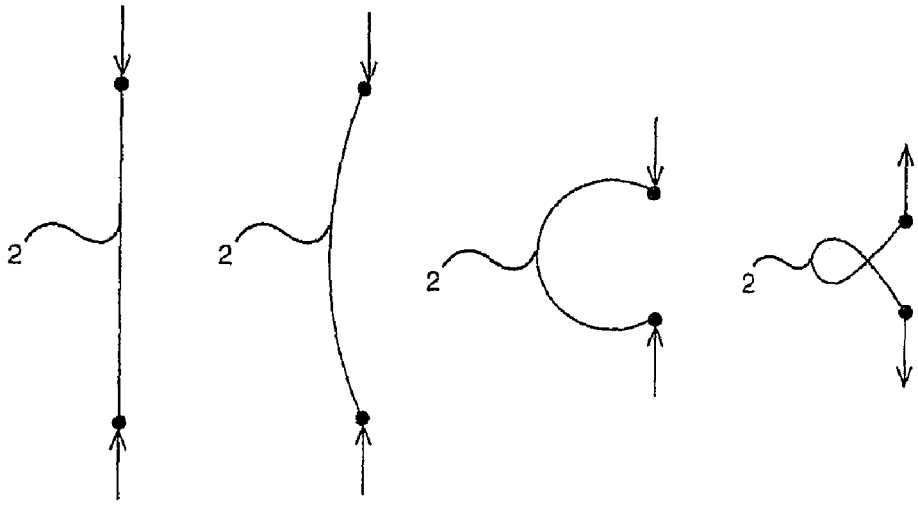

FIG. 27B comprises four stage elevations of a linear member subject to opposing end forces.

Figure 27C:
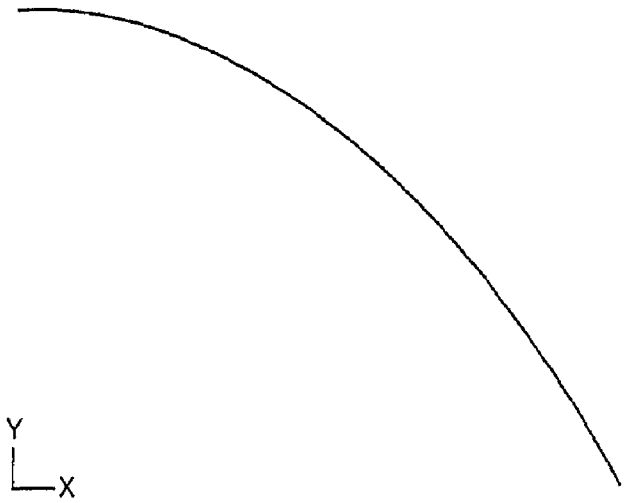

FIG. 27C is a diagrammatic cross-section through a calculated curve of half of a flexed panel.

Figure 28A:
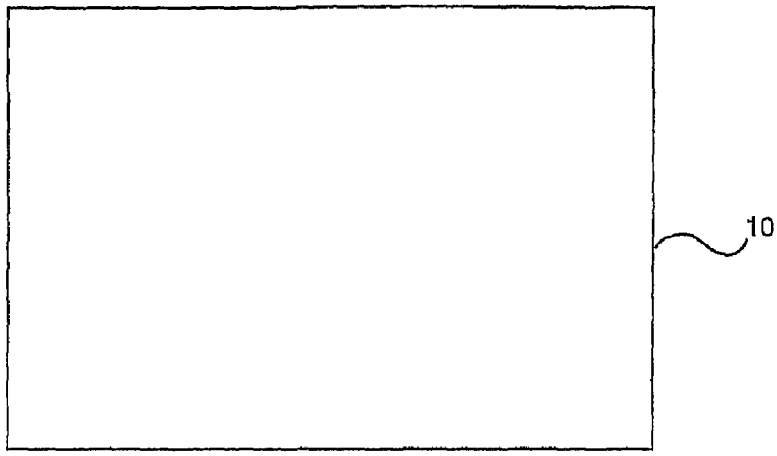

FIG. 28A is a plan of a panel.

Figure 28B:
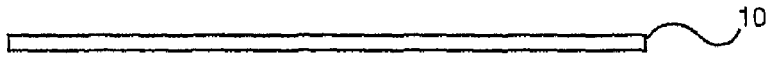

FIG. 28B is an edge elevation of a panel.

Figure 28C:
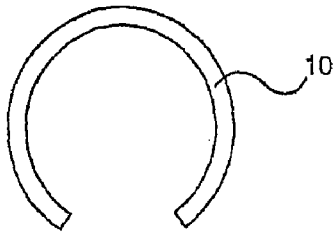

FIG. 28C is an edge elevation of a flexed panel.

Figure 28D:
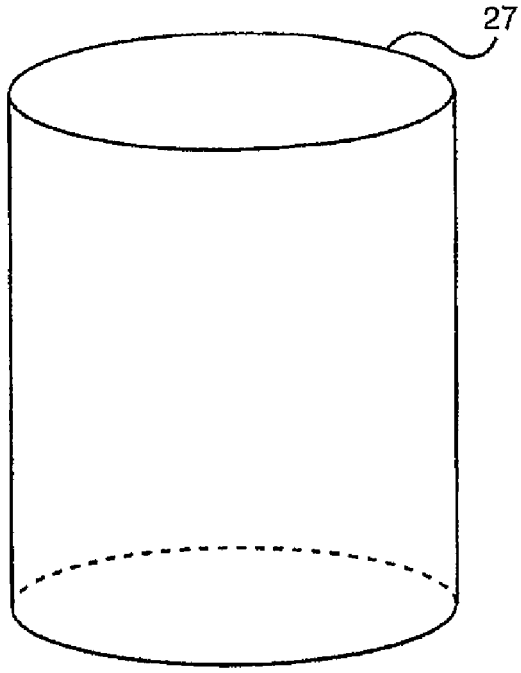

FIG. 28D is a perspective of a tubular membrane.

Figure 28E:
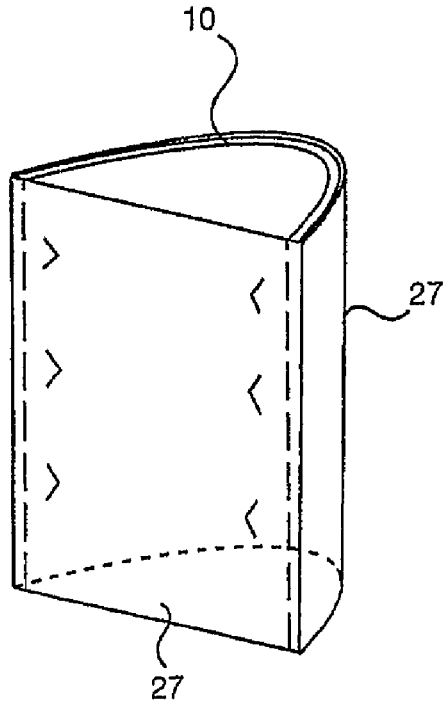

FIG. 28E is a perspective of a flexed panel within a tubular membrane.

Figure 28F:
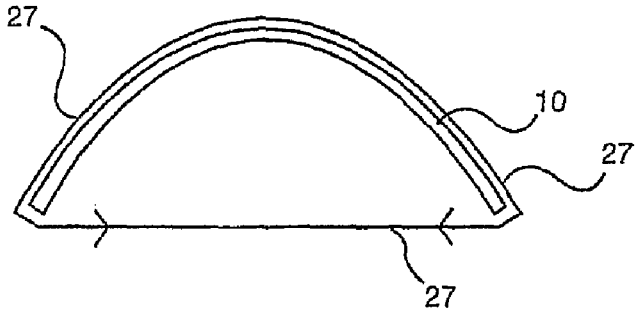

FIG. 28F is a diagrammatic cross-section of a flexed panel within a tubular membrane.

Figure 28G:
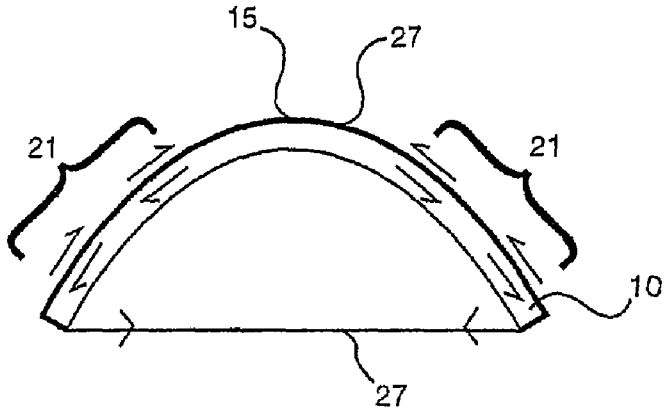

FIG. 28G is a diagrammatic cross-sectional representation of a flexed panel within a tubular membrane indicating frictional forces.

Figure 28H:
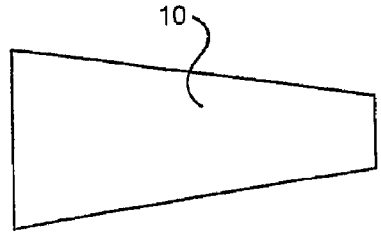

FIG. 28H is a plan of a panel.

Figure 28J:
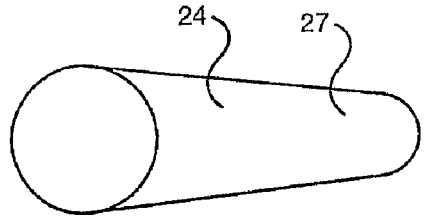

FIG. 28J is a perspective of a tapered tubular membrane.

Figure 28K:
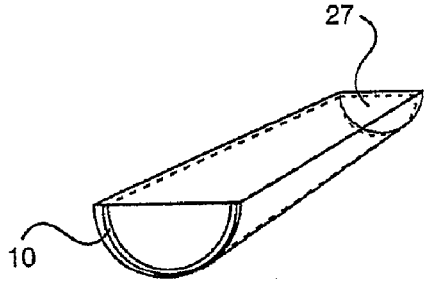

FIG. 28K is a perspective of a flexed panel within a tapered tubular membrane.

Figure 28L:
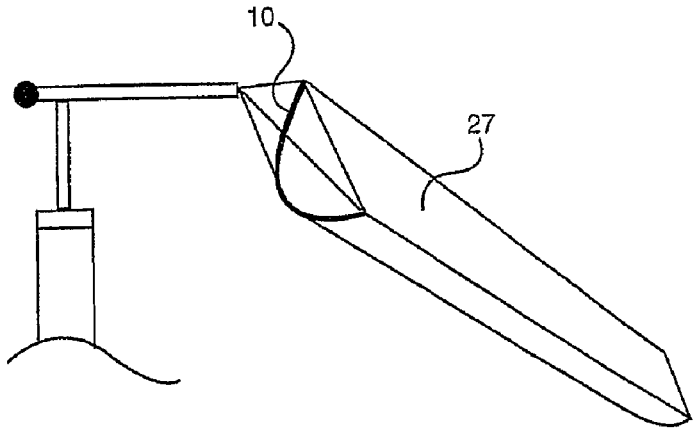

FIG. 28L is a perspective of a windsock assembly.

Figure 28M:
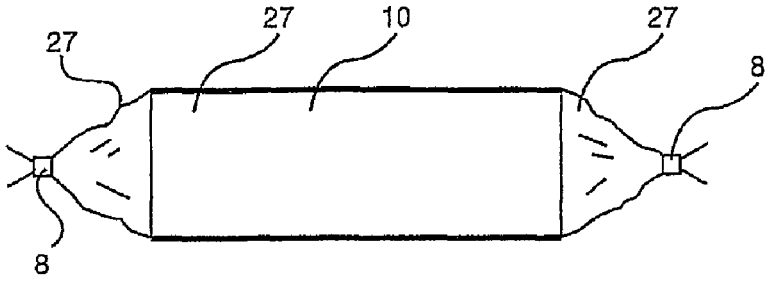

FIG. 28M is an elevation of a packaging assembly comprising a tubular membrane.

Figure 28N:
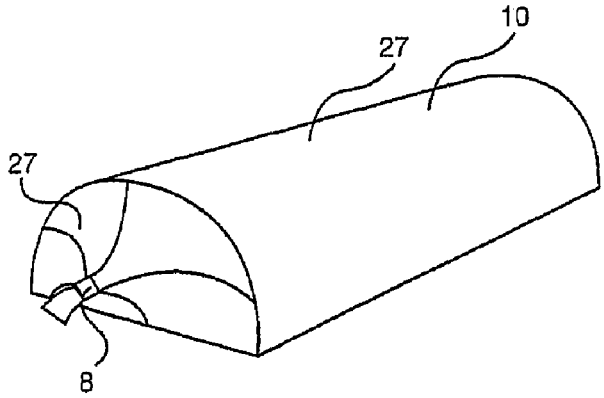

FIG. 28N is a perspective of a packaging assembly comprising a tubular membrane.

Figure 29A:
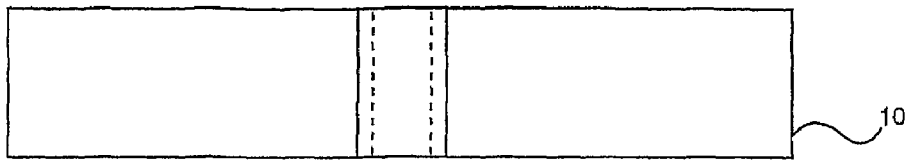

FIG. 29A is a perspective of a panel.

Figure 29B:
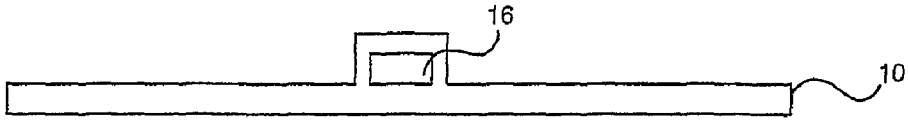

FIG. 29B is a plan of the edge of a panel.

Figure 29C:
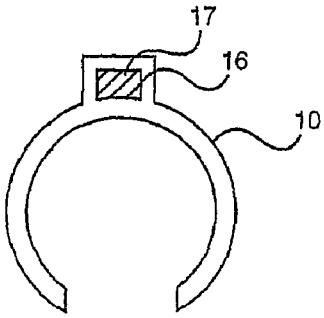

FIG. 29C is a plan of a flexed panel.

Figure 29D:
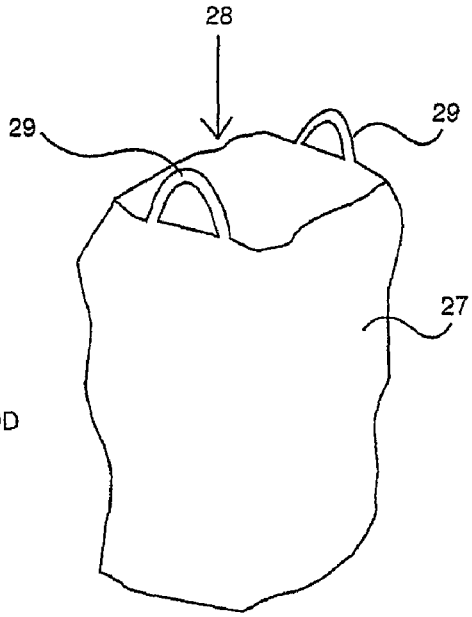

FIG. 29D is a flexible bag.

Figure 29E:
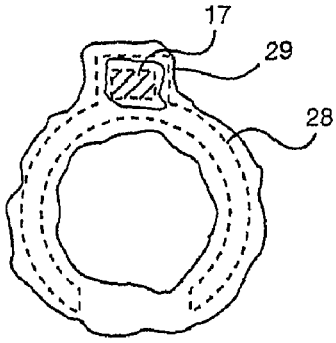

FIG. 29E is a plan of the top of a bag surrounding a tied, flexed panel.

Figure 29F:
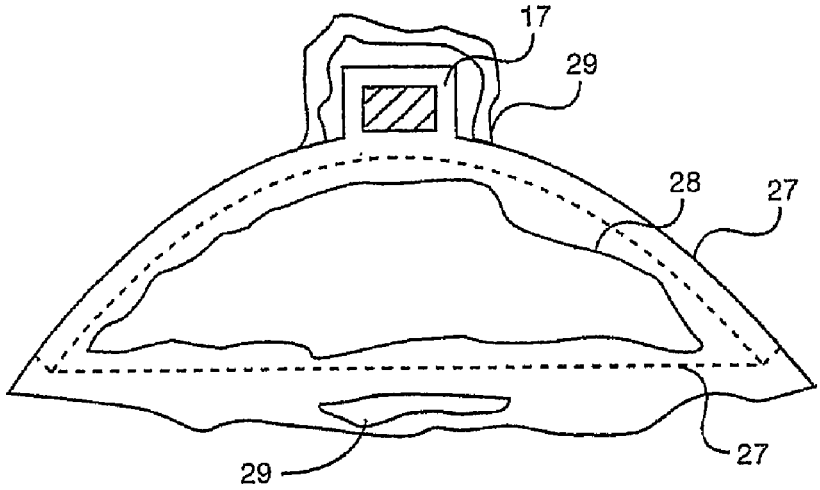

FIG. 29F is a plan of the top of a bag surrounding a released tied, flexed panel.

Figure 29G:
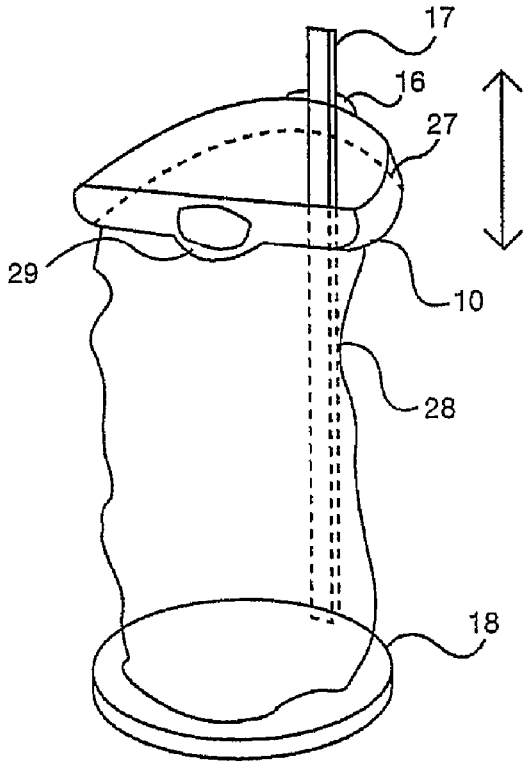

FIG. 29G is a perspective of a bin-bag assembly.

FIG. 29H is a plan of a panel.

FIG. 29J is an edge elevation of a panel.

FIG. 29K is a perspective of a flexible bag.

FIG. 29L is a cross-section through a flexible bag containing a flexed panel.

FIG. 29M is a perspective of a bin-bag assembly.

Figure 29N:
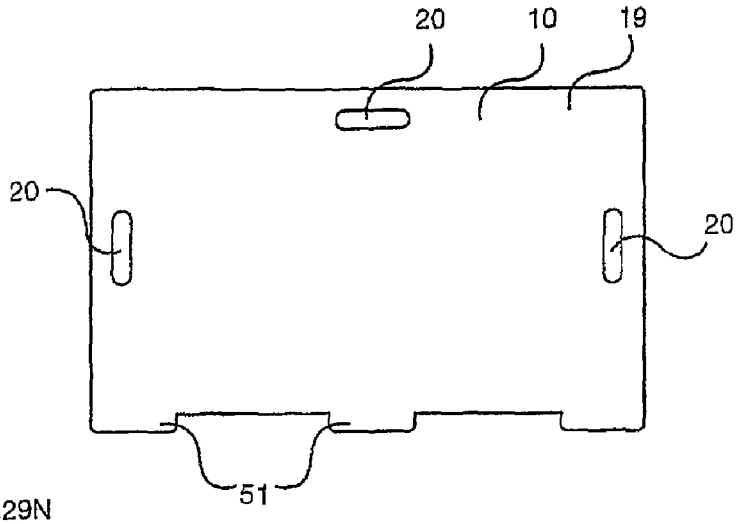

FIG. 29N is a plan of a panel comprising slots and protruding "feet".

Figure 29P:
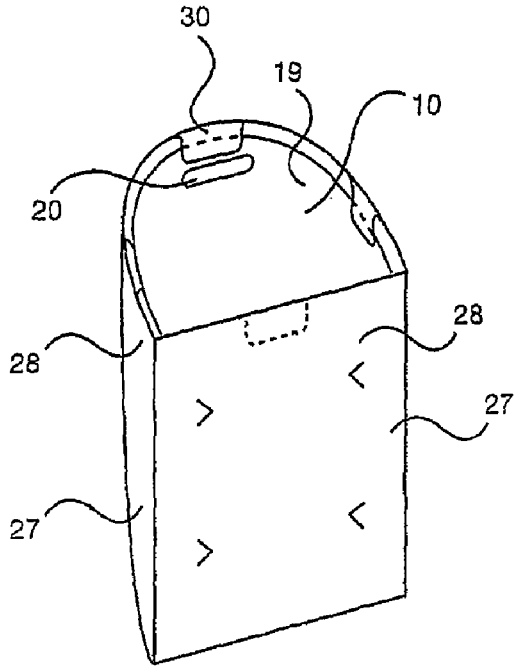

FIG. 29P is a perspective of a bin bag assembly.

Figure 29Q:
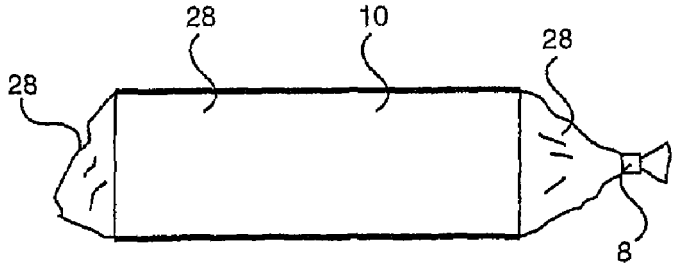

FIG. 29Q is an elevation of a packaging assembly comprising a flexible bag.

Figure 30A:
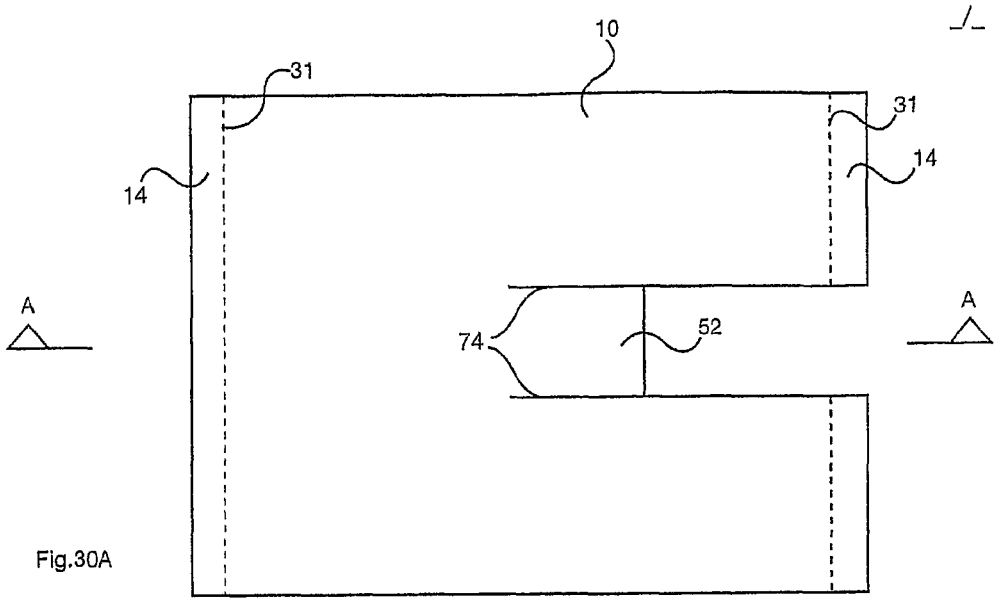

FIG. 30A is a plan of a panel which comprises a "flying leg".

Figure 30B:
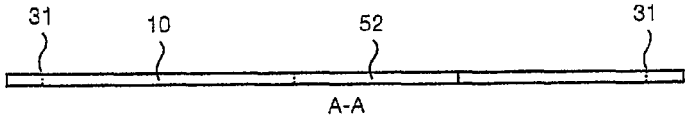

FIG. 30B is a cross-section through a panel comprising a "flying leg".

Figure 30C:
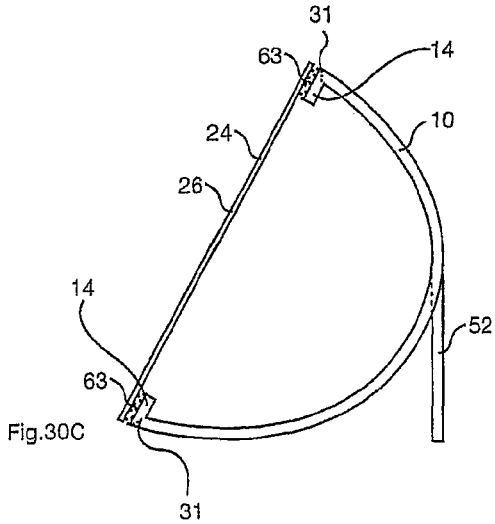

FIG. 30C is a cross-section through an assembly comprising a "flying leg".

FIG. 30D is a perspective of an assembly comprising a "flying leg".

FIG. 30E is a plan of a panel comprising a "flying leg".

DETAILED DESCRIPTION OF EMBODIMENTS OF THE INVENTION

Figure 1A:
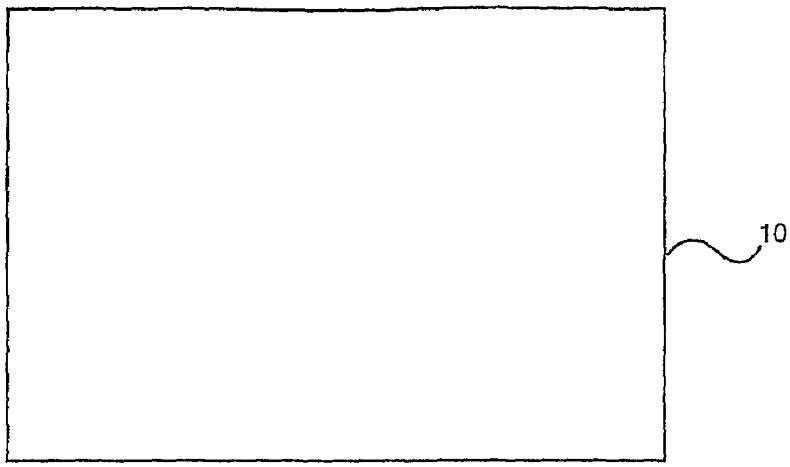
FIG. 1A is a plan of a panel.
Figure 1B:
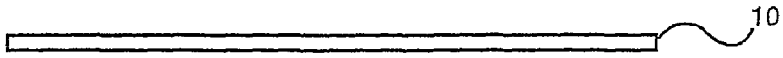
FIG. 1B is an edge elevation of a panel.
Figure 1C:
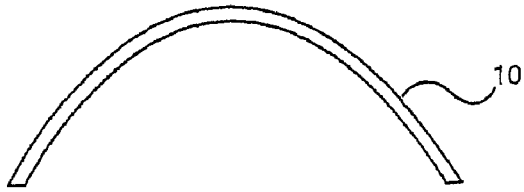
FIG. 1C is an elevation of a flexurally deformed panel.
Figure 1D:
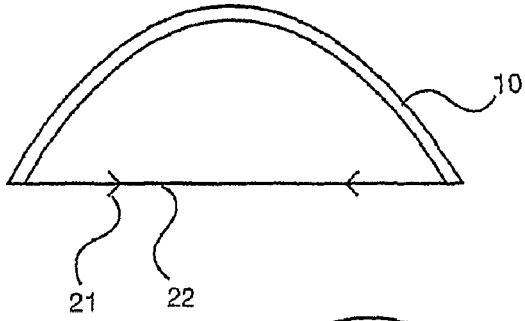
FIG. 1D is an elevation of a tied, flexurally deformed panel.
Figure 1E:
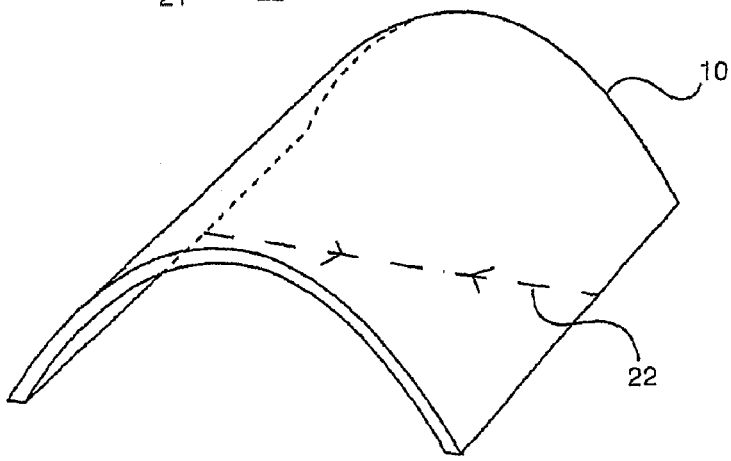
FIG. 1E is a perspective of a temporarily tied panel.
Figure 1F:
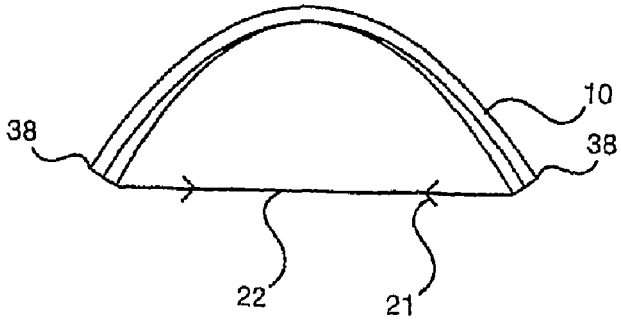
FIG. 1F is an elevation of a temporary assembly.
Figure 1G:
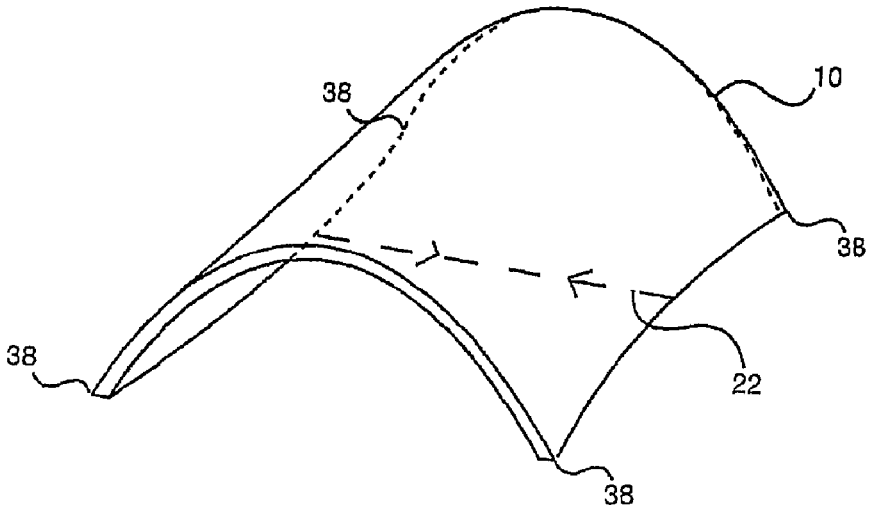
FIG. 1G is a perspective of a temporary assembly.

FIGS. 1A-G illustrate panel 10, tied by a single tie rod 22. Panel 10 is shown on plan in FIG. 1A and in edge elevation in FIG. 1B before flexure, illustrated in FIG. 1C. FIG. 1D illustrates single linear tie rod or cable 22 (the arrow heads 21 indicating tensile force) and a diagrammatic perspective of the resultant temporary assembly is illustrated in FIG. 1E. FIG. 1F illustrates the secondary deflection of the corners of the panel 38 in elevation, which is also shown in perspective in FIG. 1G. Such an assembly may be used temporarily to create an "intermediate panel geometry" before attaching the membrane tie and linear connector or connectors. In the final "flexurally deformed geometry", this secondary deflection or out-of-alignment is eliminated, a principle advantage of the invention.

Figure 2A:
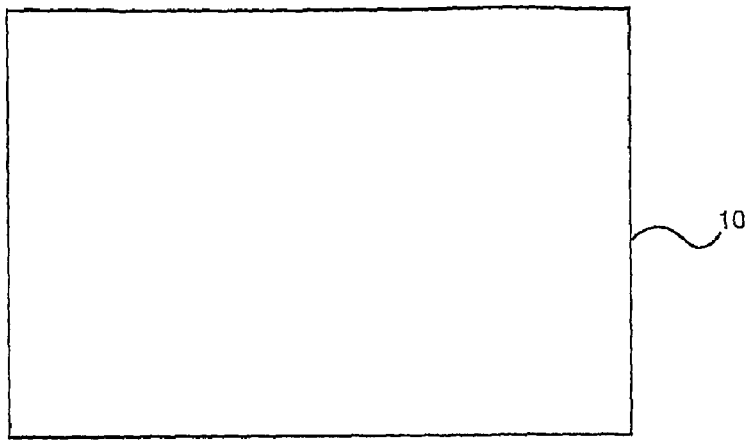
FIG. 2A is a plan of a panel.
Figure 2B:
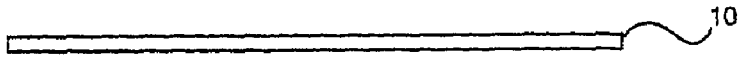
FIG. 2B is an edge elevation of a panel.
Figure 2C:
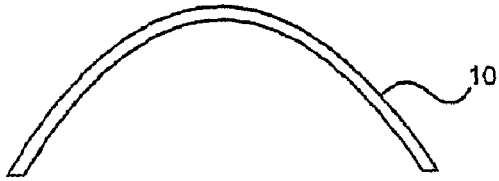
FIG. 2C is an elevation of a flexurally deformed panel.
Figure 2D:
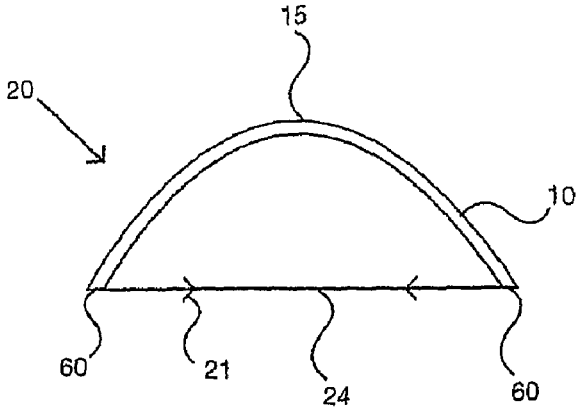
FIG. 2D is an elevation of an assembly.
Figure 2E:
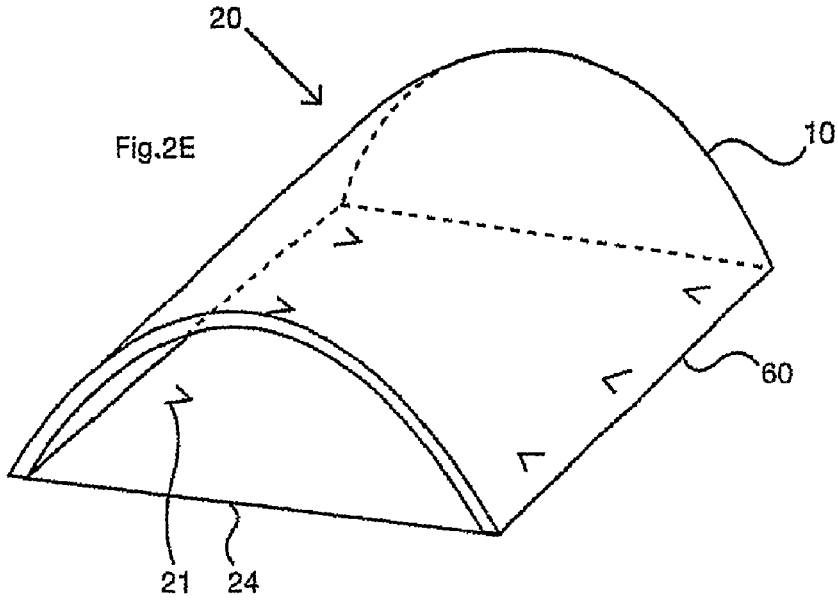
FIG. 2E is a perspective of an assembly with a horizontal membrane tie.
Figure 2F:
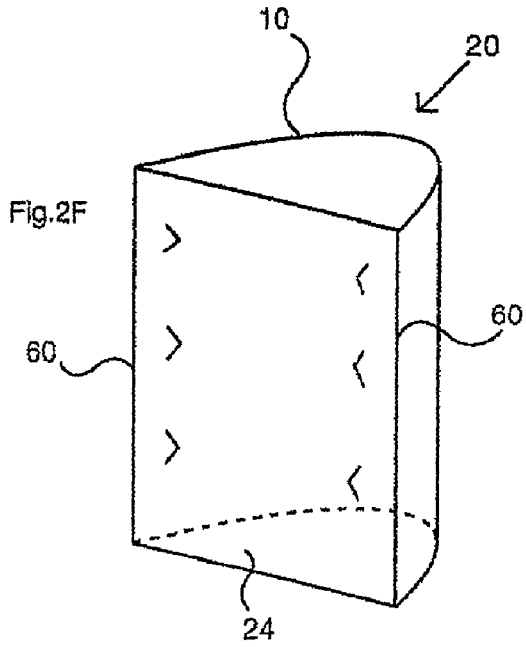
FIGS. 2F-H are perspectives of assemblies with a vertical membrane tie.
Figure 2G:
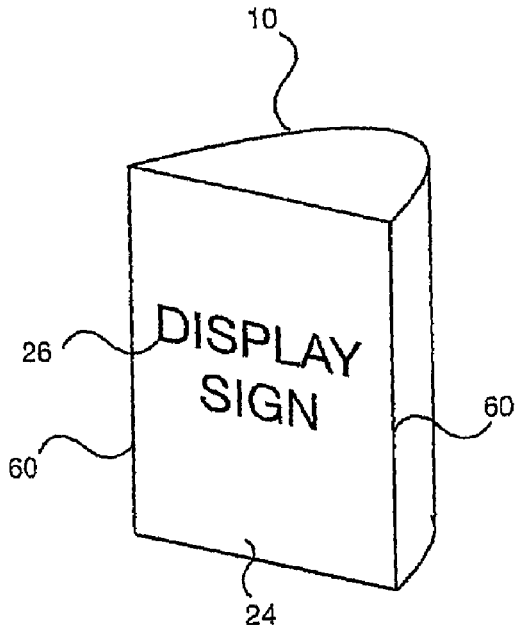
Figure 2H:
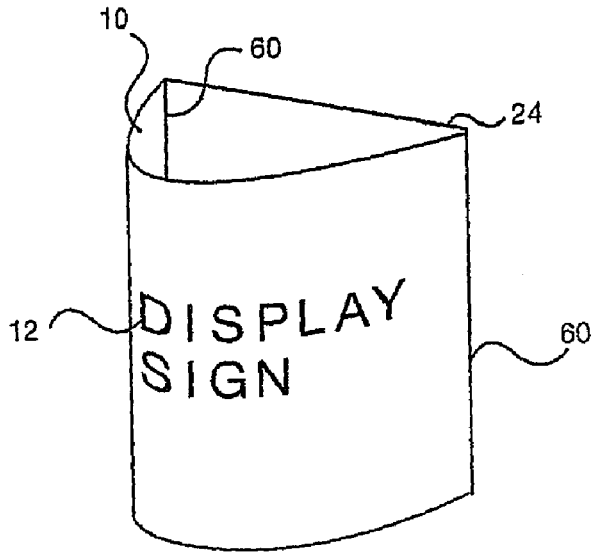
Figure 2J:
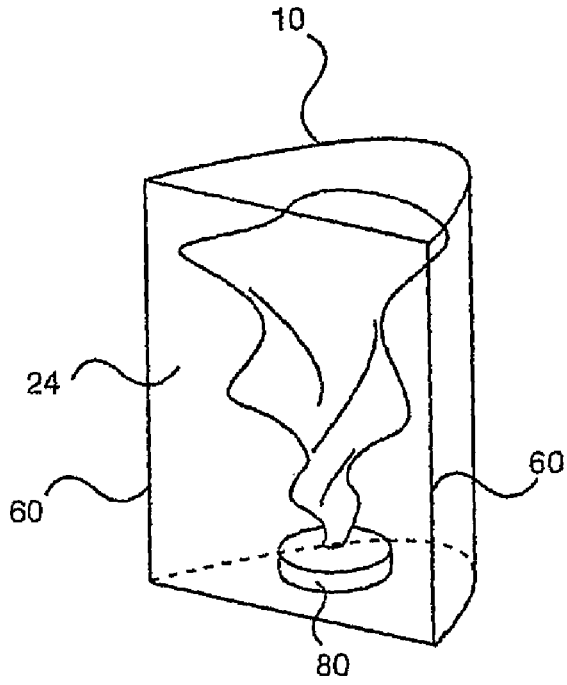
FIGS. 2J and K are perspectives of assemblies containing a displayed object.
Figure 2K:
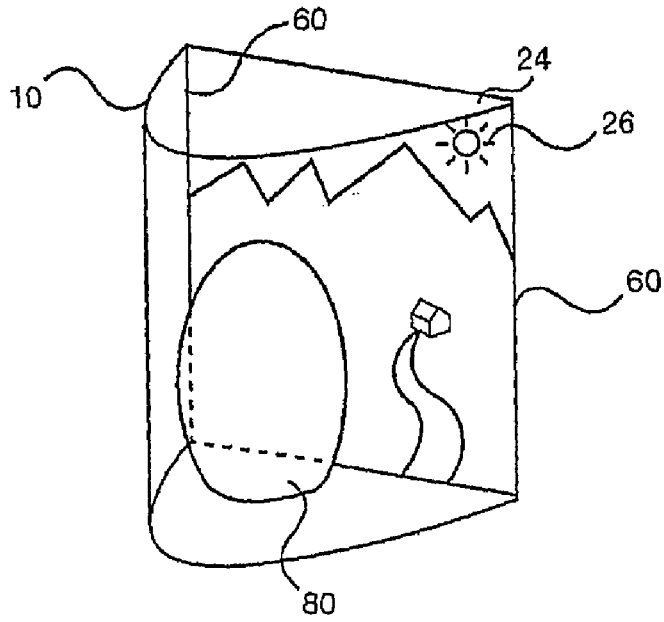
FIG. 2KK is a cross-section showing reversal of direction of curvature of a panel.
Figure 2L:
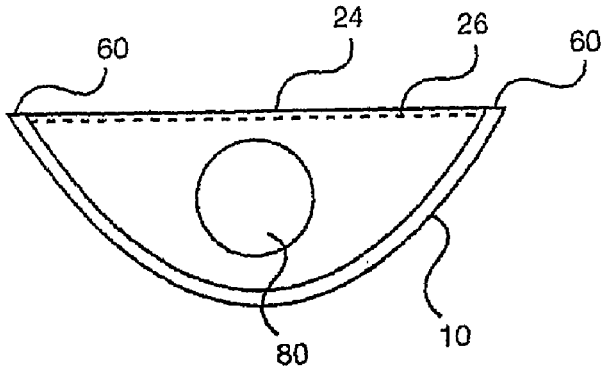
FIG. 2L is a plan of an assembly containing a displayed object.
Figure 2M:
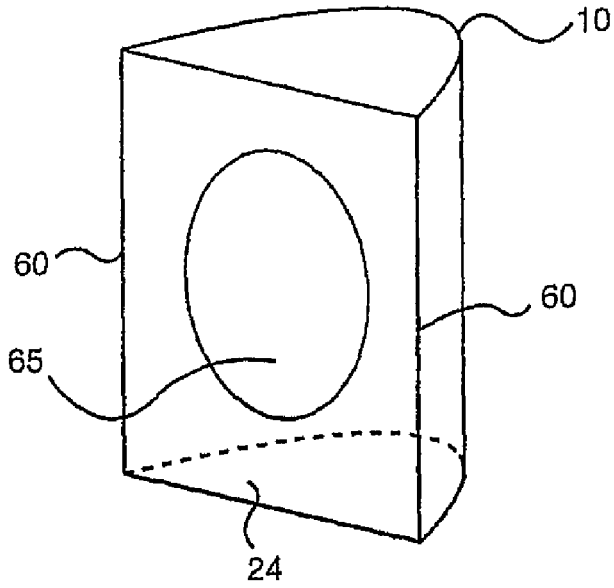
FIGS. 2M and N are perspectives of assemblies with a membrane tie containing a hole.
Figure 2N:
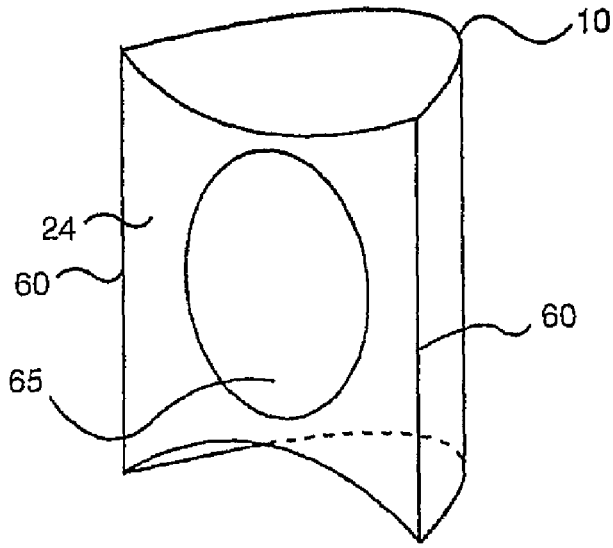
FIG. 2P is a perspective of an assembly with an array of linear tie members.
FIG. 2Q is a perspective of an independent display sign.
FIG. 2R is a perspective of an independent display sign located inside of a transparent membrane tie of an assembly.
FIG. 2S is a perspective of an independent display sign located adjacent to the inside of a transparent flexed panel of an assembly.
FIG. 2T is a perspective of a prior art display sign.
FIG. 2U is a plan of a panel comprising three legs.
FIG. 2V is a perspective of an assembly comprising a flexed panel comprising three legs.
FIGS. 2W-Z are perspectives of assemblies which are joined together in different configurations.

FIGS. 2A-C are similar to FIGS. 1A-C and FIG. 2D illustrates a flexed, tied panel assembly 20 comprising a membrane tie 24, linear connectors 60 and panel 10, which is deformed into a shape approximating to a parabolic arch with crown 15. In FIGS. 2D and 2E, the arrow heads 21 indicate tensile force in the membrane tie 24. Such a flexed, tied panel assembly 20 is stable, as illustrated in FIG. 2E, on a plane, horizontal supporting surface or with linear supports along the sides of the panel or suitable support points along the length of the panel sides, for example at the four corners of the panel. Alternatively, the assembly 20 is stable if rotated through 90°, as illustrated in FIG. 2F, if supported on a plane, horizontal surface or suitable points of support to the lower, curved side of the panel. Such an assembly can be used to display an advertisement, for example the membrane tie 24 being a membrane tie display sign 26, as illustrated in FIG. 2G. For example, the membrane tie is a small photograph or postcard with a clear transparent plastic panel, for example of 0.5 mm thick pvc with self-adhesive tape linear connectors to the photograph or post card. For larger displays for example up to 2.4 m height, the membrane tie is optionally a printed plastic film, for example a 200 micron print-treated polyester film, and the panel a transparent-plastic-sheet, for example of 6 mm acrylic. Alternately, the display sign can be printed or otherwise applied to the panel 10, for example a panel display sign 12, for example a printed acrylic sheet, as illustrated in FIG. 2H. Another application of the assembly with a transparent panel 10 and/or a transparent membrane tie 24 is to exhibit and protect a display object 80, as illustrated in FIG. 2J. The functions of the assemblies of FIGS. 2G and 2J can be combined, for example exhibiting display object 80 with a background membrane tie display sign 26, as illustrated in perspective in FIG. 2K and on plan in FIG. 2L, which show membrane tie display sign 26 applied to membrane tie 24. Membrane ties can comprise one or more holes or voids 75, as illustrated in FIG. 2M, or the free sides can be curved, as illustrated in FIG. 2N. Assemblies which may be used for display, for example those illustrated in FIGS. 2F-H and 2J-N, optionally comprise a panel of semi-rigid plastic material, for example of acrylic, polycarbonate or PVC, and a membrane tie comprising a plastic film, for example of polyester, polycarbonate or PVC, or a woven or non-woven fabric, typically a print-treated fabric. The linear connectors typically comprise self-adhesive tape or profiled aluminum or plastic sections or proprietary connecting systems, such as VELCRO®, a trademark of Velcro Industries B.V. or Dual Lock™ a trademark of 3M or any of the other linear connectors illustrated in FIGS. 21A-H, 21J, and 21K.

Figure 2P:
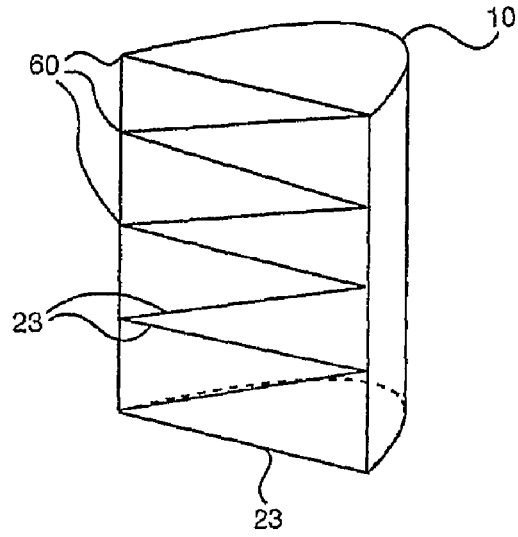

Instead of a continuous membrane, the membrane tie may be an array of linear members 23, for example as illustrated in FIG. 2P, or a net or a perforated material. In such assemblies as illustrated in FIG. 2P, the linear connectors 60 comprise a series of discrete elements, such as lacing loops attached to the panel edges or holes near the panel edges, reinforced or otherwise, which connect the array of linear members 23, for example a continuous, laced cable, to the two, tied edges of panel 10.

Figure 2Q:
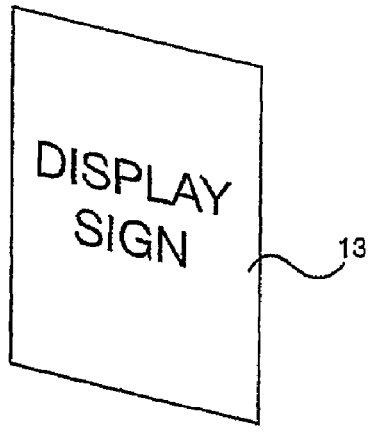
Figure 2R:
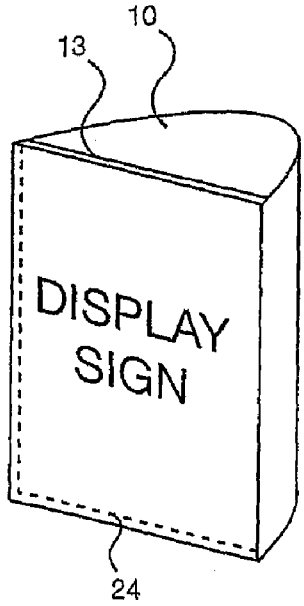
Figure 2S:
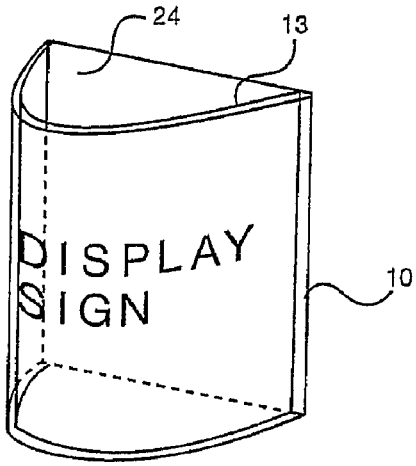

Display messages can be changed in other ways, for example an independent display panel 13, for example a printed piece of paper or card, as illustrated in FIG. 2Q, can be inserted inside an assembly of FIG. 2F with a transparent membrane tie 24, to be protected and visible from outside the assembly 20, as illustrated in FIG. 2R, or another suitably sized independent display panel 13 can be inserted behind and protected by a transparent, curved panel 10, as illustrated in FIG. 2S. The direction of flexure of transparent panel 10, for example of polycarbonate, acrylic or pvc thin sheet material, is repeatedly reversible to achieve a reusable, suitably flexed and tensioned display system, for example for printed paper or card, for example for use as table menus, retail price display units or photographic displays. Such display units of the invention typically use much less plastic material than prior art plastic display units, for example hot wire formed acrylic display holders typically comprising a continuous piece of acrylic sheet bent to form a base portion and two vertical or sloping portions between which paper or card displays are inserted.

Figure 2U:
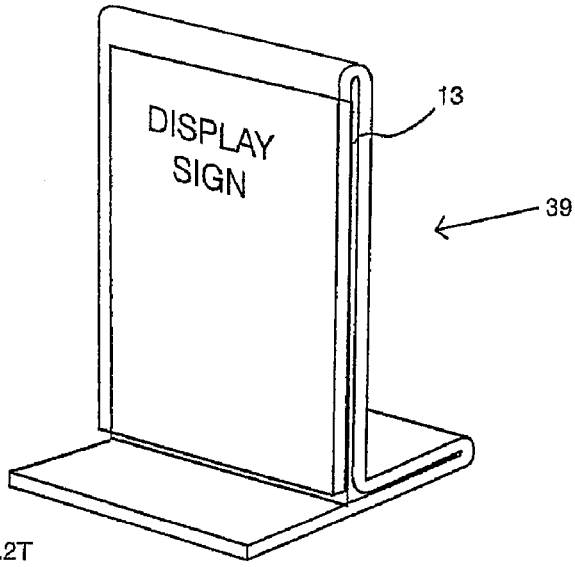
Figure 2U:
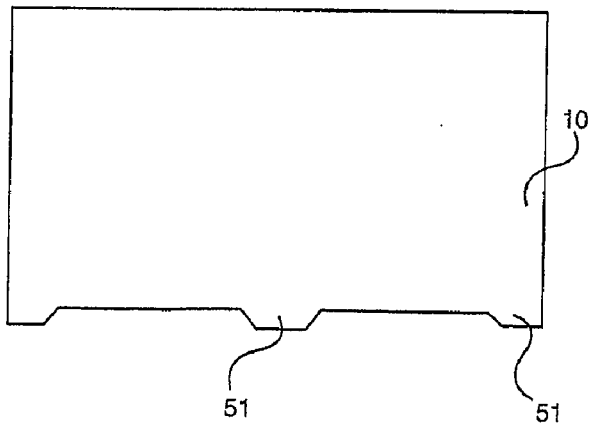
Figure 2V:
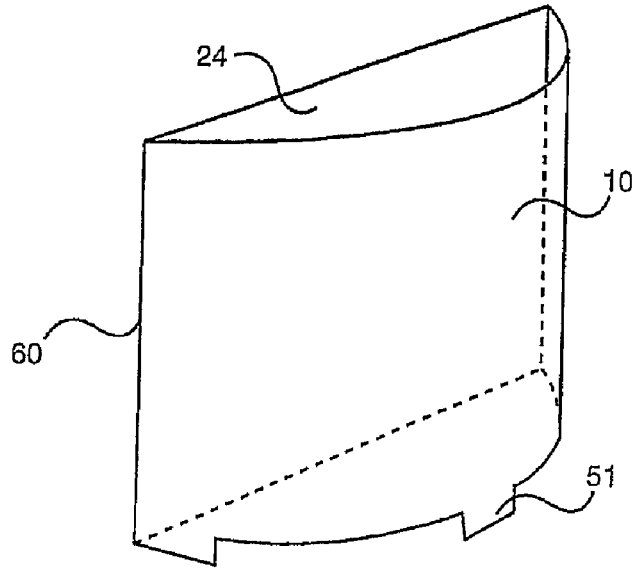

The amount of plastic used in the invention can be as little as one quarter or less of that used in hot wire formed prior art units for the same size of display panel, for example as illustrated in prior art FIG. 2T, in which independent display sign 13 is inserted inside hot wire bent acrylic sheet 39. For example, a typical prior art A4 sign of prior art FIG. 2T would use approximately 30"×8" (750 mm×200 mm) of ⅛" (3 mm) thick acrylic sheet (a total of approximately 30 $in^3$) whereas the display system of the present invention in FIG. 2W could use a pvc panel of 12"×12" (300 mm×300 mm) of 1/24" (1 mm) thickness and a 12"×8" (300 mm×200 mm) of 4/1000" (100 microns) thickness, just over 6 $in^3$, approximately ⅕ of the amount of a cheaper plastic material (pvc) than the prior art acrylic display unit. FIG. 2U illustrates a panel 10 with three feet 51 which, in the tied, flexurally deformed assembly of FIG. 2V, assist the stability of the assembly on an uneven surface.

Figure 2W:
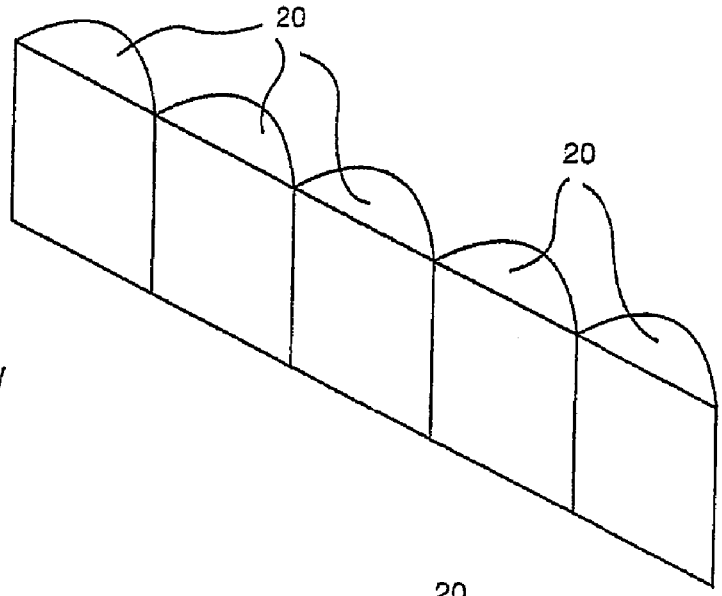
Figure 2X:
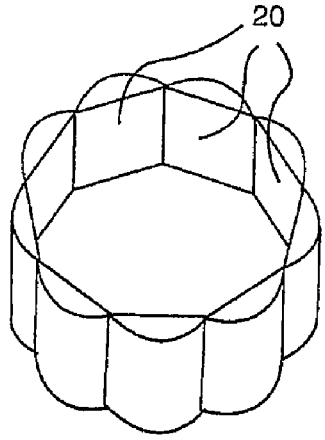
Figure 2Y:
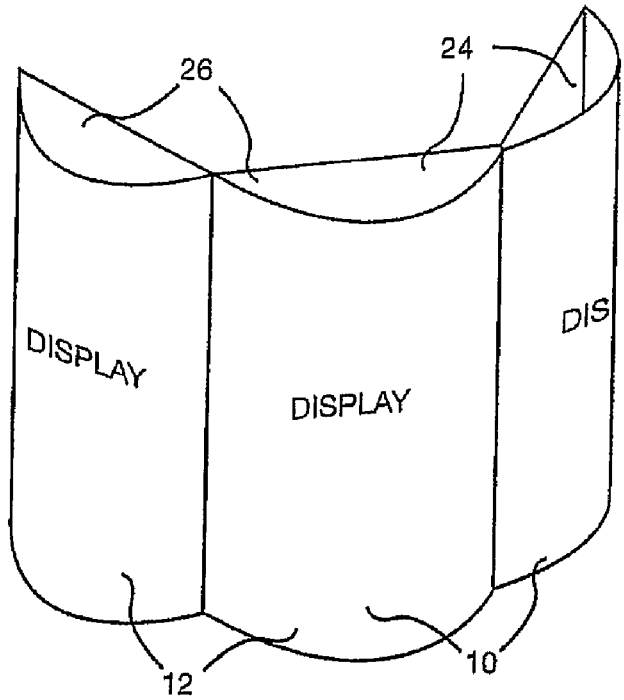
Figure 2Z:
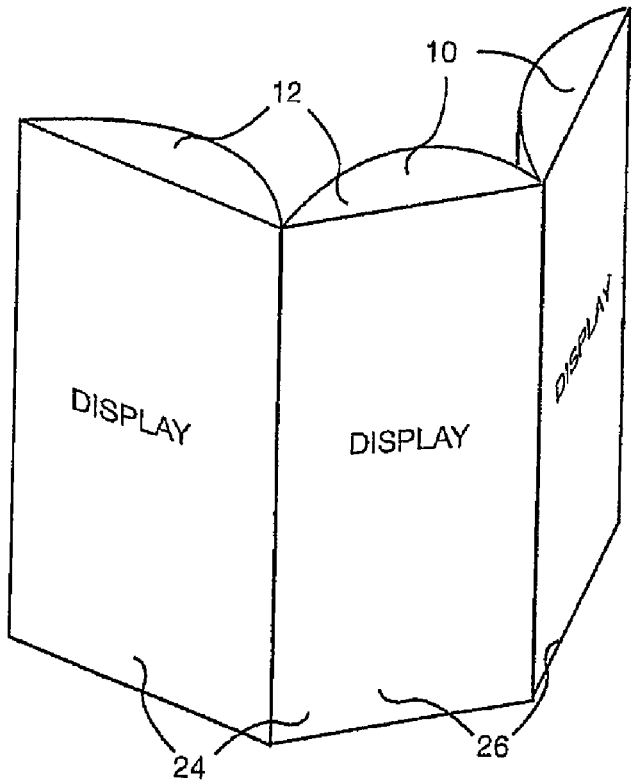
Figure 2A:
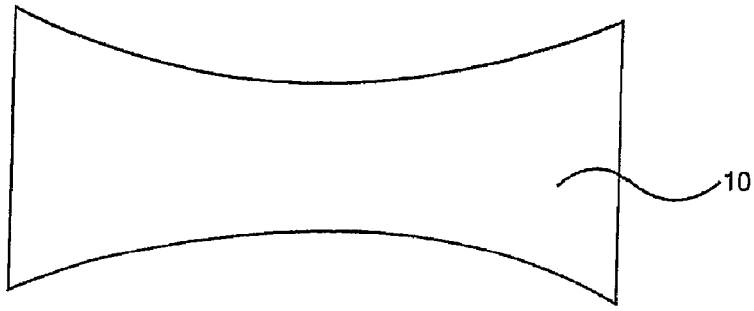
Figure 2B:
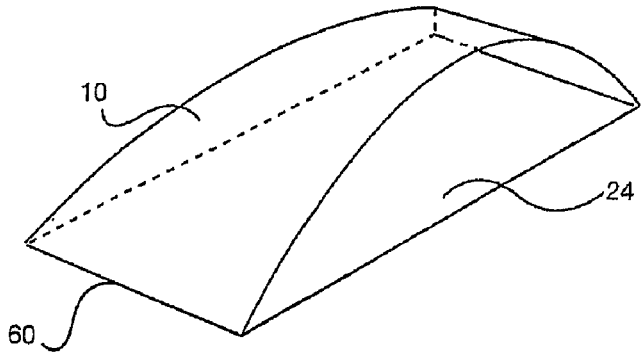
Figure 2C:
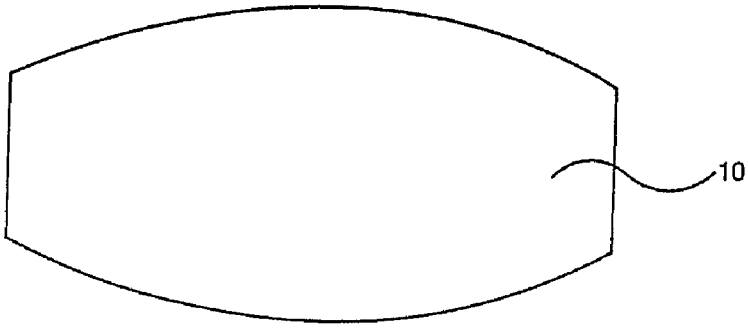
Figure 2D:
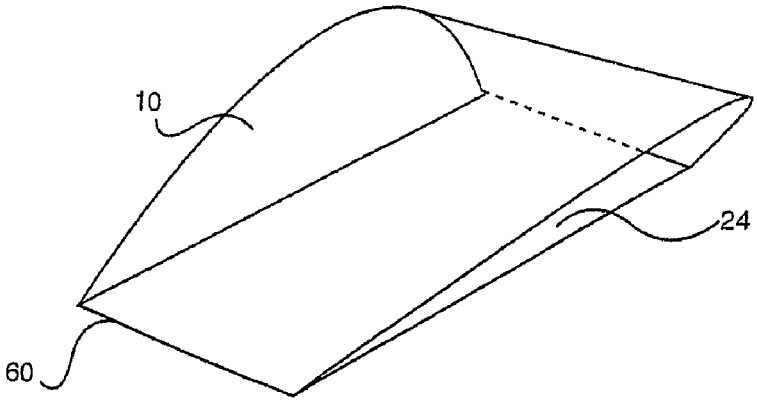
Figure 2E:
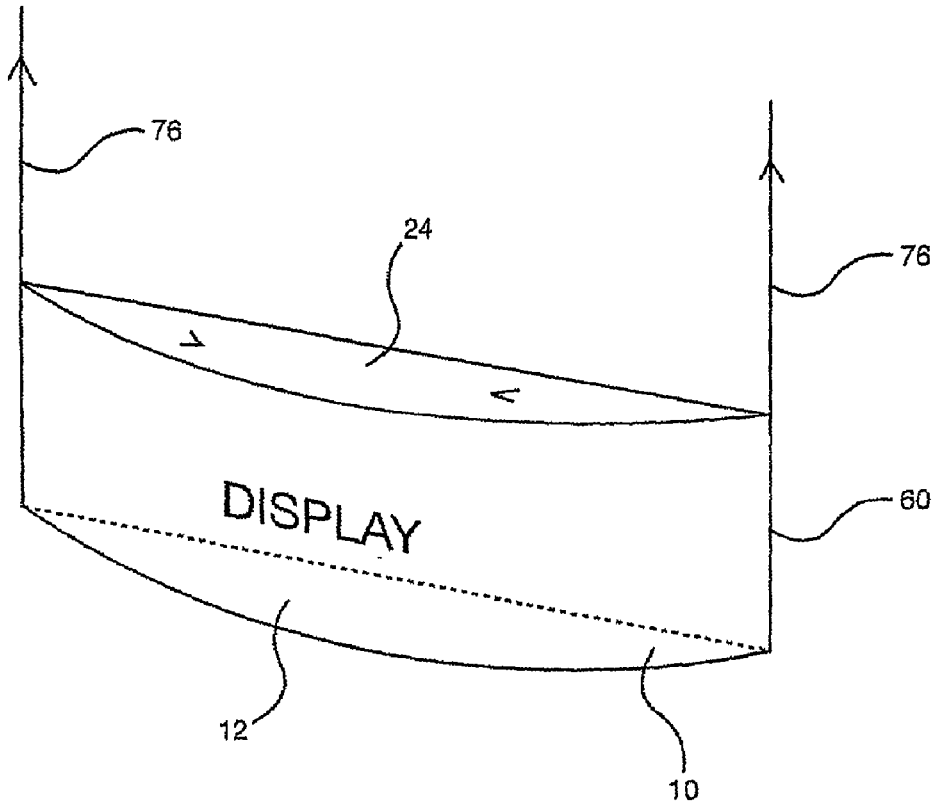
Figure 2F:
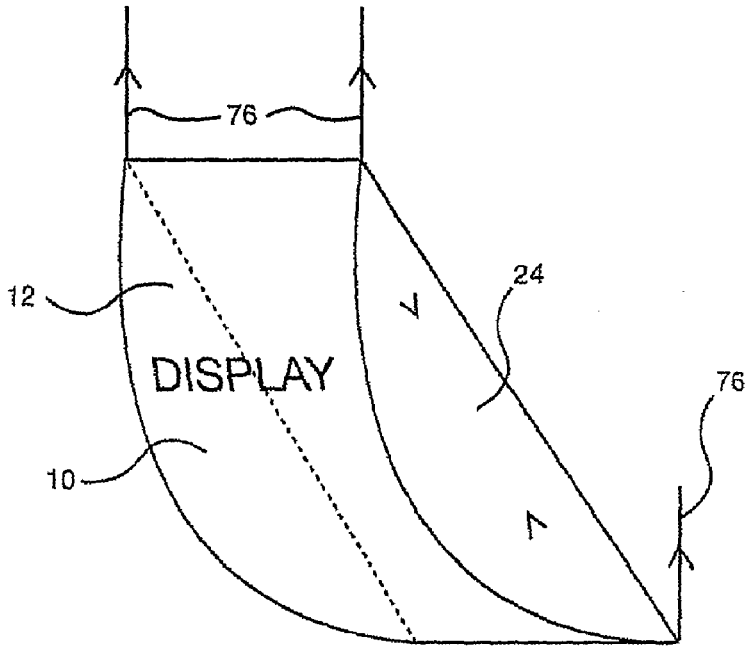
Figure 2G:
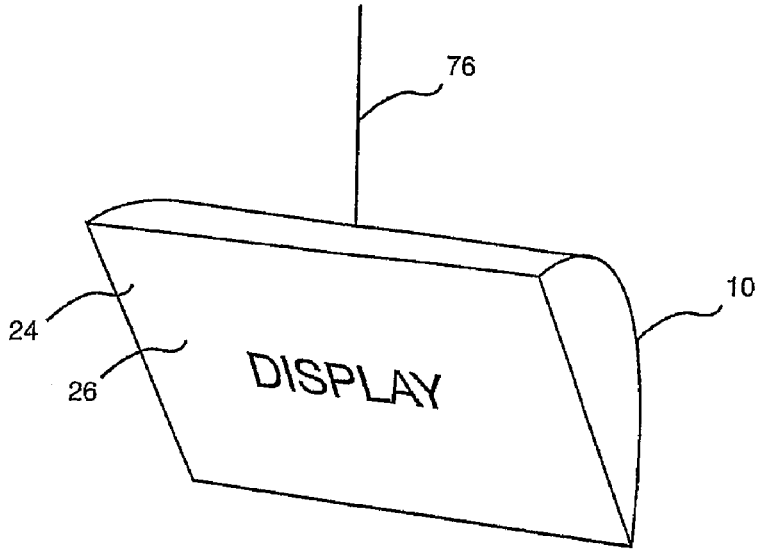
Figure 2H:
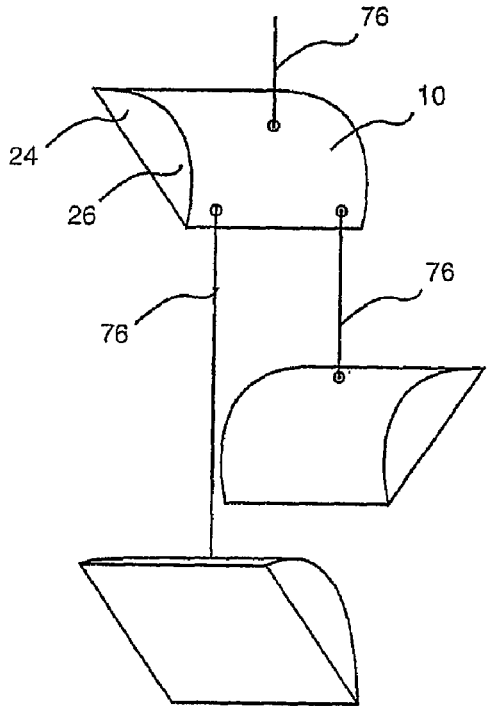
Figure 2J:
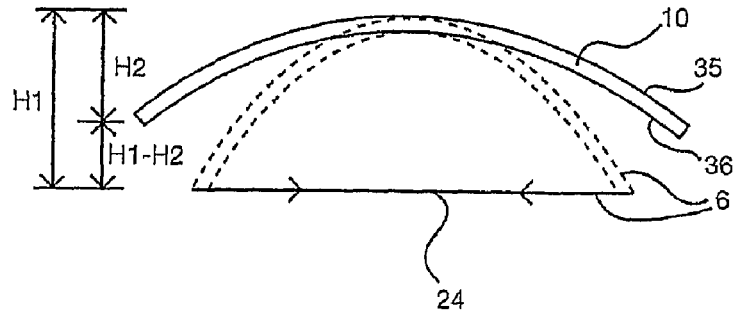
Figure 2K:
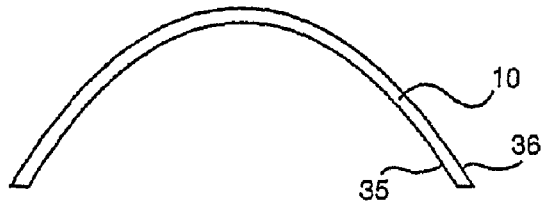
Figure 2L:
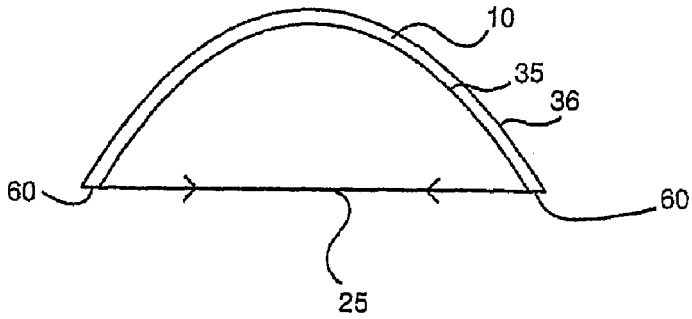
Figure 2M:
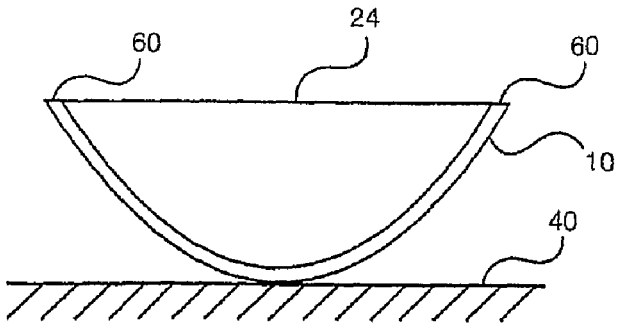

As another example of use of the embodiment of FIG. 2F, such assemblies 20 can be linked together to form a handrail system, as illustrated in FIG. 2W, or linked to form an enclosure, as illustrated in FIG. 2X, for example in which soccer skills can be practiced by kicking the ball against the membrane tie sprung surfaces, resulting in relatively unpredictable rebounds and therefore testing reactions and soccer skill. Assemblies can be combined for large displays or exhibitions, for example as shown in FIGS. 2Y and Z.

FIGS. 2AA and BB illustrate an assembly comprising panel 10 which has two opposing sides curved inwards, for example to assist access to goods displayed within a retail display embodiment of the assembly, for example jewellery. FIGS. 2CC and DD illustrate a panel and an assembly in which two opposing sides of the panel are bowed outwards, for example, in a shelter embodiment to provide better rain protection over the area of the membrane tie 24, for example which also acts as a ground sheet and/or waterproof membrane for the enclosure. FIGS. 2EE and FF are perspectives of different suspended displays, for example in a retail environment.

FIG. 2GG illustrates a display assembly suspended from suspension member 76, for example of thread or thin cable. FIG. 2HH illustrates a mobile comprising three display assemblies and three suspension threads 76.

Preferably, the direction of curvature of the panel 10 is reversible in order to offset the effects of creep in the plastic panel material, for example when changing a membrane tie display sign 26. When panel 10 is separated from membrane tie 24, as shown diagrammatically in FIG. 2JJ, it will change from its flexurally deformed tied panel geometry 6 by partially reverting towards its original plane state. The amount of restitution can be quantified by measuring dimensions $H_1$ and $H_2$ in FIG. 2JJ and the degree of restitution is typically referred to in the art of structural engineering as:

$$\text{the Coefficient of Restitution}=(H_1-H_2)/H_1$$

where $H_1$ is the height deformation of the panel in its tied, flexurally deformed panel geometry 6, and $H_2$ is the height deformation following release after creep or visco-elastic "relaxation". This Coefficient of Restitution will be less the longer the time the assembly remains unreleased. However, a major advantage of the present invention is that the typically undesirable creep properties of plastic materials can be overcome as the creep-induced reduction in stress in the assembly can be countered by reversing the direction of flexure and curvature in the panel, as indicated by the reversal of first panel side 35 and second panel side 36 from the orientation shown in FIG. 2JJ to the reverse-flexed panel of FIG. 2KK. The same membrane tie 24 can be re-used or a second, replacement membrane tie 25 can be used in the reversed panel assembly, as shown in FIG. 2LL. Thus a single panel 10 can be re-used many times with serviceable amounts of flexure in the panel and tension in the membrane tie. Typically the force in a membrane tie 24 or replacement second membrane tie 25 of the same length will initially be higher than in the original configuration with the flexurally deformed geometry 6 of FIG. 2JJ because of the greater amount of flexure in reverse-curved panel 10 in order to overcome the residual curvature.

FIG. 2MM illustrates the assembly of FIG. 2E rotated through 180°, in which it exhibits second order stability, being able to be rocked from side to side but having a position of repose. In such orientation, the assembly has many dynamic functions, for example as a spring device, exhibiting gross deformation if loaded perpendicular to and in the centre of membrane tie 24, supported by floor 40. As another example, the assembly acts as a trampoline structure, typically with additional side supports.

Figure 3A:
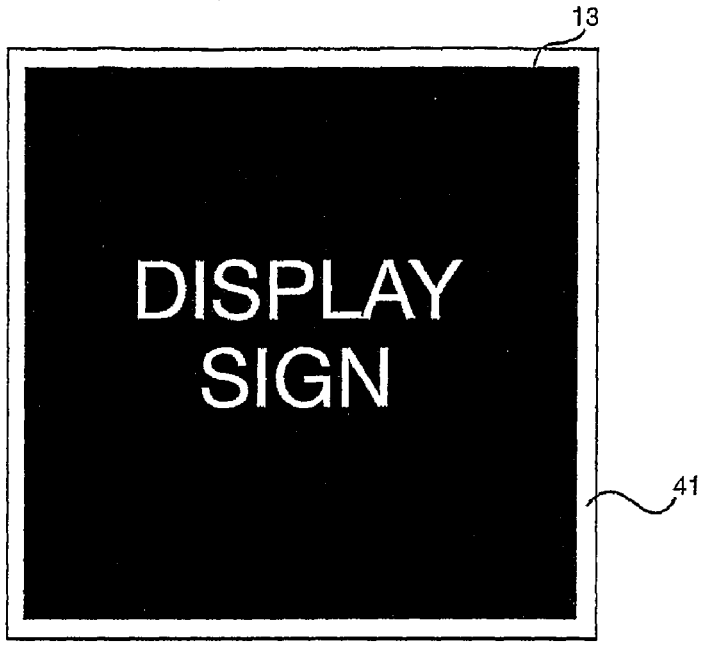
FIG. 3A is a plan of a laminated panel.
Figure 3B:
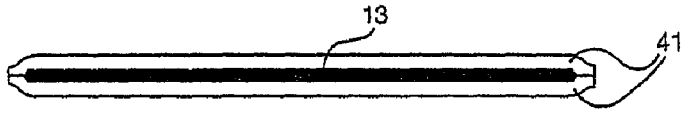
FIG. 3B is a cross-section through a laminated panel.
Figure 3C:
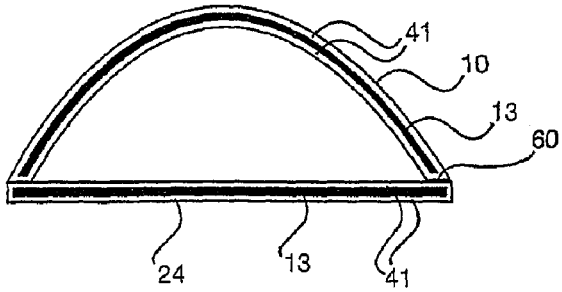
FIG. 3C is a cross-section through an assembly comprising a laminated panel and a laminated membrane tie.
Figure 3D:
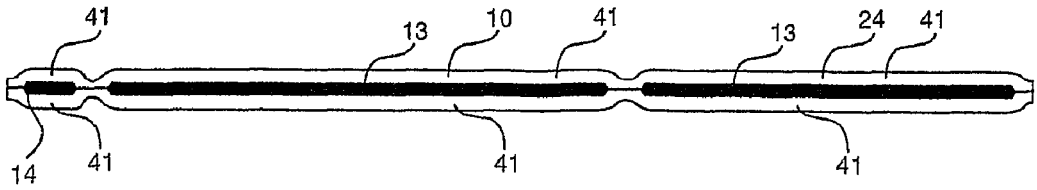
FIG. 3D is a cross-section through a laminated panel, a laminated membrane tie and a laminated edge stiffener, which are all connected by laminating film.
Figure 3E:
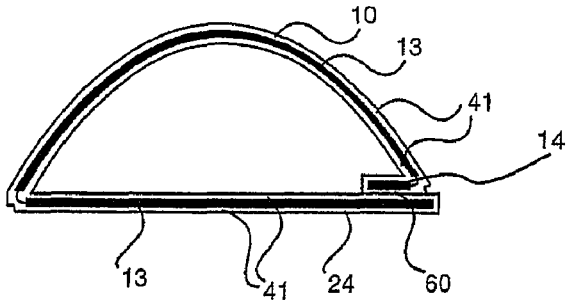
FIG. 3E is a cross-section through an assembly comprising laminated components.
Figure 3F:
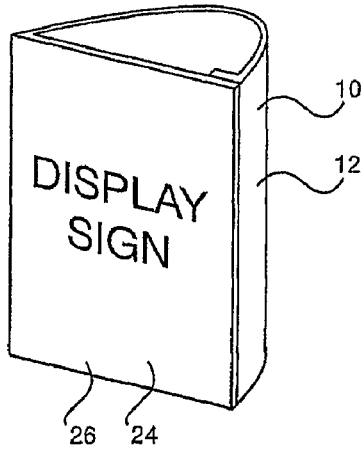
FIG. 3F is a perspective of an assembly.
Figure 3G:
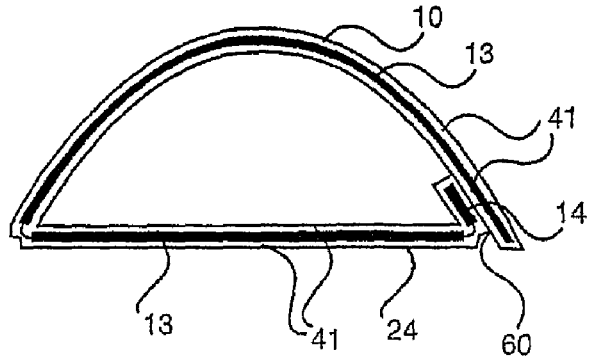
FIGS. 3G-H and 3J-L are cross-sections through assemblies comprising laminated components.
Figure 3H:
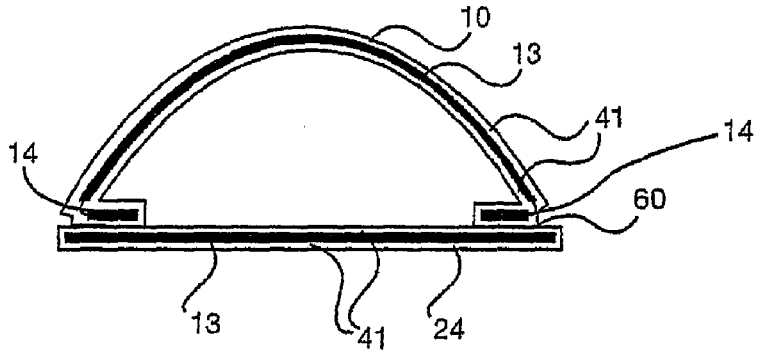
Figure 3J:
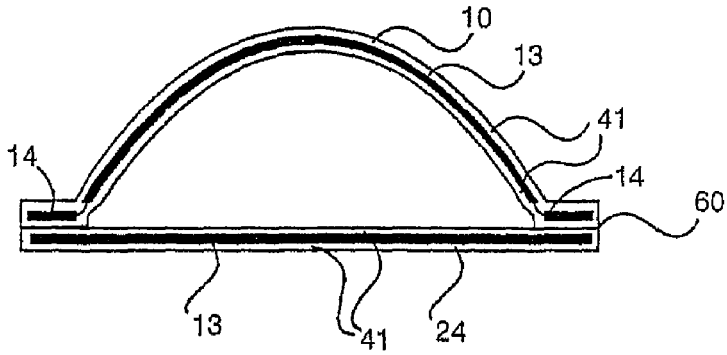
Figure 3K:
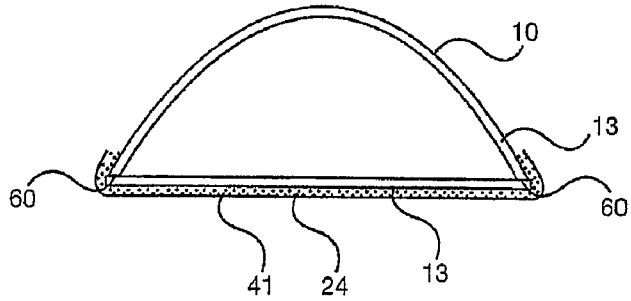
Figure 3L:
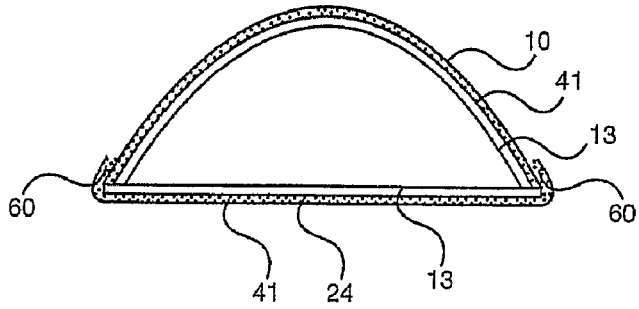
Figure 4A:
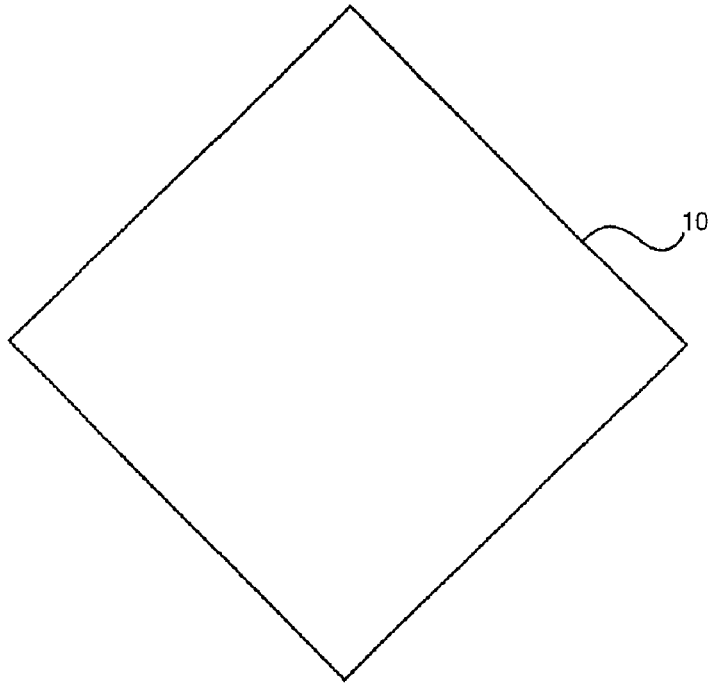
FIG. 4A is a plan of a panel.
Figure 4B:
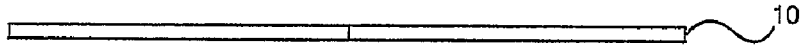
FIG. 4B is an edge elevation of a panel.
Figure 4C:
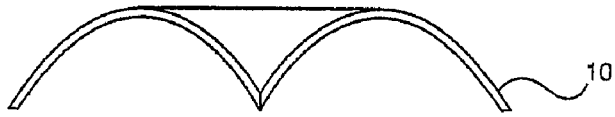
FIG. 4C is an elevation of a panel flexurally deformed in four corners.
Figure 4D:
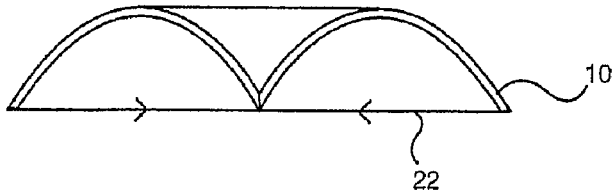
FIG. 4D is an elevation of a tied panel flexurally deformed in four corners.
Figure 4E:
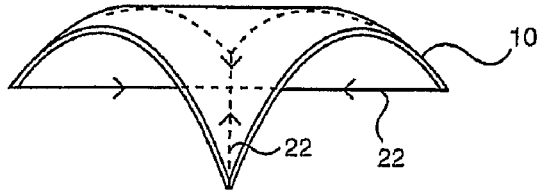
FIG. 4E is a perspective of a tied panel flexurally deformed in four corners.

Some particularly practical embodiments of the invention comprise panels and/or membrane ties with transparent plastic laminating film 41 to protect a paper or card display panel, laminated to one or preferably both sides of a paper or card display panel 13, for example as illustrated in FIG. 3A. In the embodiment of FIG. 3B, two paper display panels 13 are encapsulated between two protective transparent plastic laminating film layers 41, which are connected by linear connectors 60. In FIG. 3C, two paper or card display panels 13 are encapsulated and bonded together by two layers of laminating film 41, the strip between the two panels 13 being creased to form an effective hinge 42 on one side of the display assembly and folded to enable a pressure-sensitive adhesive linear connector 60 at the other side of the display assembly 20. FIG. 3D is a cross-section through a display comprising laminated display panels 13, for example of printed paper, encapsulated within laminating film 41 which also encapsulates edge flap 14 with gaps between the encapsulated elements comprising just two layers laminating film 14, to act as hinges in the completed assembly of FIG. 3E, in which laminated flap 14 is adhered to laminated membrane tie 24, for example by means of pressure-sensitive adhesive, as shown in perspective in FIG. 3F, having membrane tie display panel 26 and panel display sign 12. FIGS. 3G, H and J show alternative assemblies comprising laminated display panels 13 encapsulated within two sheet of laminating film 41 with edge flaps 14. FIGS. 3K and L show assemblies in which display panels 13 are laminated on one side only by over laminate film 41. In all the above cases, laminating film 41 is of clear, transparent plastic, for example polyurethane, pvc or polyester bonded to display panel 13 by pressure-sensitive or heat-activated adhesive.

Figure 5A:
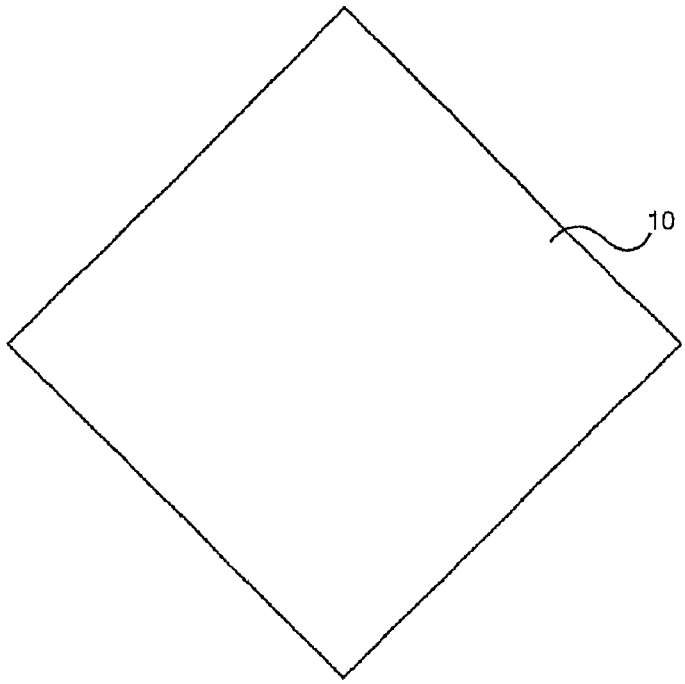
FIG. 5A is a plan of a panel.
Figure 5B:
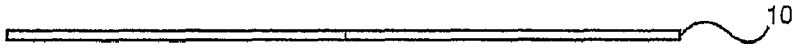
FIG. 5B is an elevation of a panel flexurally deformed in four corners.
Figure 5C:
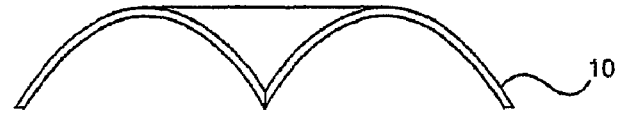
FIG. 5C is an elevation of a panel flexurally deformed in four corners.
Figure 5D:
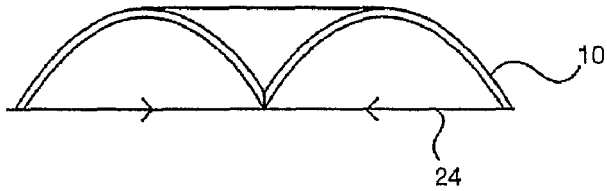
FIG. 5D is an elevation of a tied panel flexurally deformed in four corners.
Figure 5E:
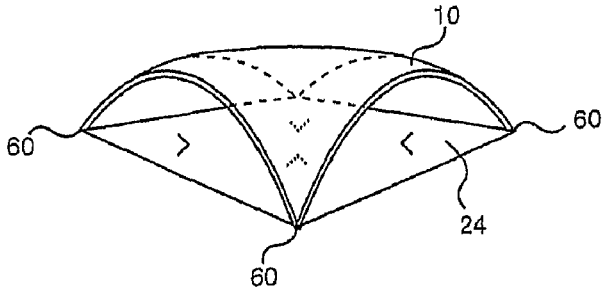
FIG. 5E is a perspective of a tied panel flexurally deformed in four corners.

FIGS. 4A-E are similar to FIGS. 1A-E, except there are two linear tie rods or cables 22 connecting opposing corners of square panel 10. This sequence is optionally used to create an "intermediate panel geometry" prior to applying a plane membrane tie 24 connecting the four corners of the deformed panel 10, as illustrated in FIG. 5E.

Figure 5F:
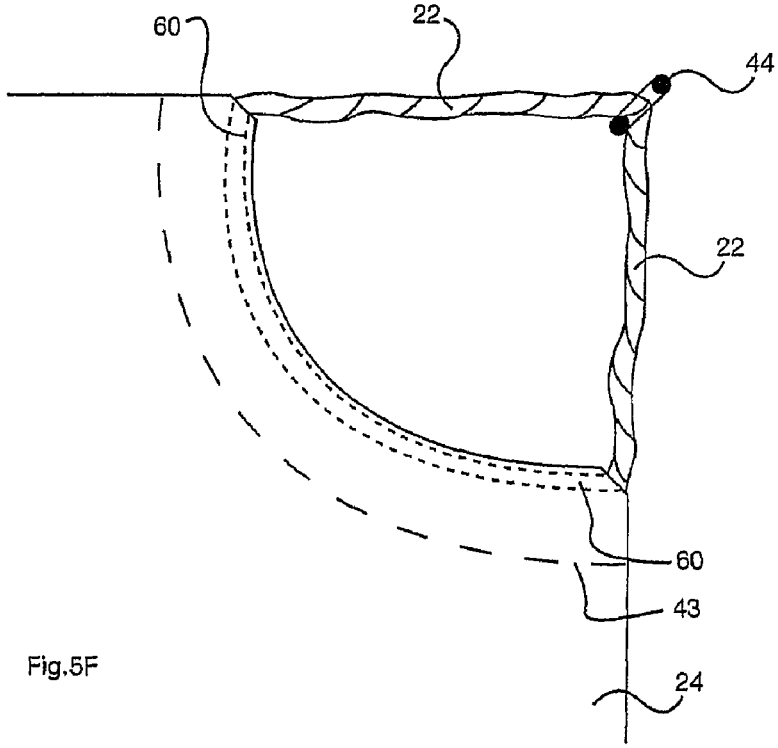
FIG. 5F is a plan of a linear connector at the corner of a membrane tie.

FIGS. 5A-D illustrate a sequence of flexure of panel 10 in the case of temporary ties not being required, for example for a small embodiment that can be manipulated manually and the membrane tie added manually. The resulting vault like structure "springs" from the four corners of membrane tie 24. In such assemblies as FIG. 5E, in which a panel 10 and a membrane tie 24 are only connected at their corners there is typically a loop or ring linear connector 560 as illustrated in FIG. 5F. The linear connector 60, is typically a cable 22 within an edge seam 43 of membrane tie 24, connected to the panel, for example by means of ring 44 passing through a hole near the corner of the panel (not shown).

Figure 6A:
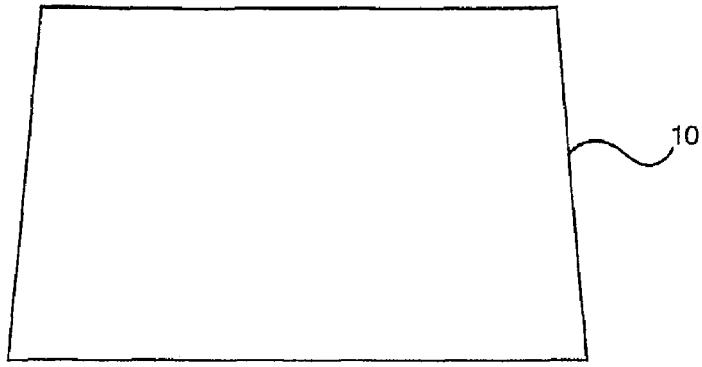
FIG. 6A is a plan of a panel with two opposing, sloping edges.
Figure 6B:
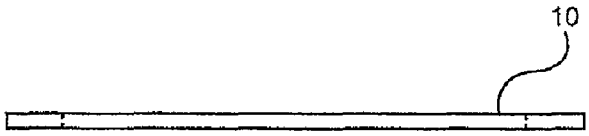
FIG. 6B is an edge elevation of the panel of FIG. 6A.
Figure 6C:
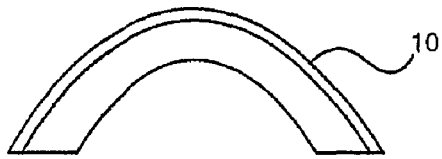
FIG. 6C is an elevation of a flexed panel of FIG. 6A.
Figure 6D:
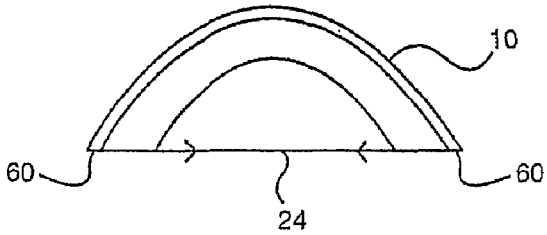
FIG. 6D is a tied, flexed panel of FIG. 6A.
Figure 6E:
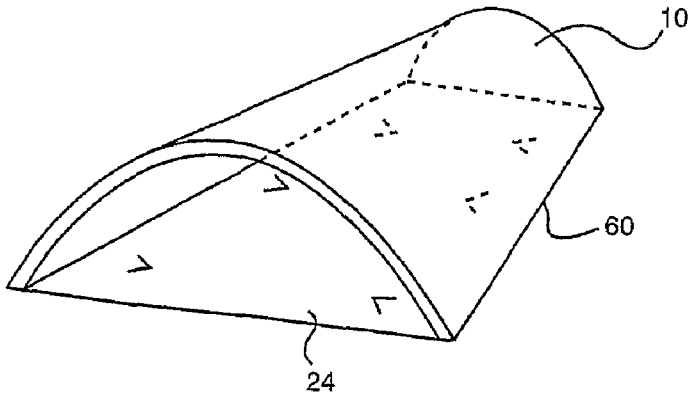
FIG. 6E is a perspective of an assembly.
Figure 6F:
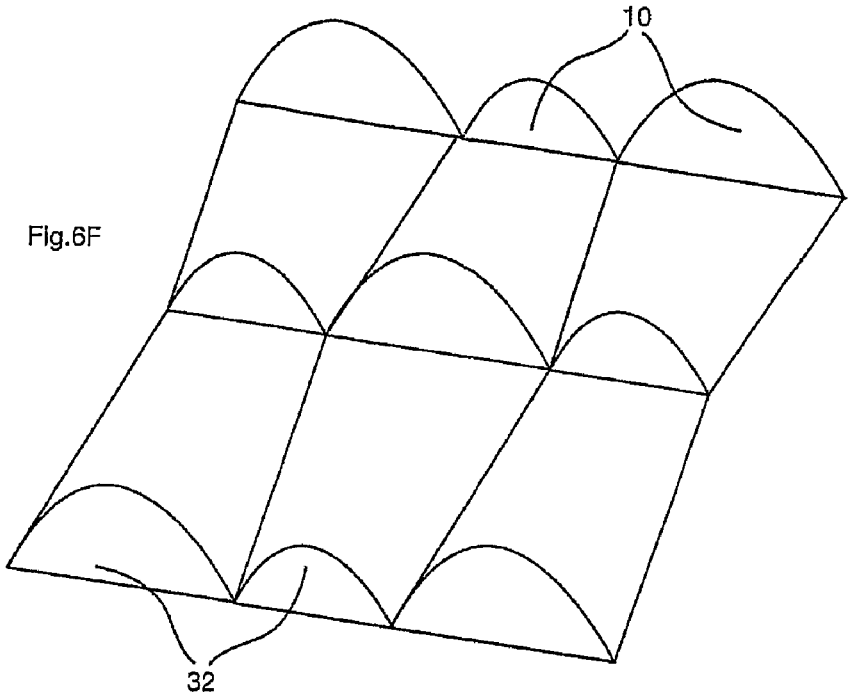
FIG. 6F is a perspective of a number of combined assemblies.
Figure 6G:
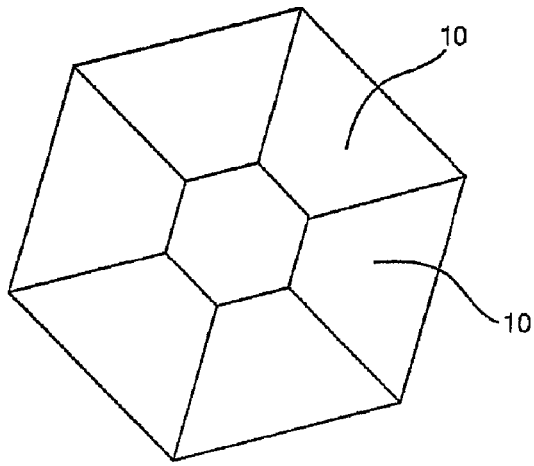
FIG. 6G is a plan of a number of combined assemblies.
Figure 6H:
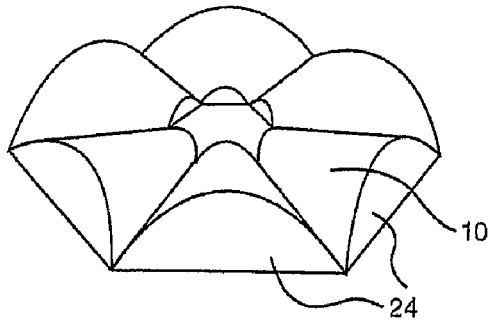
FIG. 6H is a perspective of a number of combined assemblies.
Figure 6J:
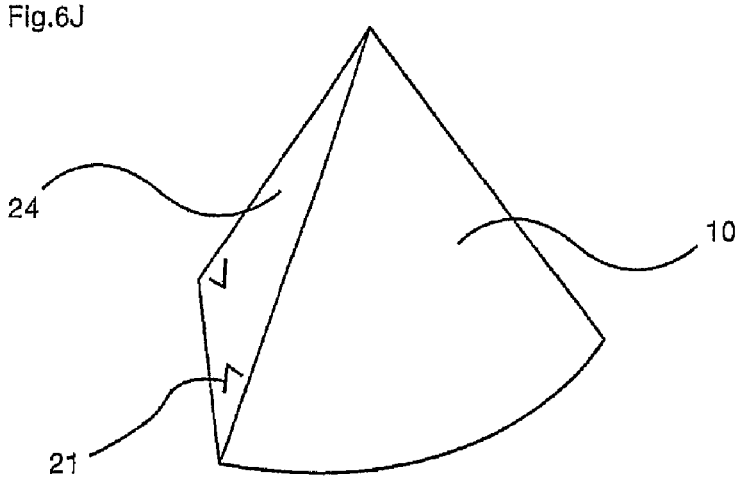
FIG. 6J is a perspective of an assembly comprising a triangular membrane tie and a conically-surfaced, flexed panel.

FIGS. 6A-E are similar to FIGS. 2A-E except that the panel 10 (is a truncated triangle), resulting in a conical surface to the panel and the open ends of the flexed panel being of different size, as illustrated in FIG. 6E. The assembly of FIG. 6E can also be used in conjunction with other such assemblies, for example to create a "north light" roof system, as illustrated in FIG. 6F, in which the ends 32 of each assembly are glazed and the other ends of each assemblies have a solid shear diaphragm infill panel (not shown). FIGS. 6G and H show another arrangement of combined assemblies with panels of conical surface. FIG. 6J illustrates another type of conical surfaced panel combined with membrane tie 24, typically a membrane tie display sign 26.

Figure 7A:
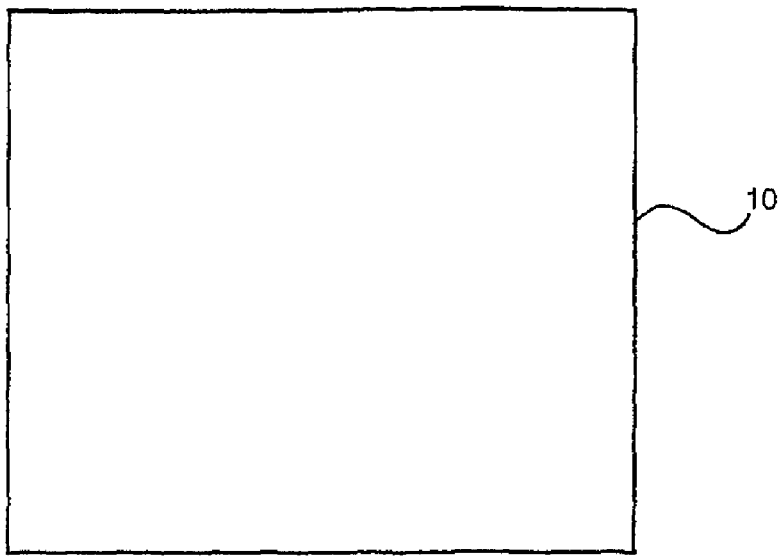
FIG. 7A is a plan of a panel.
Figure 7B:
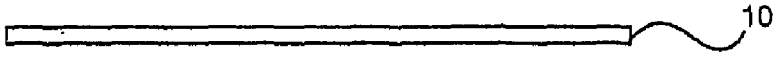
FIG. 7B is an edge elevation of a panel.
Figure 7C:
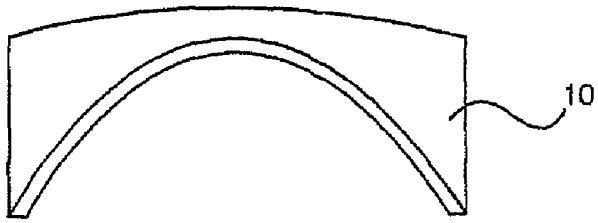
FIG. 7C is a perspective of a flexed panel.
Figure 7D:
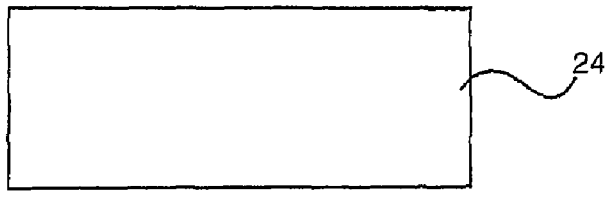
FIG. 7D is a plan of a membrane tie.
Figure 7E:
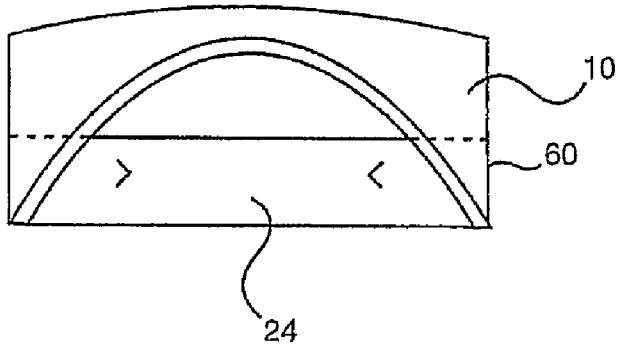
FIGS. 7E-H are perspectives assemblies comprising a membrane tie of width less than a flexed panel.
Figure 7F:
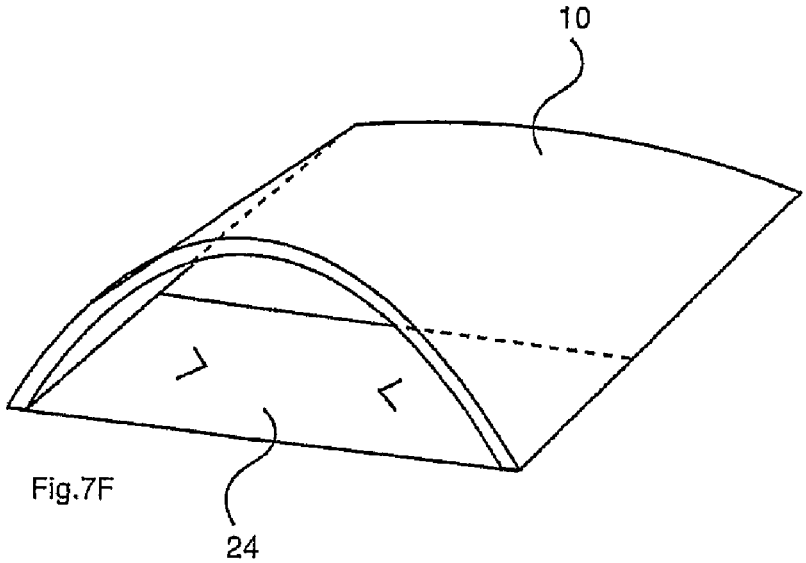
Figure 7G:
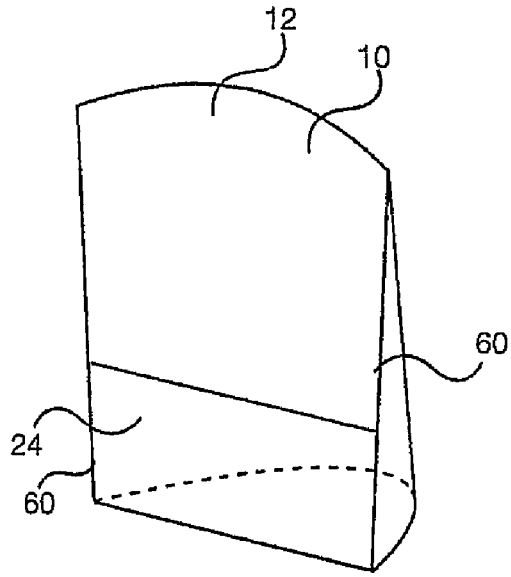
Figure 7H:
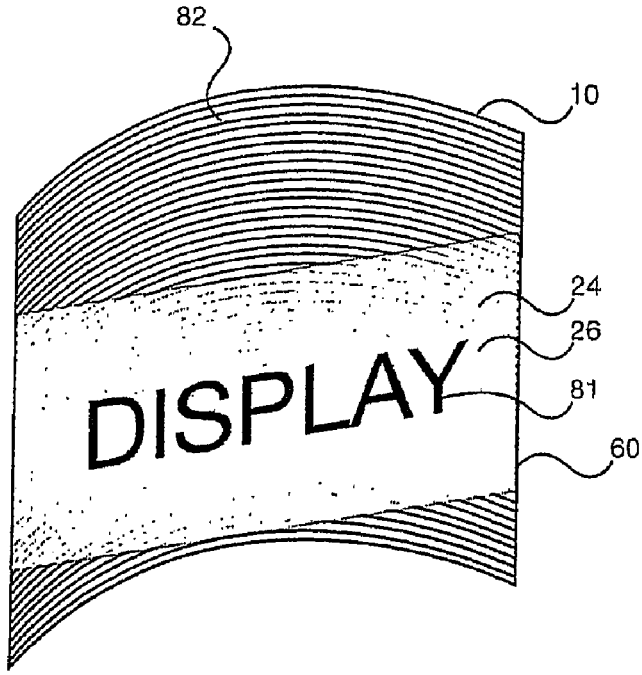

FIGS. 7A-G illustrate an embodiment in which only part of two opposing sides of panel 10 are connected by membrane tie 24 and linear connectors 60. Membrane tie 24 is located at one end of panel 10, which is free and has less curvature than at the other end of panel 10, shown to an exaggerated degree in FIGS. 7C and E-G. The finished assembly is stable, for example with the membrane tie 24 horizontal, as illustrated in FIG. 7F, or vertical, as illustrated in FIG. 7G which has several practical uses, for example as a menu or retail information display on panel 10 and/or membrane tie 24, for example both being of printed paper laminated and encapsulated by transparent plastic laminated film 41, as described in relation to FIGS. 3A-F. FIG. 7H illustrates another example of a display in which membrane tie 24 only extends over part of the length of opposing edges to flexurally deformed panel 10, for example showing a discrete display design 81 on a transparent membrane tie 24 comprising membrane tie display sign 26 enabling a background second display design 82 to be visible through the transparent portions of membrane tie 24, for example to show a subject design 81 in a three-dimensional relationship with background design 82.

Figure 8A:
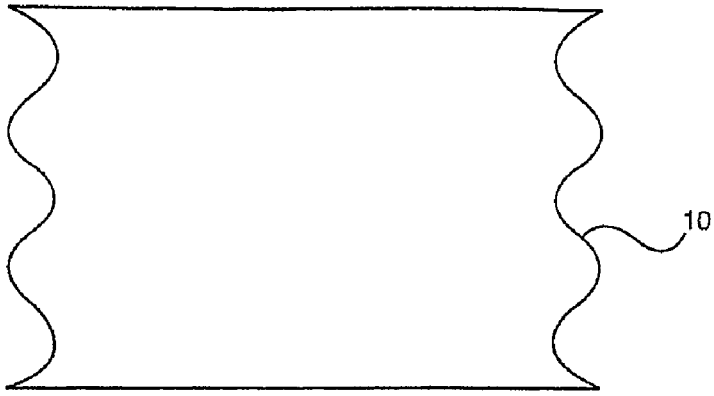
FIG. 8A is a plan of a panel with opposing curved edges.
Figure 8B:
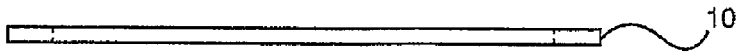
FIG. 8B is an edge elevation of a panel with opposing curved edges.
Figure 8C:
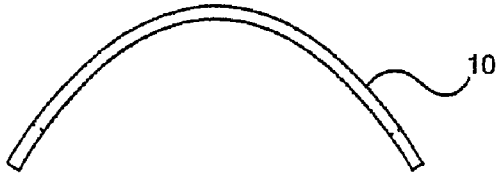
FIG. 8C is an elevation of a flexed panel with opposing curved edges.
Figure 8D:
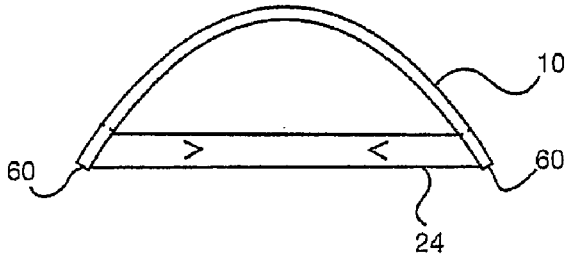
FIG. 8D is an elevation of an assembly comprising a panel with opposing curved edges.
Figure 8E:
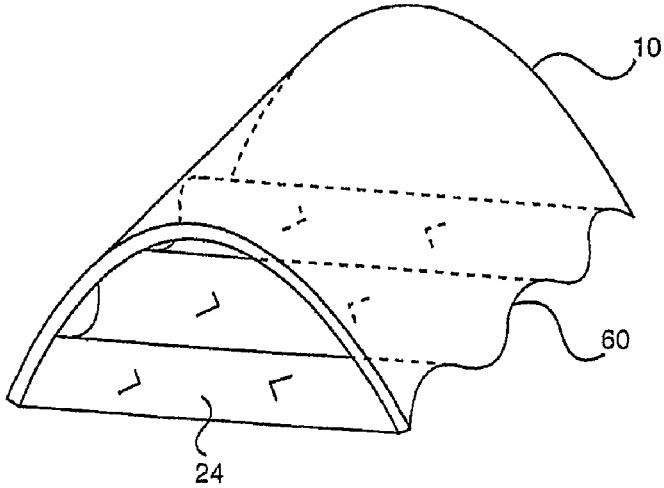
FIGS. 8E and F are perspectives of assemblies comprising a panel with opposing curved edges.
Figure 8F:
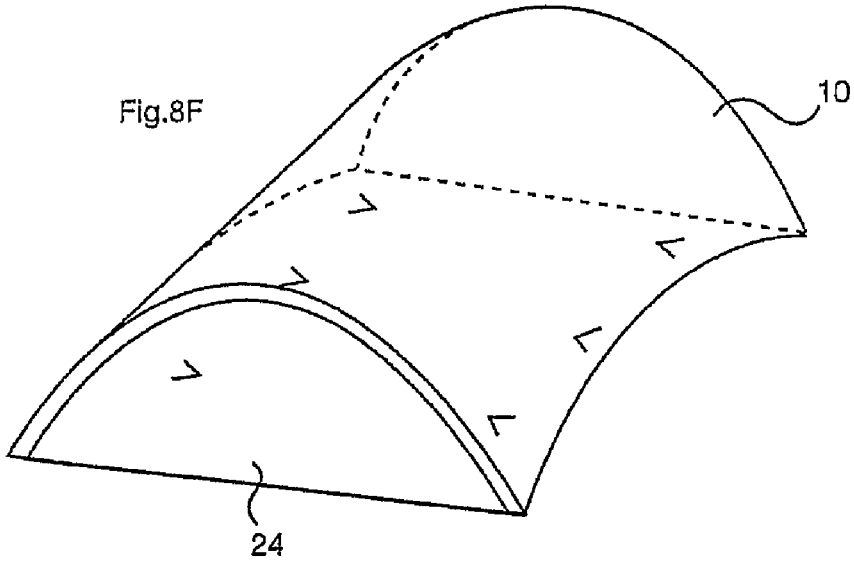
FIG. 8G is a perspective of an assembly comprising a membrane tie of double curvature.
FIG. 8H is a plan of a chevron shaped panel.
FIG. 8J is a perspective of an assembly comprising a membrane tie of double curvature.
Figure 8G:
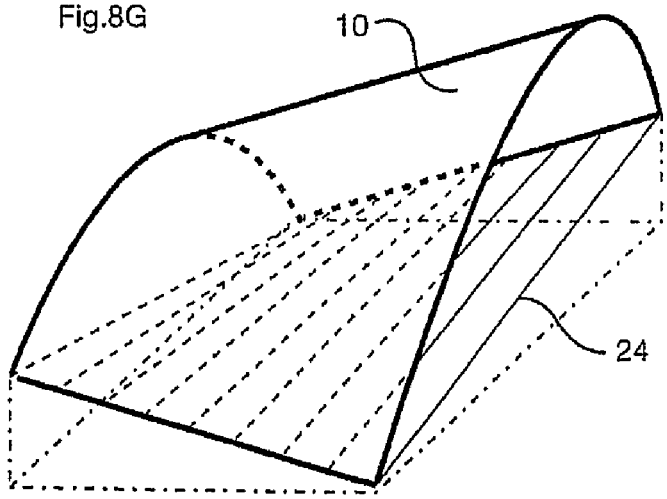
Figure 8H:
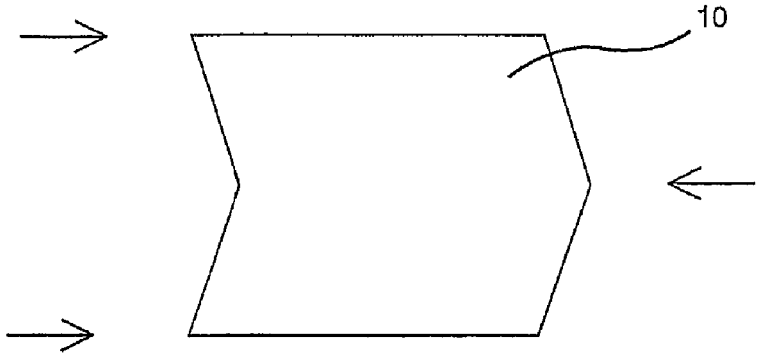
Figure 8J:
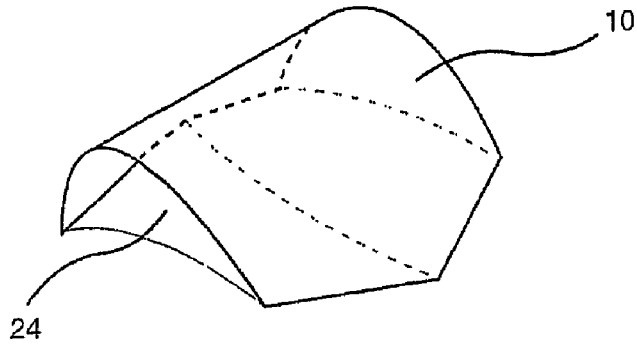

FIGS. 8A-E illustrate the assembly of a panel similar to FIGS. 2A-E except that opposing sides of panel 10 are curved in the form of a wave. Membrane tie 24 is also curved in an undulating, wave form, tying together the opposing curved sides of panel 10. FIG. 8F illustrates a panel 10 with a single curve on opposing sides, resulting in a structure with a vaulted panel 10 curved in one direction and a vaulted membrane tie 24, curved in the perpendicular direction. Such a structure may be repeated to create a multi-bay roof. FIG. 8G illustrates a panel 10 in the form of a parallelogram flexed about an axis perpendicular to two parallel sides until it is rectangular on plan, requiring a membrane 24 of double curvature, for example comprising a membrane tie fabricated from strips in a cutting pattern to achieve the required double curvature, as does the chevron shaped panel 10 of FIG. 8H, as illustrated in FIG. 8J. Cutting patterns to create double curvature membrane ties can be created using the same methods as prior art sail-making and tensile structure fabrication. Suitable fabric materials for larger assemblies, for example for roof systems, include pvc-coated polyester or Teflon-coated polyester fabric.

Figure 9A:
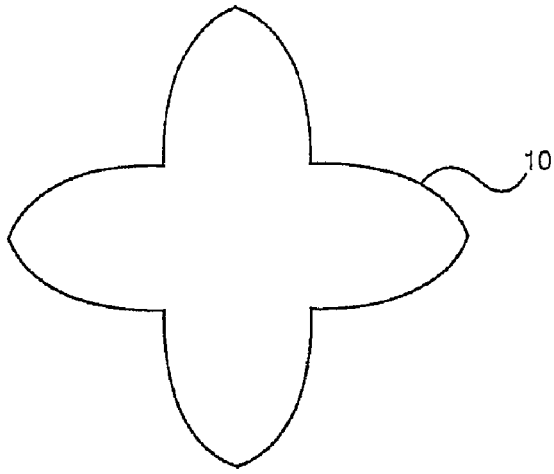
FIG. 9A is a plan of a petaloid panel.
Figure 9B:
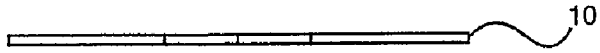
FIG. 9B is an edge elevation of a petaloid panel.
Figure 9C:
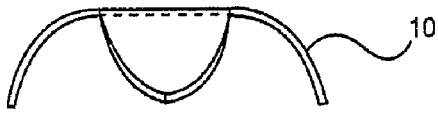
FIG. 9C is an elevation showing flexed panel "petals".
Figure 9D:
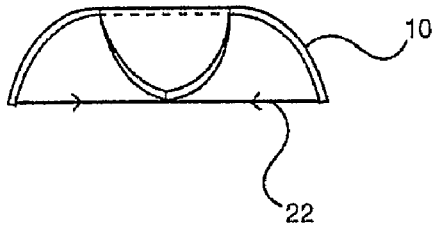
FIG. 9D is an elevation showing a tied, flexurally deformed petaloid panel.
Figure 9E:
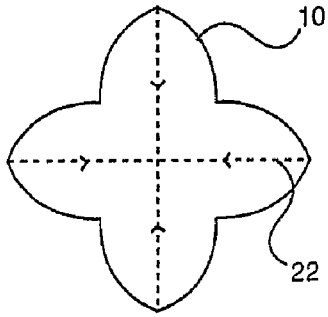
FIG. 9E is a plan of the assembly of FIG. 9D.
Figure 9F:
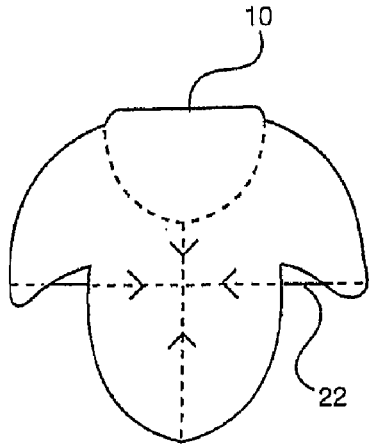
FIG. 9F is a perspective of the assembly of FIG. 9D.

FIGS. 9A and 9B are a plan and edge elevation view of petaloid panel 10. FIG. 9C illustrates the "petals" of panel 10 flexurally deformed, their ends being tied with linear tie rods 22, as illustrated in FIGS. 9D-F, in an intermediate panel geometry before installing the membrane tie of FIG. 10D, resulting in the flexurally deformed, tied panel assembly of FIGS. 10E and F.

Figure 10A:
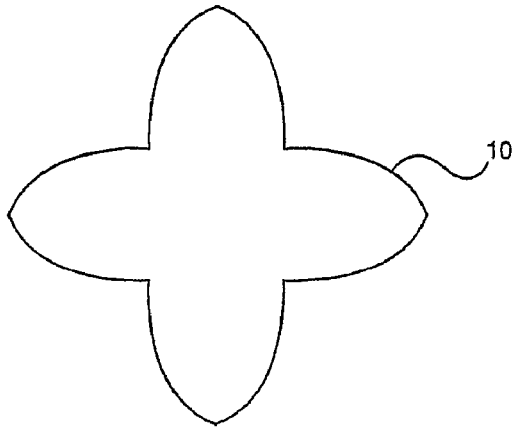
FIG. 10A is a petaloid panel.
Figure 10B:
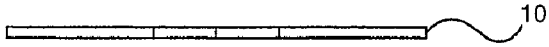
FIG. 10B is an edge elevation of a petaloid panel.
Figure 10C:
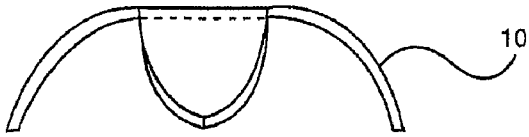
FIG. 10C is an elevation showing flexed panel "petals".
Figure 10D:
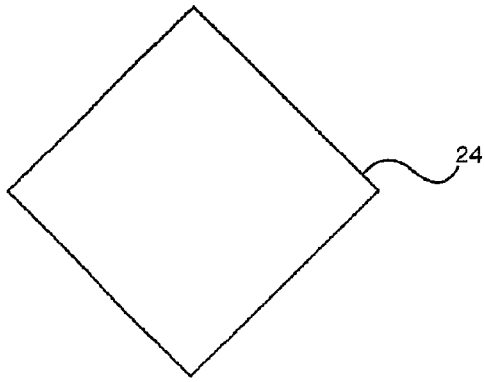
FIG. 10D is a plan of a membrane tie.
Figure 10E:
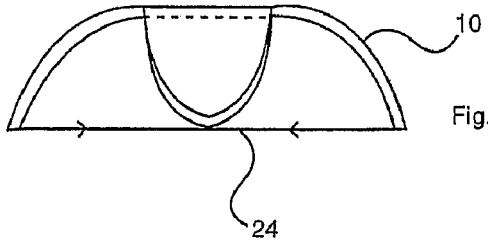
FIG. 10E is an elevation showing a tied, flexurally deformed petaloid panel.
Figure 10F:
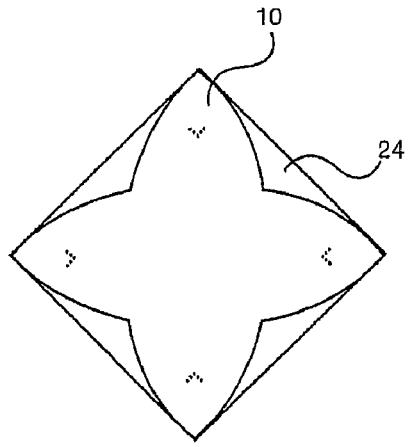
FIG. 10F is a plan of the assembly of FIG. 10E.

FIGS. 10A-C illustrate a similar petaloid panel 10 to FIGS. 9A-C but flexed and held without the use of linear ties before being connected by the square membrane tie 24 of FIG. 10D, as illustrated in FIGS. 10E and F.

Figure 11A:
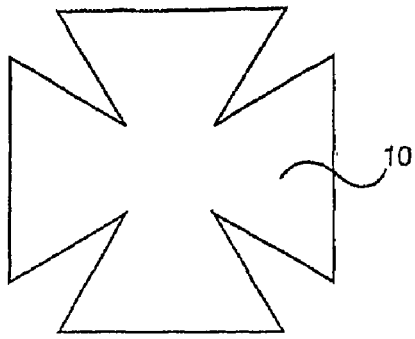
FIG. 11A is a plan of a cross-shaped panel.
Figure 11B:
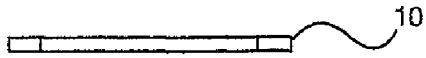
FIG. 11B is an edge elevation of a cross-shaped panel.
Figure 11C:
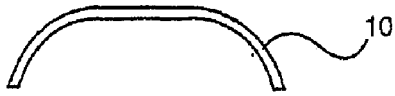
FIG. 11C is a cross-section through a flexed panel of FIG. 11A.
Figure 11D:
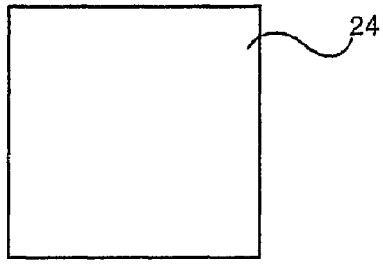
FIG. 11D is a plan of a membrane tie.
Figure 11E:
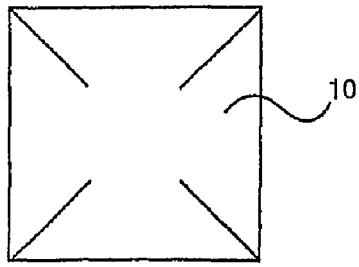
FIG. 11E is a plan of a tied, flexed panel.
Figure 11F:
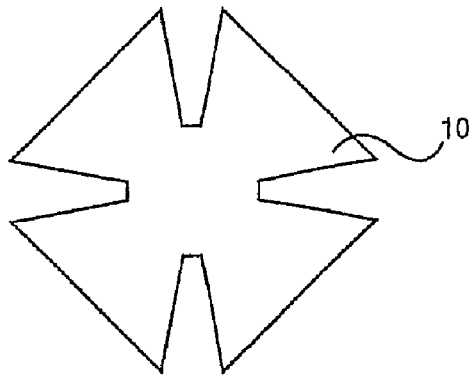
FIG. 11F is a plan of a panel.
Figure 11G:
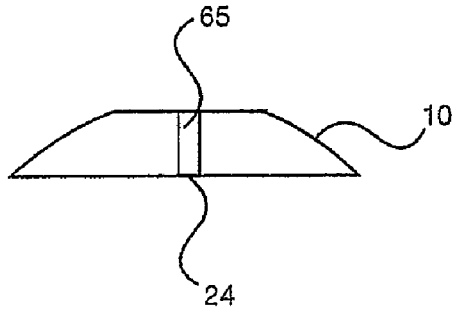
FIG. 11G is an elevation of a tied, flexed panel.

FIGS. 11A and B illustrate a plan and edge elevation view of petaloid panel 10. In FIG. 11C the "petals" are flexurally deformed to create a continuous enclosure as illustrated in FIG. 11E on plan. FIG. 11D is a plan view of membrane tie 24 which ties the outside edges of the four petals to create the sealed enclosure of FIG. 11E. FIG. 11F illustrates another petaloid panel 10 which creates, in a similar sequence to FIGS. 11B-E, an enclosure with four openings 75. The embodiments of FIGS. 11A-E and FIGS. 11F and G can be combined, for example to create a single door opening in an igloo-like enclosure.

Figure 12A:
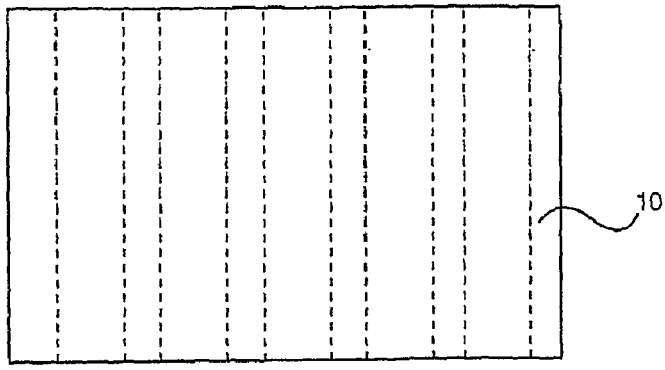
FIG. 12A is a plan of a corrugated panel.
Figure 12B:
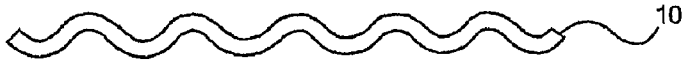
FIG. 12B is an edge elevation of a corrugated panel.
Figure 12C:
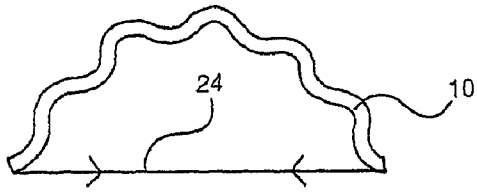
FIG. 12C is a cross-section of a tied, flexed corrugated panel.
Figure 12D:
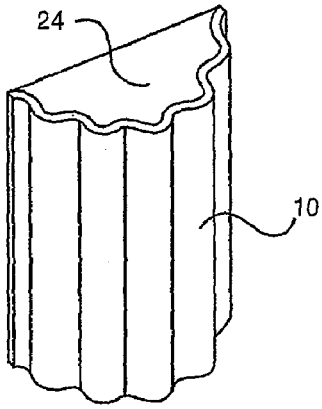
FIG. 12D is a perspective of a tied, corrugated panel assembly.
Figure 12E:
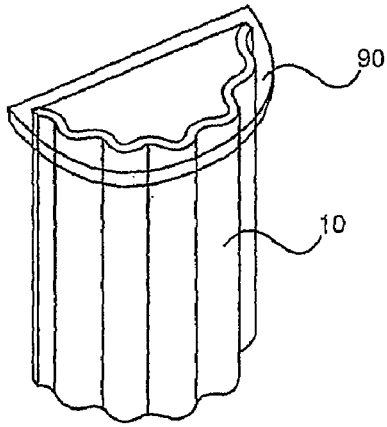
FIG. 12E is a perspective of a table comprising a tied, corrugated panel.

FIGS. 12A-D illustrate the use of a corrugated panel 10, curved about an axis parallel to the direction of the corrugations, the ease of bending being similar to a plane panel of the same thickness with membrane tie 24 restraining the flexed, corrugated panel 10. Such assemblies are particularly strong in resisting superimposed loading in the direction of the corrugations, for example gravitational loading if the assembly is orientated with the corrugation vertical, for example to form a table with top 90, as illustrated in FIG. 12E. Corrugated panels can also be flexed about an axis perpendicular to the direction of corrugations, in which much greater lengths of flexed panel 10 and membrane tie 21 can be achieved for a particular thickness of corrugated panel, or example bus shelters. The corrugated panel material is selected to suit the particular application, for example thin corrugated acrylic would be appropriate for a table application, in conjunction with an acrylic membrane tie and, for example extruded corrugated polycarbonate would be suitable for a roof canopy of say 5 to 10 meters span.

Figure 13A:
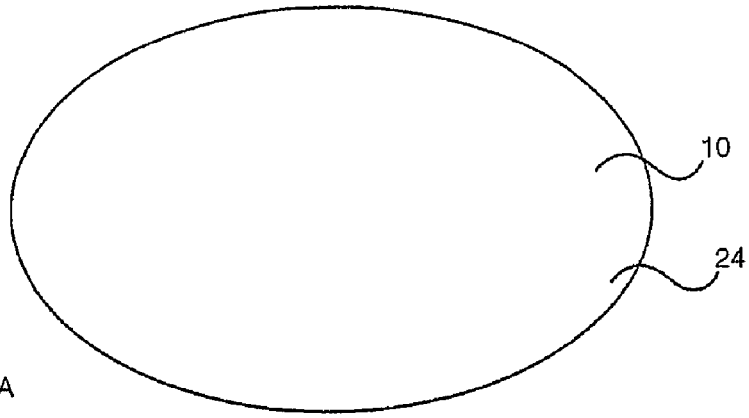
FIG. 13A is a plan of a single oval-shaped panel.
Figure 13B:
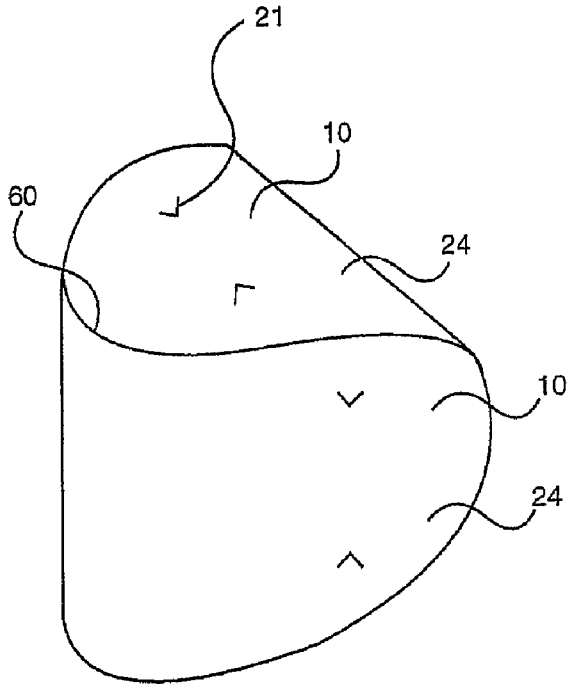
FIG. 13B is a perspective of two flexed, oval-shaped panels forming an assembly.
Figure 13C:
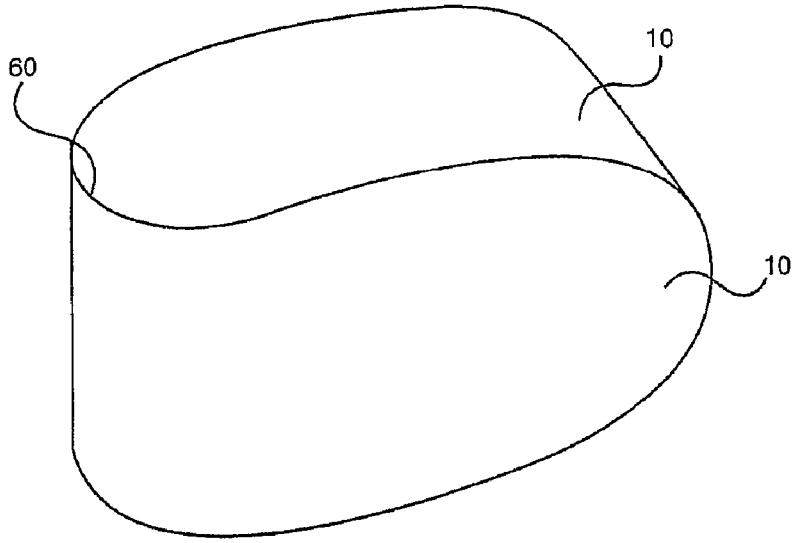
FIG. 13C is a perspective of an assembly comprising two mutually interactive curved panels.
Figure 13D:
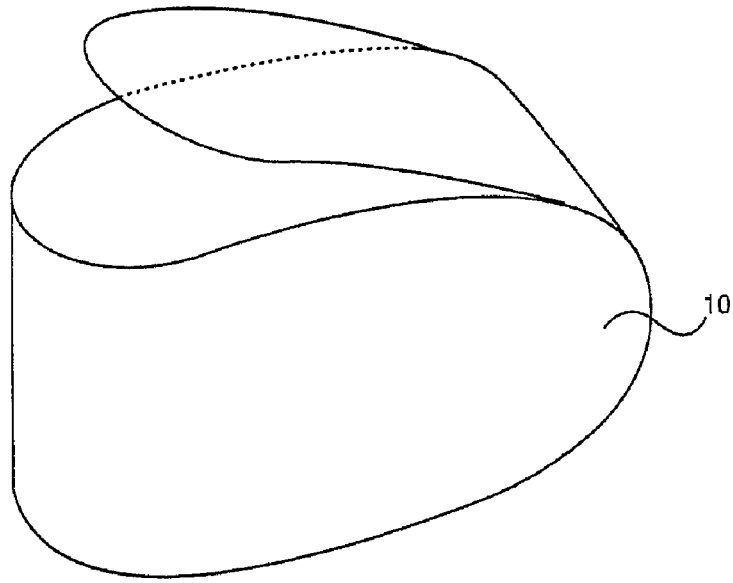
FIG. 13D is a perspective of two mutually interactive curved panels with one end of one of the curved panels released.

FIGS. 13A and B illustrate an embodiment in which two identical elements can both be flexed and joined by linear connector 60 to form a three dimensional enclosure of the invention in which each flexurally deformed panel 10 also acts as membrane tie 24 to the other panel, as illustrated in FIG. 13B. FIGS. 13C and D illustrate a variant of this embodiment in which the panel/membrane tie elements are extended by a central rectangular section to form an elongated three dimensional enclosure, for example in which linear connector 60 is a zip enabling the embodiment to be used as a container, for example, to hold personal effects.

Figure 14A:
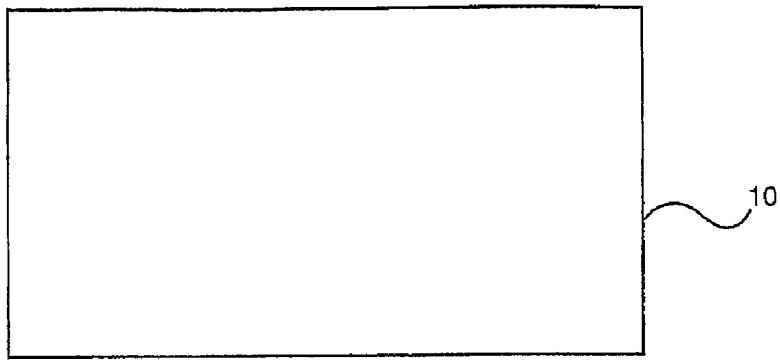
FIG. 14A is a plan of a panel.
Figure 14B:
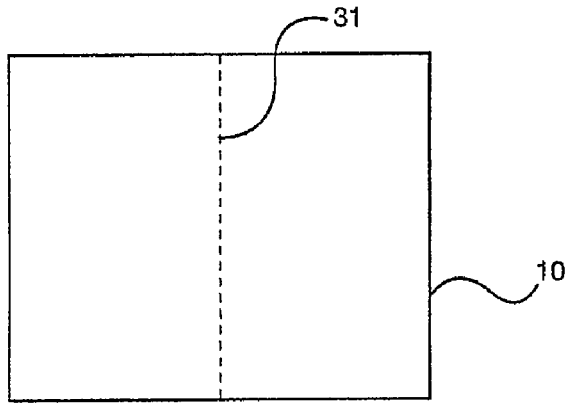
FIG. 14B is a plan of a panel creased along a central line.
Figure 14C:
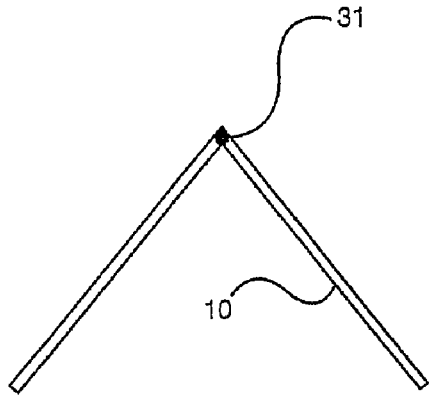
FIG. 14C is a cross-section of a creased panel.
Figure 14D:
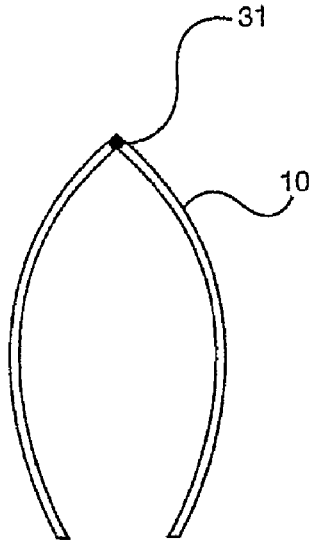
FIG. 14D is a cross-section of a flexed, creased panel.
Figure 14E:
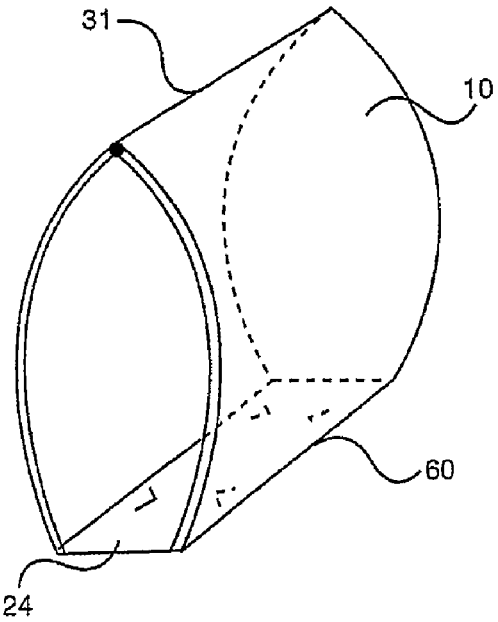
FIG. 14E is a perspective of a tied, flexed, creased panel.

FIGS. 14A-E illustrate an embodiment in which panel 10, illustrated on plan in FIG. 14A, is folded along fold line 31, as illustrated in FIGS. 14B and C. For example, if panel 10 is of stainless steel, fold line 31 would comprise a "plastic hinge" where the panel 10 is permanently deformed but still able to withstand a bending moment perpendicular to fold line 31. This allows subsequent flexure of panel 10 according to the invention, as illustrated in FIG. 14D, subsequently tied with membrane tie 24, as illustrated in FIG. 14E. Such an assembly may be used to create, for example, an individual shelter or, connected end-to-end, form a walkway, for example in a hostile environment, for example in conditions of extreme cold or heat.

Figure 15A:
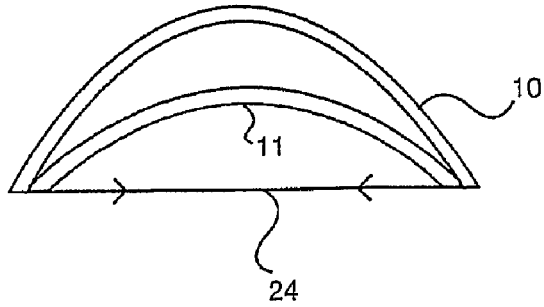
FIG. 15A is a cross-section through an assembly comprising two flexed panels.
Figure 15B:
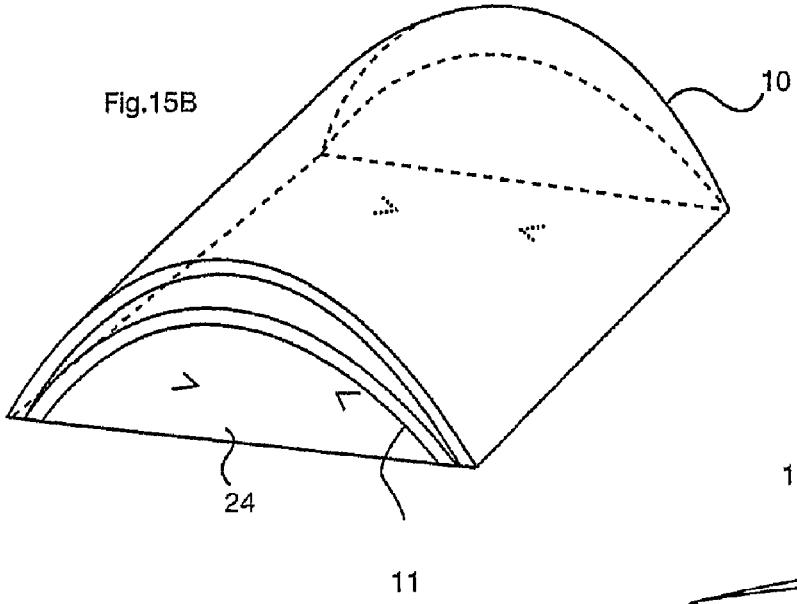
FIG. 15B is a perspective of an assembly comprising two flexed panels.
Figure 15C:
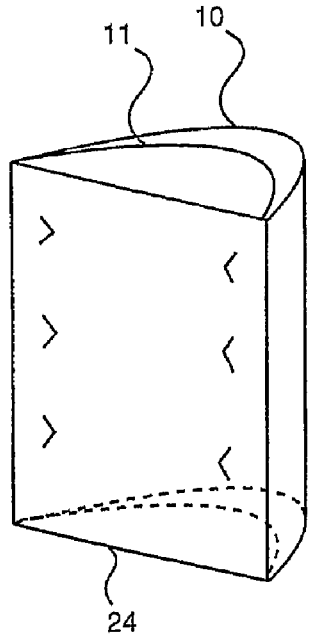
FIG. 15C is a perspective of an assembly comprising two flexed panels.
Figure 15G:
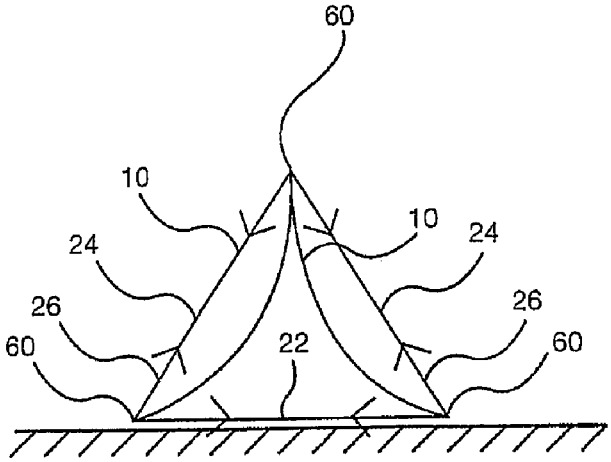
FIG. 15G is a cross-section through two assemblies and a connecting linear tie.
Figure 15H:
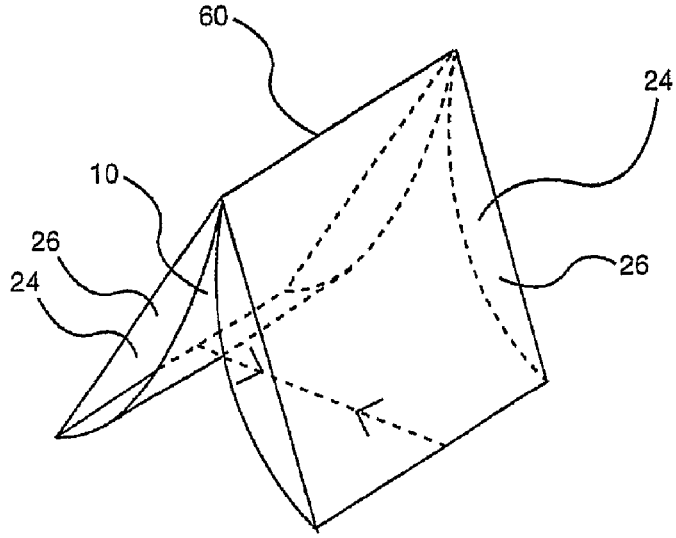
FIG. 15H is a perspective of two assemblies and a connecting linear tie.
Figure 15J:
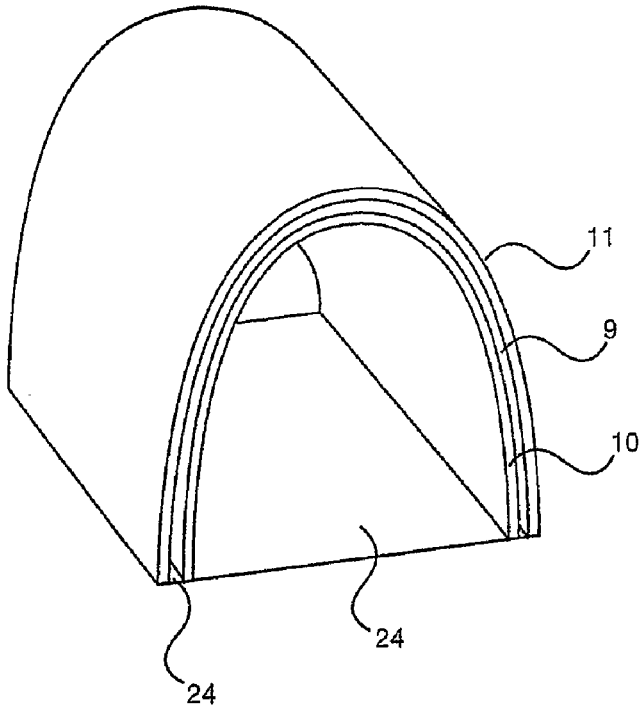
FIG. 15J is a perspective of an assembly comprising two tied, flexed panels.

FIGS. 15A-F illustrate embodiments comprising a plurality of panels. In FIG. 15A, panel 10 and second panel 11 are both tied by membrane tie 24, as illustrated in perspective in FIGS. 15B and C. Such an assembly has many potential uses, for example a building shelter in a hot climate according to FIG. 15B comprises an inner enclosure within second panel 11 and membrane tie 24 being protected from harsh sunlight by panel 10, the gap between panel 10 and membrane 11 for example remaining open, to allow ambient air movement to further mitigate solar heating of the internal enclosure between second panel 11 and planar tie 24. FIGS. 15D and 15E illustrate an embodiment in which flexurally deformed panels 10 and 11 are deformed in an opposing relationship, both tied by membrane tie for example to display and protect products on both sides of membrane tie 24. FIG. 11F illustrates how much an embodiment may be used to create a tower structure, a dual duct or dual pipe structure. FIGS. 15G and H illustrate an embodiment in which two assemblies of the invention are connected along the line of a single or double linear connector 60 and, for example, the opposite edges being connected by linear tie rod 22, for example to form a large display assembly as illustrated in FIG. 15H. FIG. 15J illustrates another embodiment comprising two panels 10 and 11 which are spaced apart and both connected by a single membrane tie 24. For example such an assembly can form a sophisticated enclosure, the flexurally deformed panels 10 and 11 being spaced apart to form a plenum 9 through which air can be circulated through a flexible end seal and air duct combined (not shown) which, optionally combined with solar reflective transparent panel 10 and/or 11 can achieve an environmentally controlled interior, suited for example as a garden office with membrane tie 24 acting as a ground sheet, for example with modular flooring above this waterproof membrane tie 24.

Figure 16A:
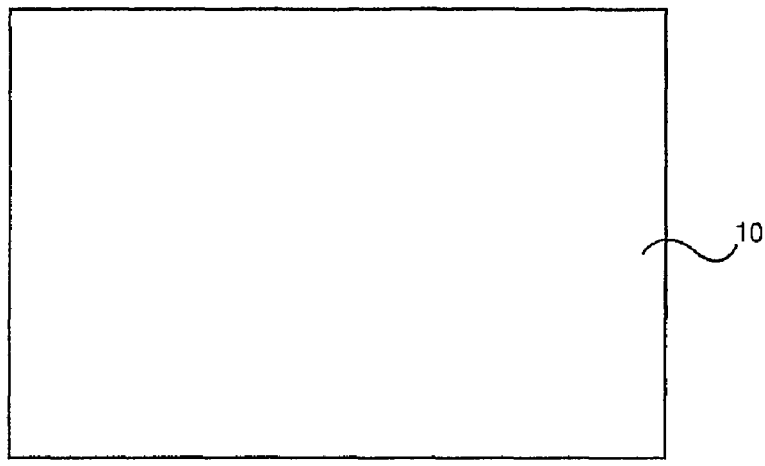
FIG. 16A is a plan of a panel.
Figure 16B:
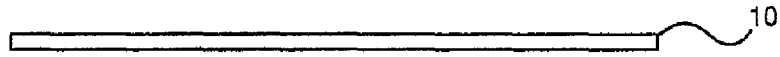
FIG. 16B is an edge elevation of a panel.
Figure 16C:
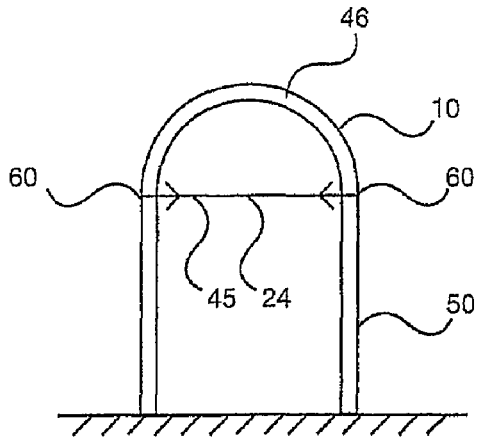

FIGS. 16A and B illustrate plan and edge elevation views of panel 10 which is flexurally deformed and tied with membrane tie 24 along lines spaced within the left and right hand sides of panel 10, for example to create a shelter with barrel vault roof 46, side walls 50 and ceiling 45, as illustrated in FIG. 16C. There are many suitable materials for such embodiments according to FIGS. 16A-C, for example polycarbonate sheet for the panel 10, polycarbonate film for the membrane tie 24, connected by extruded polycarbonate angle section, linear connectors 60. For example, angle linear connector 60 is permanently adhered to membrane tie 24 and bolted through a line of holes in panel 10, forming an easily transportable and erectable structural system, panels 10 typically being stored and transported flat and membrane ties 24 with adhered angle linear connectors 60 typically being stored and transported in rolls. Such shelters may be combined to form a walkway.

Figure 17A:
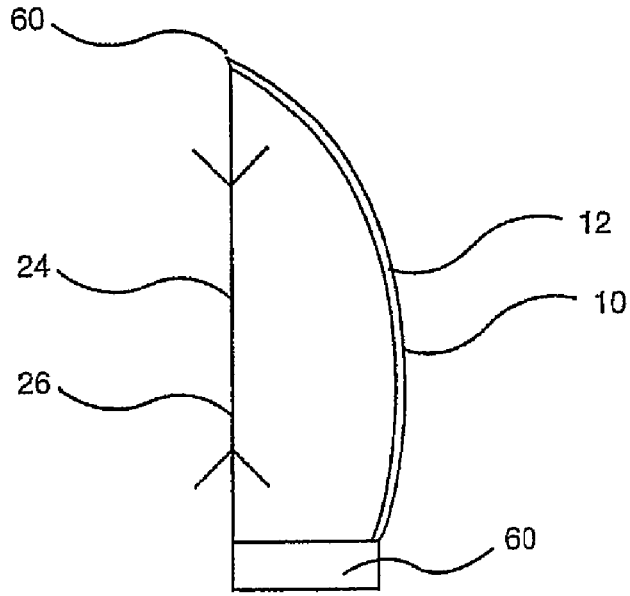
Figure 17B:
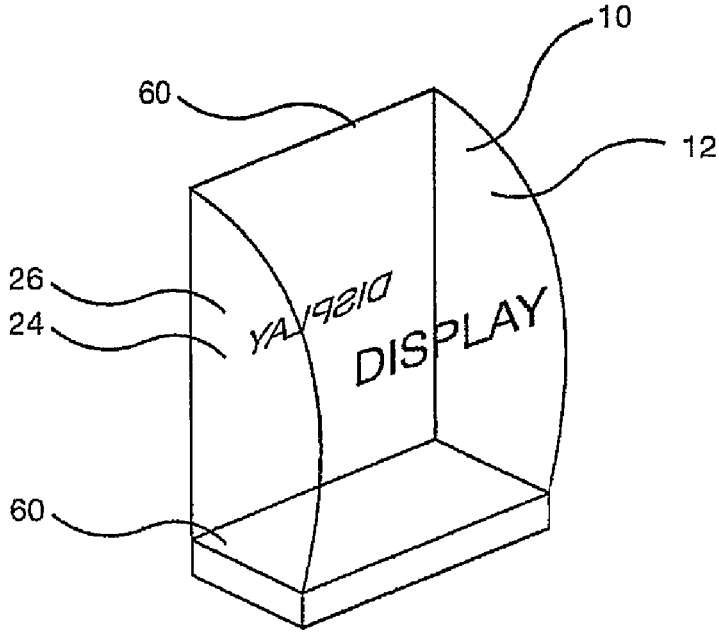
Figure 17C:
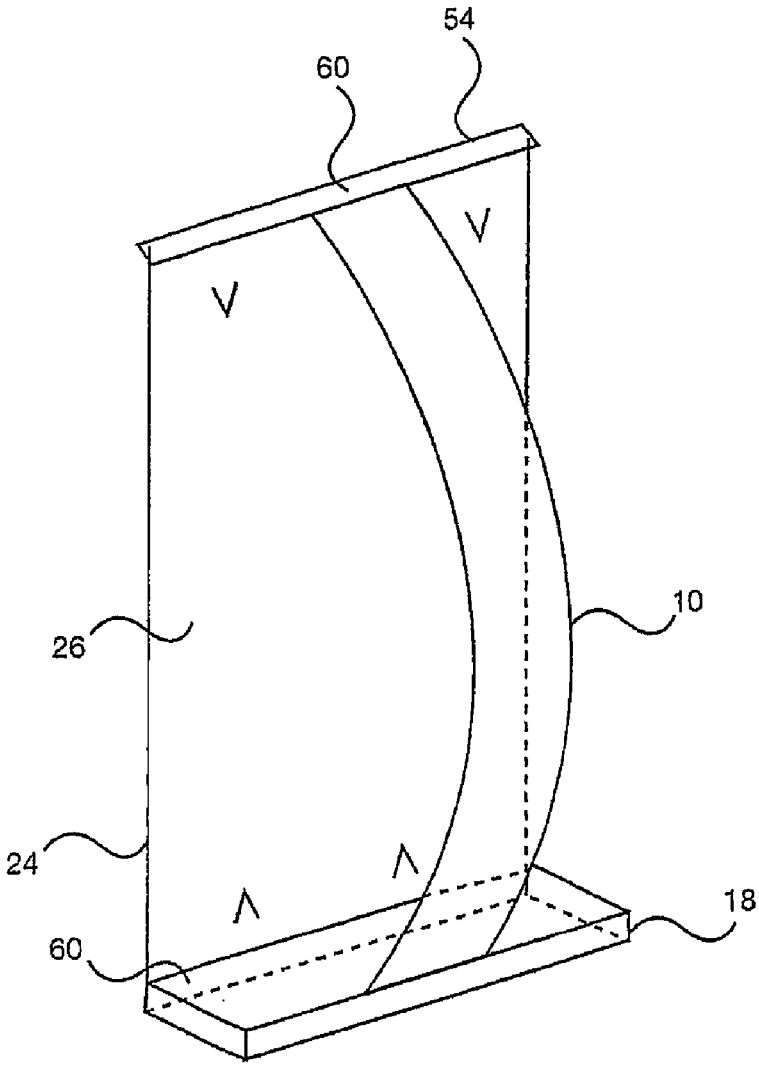

FIGS. 17A-C illustrate graphic display devices comprising flexurally deformed panel 10, restrained by membrane tie 24, for example a membrane tie display sign 26 which is tensioned between the linear connectors 60 of top member 54 and relatively heavy base 18, which provides the overall stability to the assembly. If panel 10 is transparent, for example a clear polycarbonate sheet, this assembly provides an attractive alternative to prior art display systems, as there are no vertical, sloping or bowed opaque structure elements, which is particularly advantageous in the case of a transparent or semi-transparent membrane tie display sign 26.

Figure 18A:
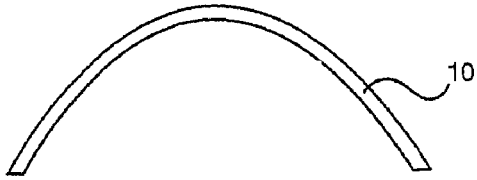
Figure 18B:
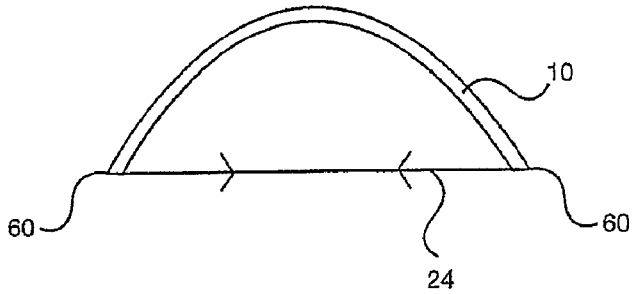
Figure 18C:
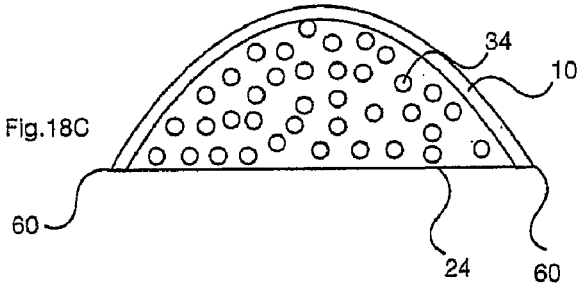
Figure 18D:
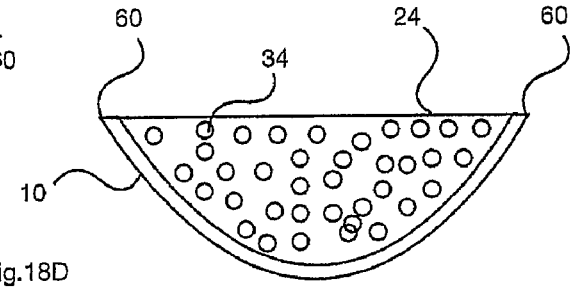
Figure 18E:
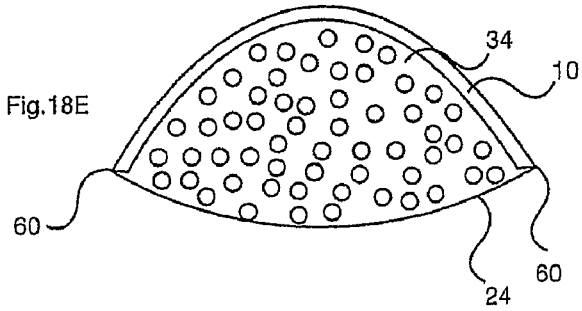
Figure 18F:
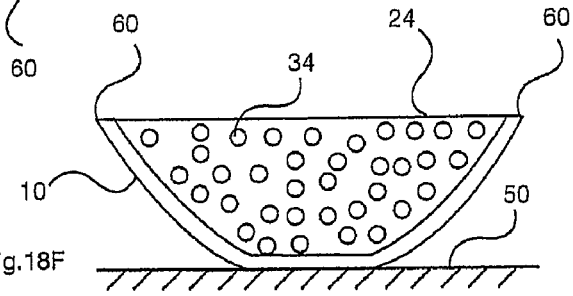

FIG. 18A illustrates flexurally deformed panel 10, which is shown tied with membrane tie 24 in FIG. 18B. In FIG. 18C, the gap between the two components 10 and 24 is filled with infill 34. For example, the assembly forms a service duct and the infill 34 optionally comprises a plurality of tubes or cables, for example to transmit liquids, electricity or other services. Alternatively, for example, infill 34 is a foamic material, for example to be used as a heat insulating component of a larger assembly or to create a stressed-skin structure, for example a structural beam, optionally inverted as illustrated in FIG. 18D. Alternatively, for example, infill 24 comprises compressible elements, for example compressible spheres or cylinders or small embodiments of the present inventions. Such an assembly may be used in a modified version of the spring and other uses of the embodiment of FIG. 2MM and may exhibit deformation in use, as illustrated in FIGS. 18E and 18F, for example to absorb energy.

FIGS. 19A-H, 19J-N, 19P-19HH, 19JJ-NN, and 19PP illustrate further practical embodiments of the invention.

In some embodiments, cables or tie rods are used after the main function of the assembly has been completed, in order to dismantle the assembly. For example, the invention can be used as part of a flat-pack and easily assembled and reusable formwork system for constructing ribbed reinforced concrete floor with downstand beams, as illustrated in FIGS. 19A and B. FIG. 19A is a cross-section through a floor following casting of concrete 95, showing temporary formwork comprising flexed panels 10 (optionally coated with a release agent on the top surface) with an array of tie rods 22 forming membrane tie 24, located and spanning between temporary "header" beams 96 supported on temporary props 97. FIG. 19B is a cross-sectional plan X-X of the same arrangement. Turnbuckles 70 are adjusted to achieve the required curved shape of panels 10 to which the concrete is to be poured. When the concrete is sufficiently curved, the turnbuckles 70 are again adjusted to draw in the sides of the panels 10, before or after removal of the temporary "header" beams 93 and temporary props 97, in order to release and remove the panels 10 from the cast concrete. This formwork system represents a considerable advantage over prior art systems requiring storage, transport and handling of three-dimensional formwork units, typically having no easy means of being released from the cured concrete, which process commonly incurs damage to both formwork and the cast concrete surface.

Embodiments of the invention can be flat-packed for ease of packaging and transport, for use in remote locations. FIGS. 19B and C illustrate a folded, portable headrest comprising membrane tie 24, on one side of which is a fastening system 69, for example of Velcro, to temporarily attach the headrest to a seat, for example in a train or car, two panels 10, for example of rubber compound, can be flexed and connected to the membrane tie 24 by means of linear connectors 60, for example also comprising Velcro, to form a practical, flat-packed headrest which is more convenient than three-dimensional fixed headrests or inflatable headrests of the prior art.

FIG. 19E illustrates a luminaire comprising flexed mirror coated plastic panel 10, for example of mirror-coated acrylic or polycarbonate, tied by transparent membrane tie 24, for example of polyester film or a polyester netting material, which allows the transmission of light emanating from light source 92 and partially reflected off the panel 10 with mirror-coating 94. The curve of the panel 10 is similar to a parabola in the illustrated degree of flexure, which can be considered to have a "focal point" at which the light source 92 is preferably located.

FIG. 19F illustrates a solar collector with solar collector tube 93, typically black, preferably located at the "focal point" of the flexed panel with mirror coating 94, by means of end panels 32. Water is held in the solar collector tube within a solar heating system that allows heated water to rise.

FIGS. 19G and H illustrate a flat-packed tent-like enclosure comprising a flexed panel 10, for example of polycarbonate, ground sheet membrane tie 24, for example of reinforced pvc, adhered together on one side and with a suitably profiled linear connector on the other side, for example selected from one of the options in FIGS. 23A-H, 23J-N, and 23P-24R, preferably fixed to the ground by tent pegs 83 and optional guy ropes 55.

FIG. 19J illustrates a flat-packed water or other liquid duct system typically comprising a plurality of assemblies, each comprising, for example, a pvc flexed panel 10 with a membrane tie 24, for example also of pvc if a closed duct is required or a suitable netting, for example of polyester twine, if an open duct is required, for example with profiled section linear connectors. The flexed form of panel 10 advantageously is of a smaller radius at the bottom of the duct than higher up the sides, a well known prior art benefit in duct and pipe design in order to assist low volume flow.

FIG. 19K is a cross-section through a lounger seat comprising flexed panel 10 for example of polycarbonate, membrane tie 24, for example of polyester fabric, with an additional membrane tie 25, typically adhered to panel 10 and sewn to membrane tie 24 to achieve the pre-stressed structure illustrated by tension arrows 21, in which membrane tie 24 is pulled towards panel 10 by additional membrane tie 25. FIG. 19L illustrates the same lounger chair in use, in which panel 10 and membrane tie 24 are deformed by the weight of occupant 99, additional membrane tie 25 typically becoming slack in use.

FIG. 19M illustrates an embodiment with the membrane tie 24 deformed in the opposite direction to FIG. 19K by means of prop member 97, for example of acrylic sheet material, which is in compression as illustrated by compression arrows 98. Such an arrangement is used, for example to provide a display comprising panel display sign 12, for example of printed acrylic sheet, membrane tie 24 being for example of polyester film, as illustrated in FIG. 19N.

FIG. 19P illustrates a retail display system comprising an assembly with transparent panel 10, for example pvc sheet adhered to membrane tie 24, for example of pvc film, containing display object 80, for example an item of jewellery, within a box 86 with lid 87, typically of decorated card. FIG. 19Q illustrates the box upturned to support the display assembly in use, which protects but allows side access to the displayed object, for example jewellery in a retail environment, which is also shown in perspective in FIG. 19R. FIG. 19S illustrates another display assembly through which product 80 projects through hole 75 in panel 10. Display panel 56, for example in a return edge to tie member 24, for example of card, is adhered to transparent panel 10, for example of pvc.

FIGS. 19T-19HH, 19JJ-NN, and 19PP refer to other uses for embodiments of the invention utilising materials suited for the particular application which for brevity will not be described in detail except as follows. FIG. 19 illustrates a "desk tidy" with two flexed panels 10 with a mutual tie 24, a similar system for which is adopted for the vase for dried flowers illustrated in FIG. 19U.

FIG. 19V illustrates a garden cloche system comprising individual assemblies with transparent panels 10, for example of pvc, with ground cover plastic film membrane ties 24, typically of light absorbing black color, with holes 75 to accommodate seedlings and typically extended beyond panels 10, for example to be held down by means of pegs 83.

FIGS. 19W and X and illustrate a sandwich packaging assembly comprising cruciform panel 10, for example of polyethelene laminated paper adhere to membrane tie 24, for example of card.

FIGS. 19Y and Z illustrate a display assembly comprising a panel 10, typically transparent, for example of pvc, with hole 75 enabling a raised membrane tie 24 in addition to a base membrane tie 24.

The invention can be used for a variety of furniture applications, optionally modular and multi-use, typically flat-packed for convenience for occasional use in a particular location or for transport and use in another location. FIGS. 19AA and BB illustrate alternative podium designs with top 90 supported on panel 10 and membrane tie 24.

FIG. 19CC illustrates two plinth assemblies each comprising top 90, curved side panels 10 and plane side panels 24, for example for seating, or to stand on, or to form the base of a table, for example with glass top 90 as illustrated in FIG. 19DD.

FIG. 19EE illustrates open bin assemblies, for example for use in a retail environment.

FIGS. 19FF-HH and 19JJ-KK illustrate a collapsible display system with two panel display signs 12 fixed together at two opposing sides, for example by adhesive or a suitable proprietary closure systems 69, for example Velcro attached to return edges 14, which also act as linear connectors to a mutual membrane tie, for example of elasticated fabric 29 stretched between the two connected edges. The elasticated fabric membrane tie 29 optionally pulls the opposing edges together to form a retail display, optionally comprising base 80 illustrated in FIG. 19G, which also acts optionally as a prop to maintain the assembly in a flat-packed condition illustrated in cross-section in FIG. 19KK and in perspective in FIG. 19JJ, optionally assisted by press studs (poppers) 48.

FIG. 19LL illustrates a flat-packed seat comprising a relatively flexible panel 10, for example of polycarbonate sheet, with membrane tie 24, for example also of polycarbonate sheet, supporting top 90, for example also of polycarbonate sheet.

FIG. 19MM illustrates another retail display system with membrane tie display sign 26 projecting above flexed panel 10 forming a product bin with an optional base or raised floor.

FIG. 19NN illustrates a packaging unit comprising a single flexed panel 10, typically of transparent sheet plastic, for example of PLA, with membrane tie 24 with holes 75 within which to hold products, for example eggs, which are also supported by and protected by underlying flexed panels 10 attached to the same membrane tie 24, for example by adhesive.

FIG. 19PP illustrates a flat-pack, floor-mounted sign with optionally raised membrane tie 24. The membrane tie 24 can optionally be of the same material and folded at one end out of the same sheet as panel 10, typically to be fixed by a temporary linear connector at the other end, for example by an open hook profile section or proprietary system, for example Velcro. Optionally in this and other embodiments, the linear connector is located remote from the ends of the membrane tie, for example central to the display, for example by means of a proprietary system such as Velcro.

FIGS. 20A-D illustrate flat-pack assemblies in loops, for example to display photographs, postcards or greetings cards, typically comprising a panel 10 which is hinge-connected to two linear stiffening members 14 and membrane tie 24, for example as shown in FIG. 20A with self-adhesive 63 temporarily protected by release liners 65. This arrangement can be conveniently packed and shipped, for example mailed in an envelope, to be converted by removing the release liners 65 and folding the assembly as illustrated in FIG. 20B, to produce an embodiment of the invention which is firmly connected by means of external stiffening members 14 and adhesive 63. FIG. 20C illustrates a similar arrangement but with a permanent adhesive 61 connecting panel 10 to the outer stiffening members 14 and pressure-sensitive adhesive 63 located outside the other, inner stiffening members 14 with temporary release liners 65. This arrangement can be reconfigured as illustrated in FIG. 20D with the stiffening members 14 located on the inside of panel 10, firmly adhered to membrane tie 24 by means of stiffening members 14 and adhesive layers 60 and 61. The loop assemblies of FIGS. 20A-D can be made by a variety of materials but preferably comprise separate paper or card elements 10, 24 and 14 which are laminated together on both sides, gaps between the individual elements just comprising two layers of laminating film to act as efficient hinges in the manner of prior art folding map technology, as disclosed in GB-2312869. The transparent laminating film or an optional single layer transparent plastic panel 10 contribute to an efficient structural system as well as providing an aesthetic means of display.

All the previously illustrated embodiments comprising a membrane tie typically require one or more linear connectors to connect the panel 20 and membrane tie 24 components together.

FIGS. 21A-E, 22A-H, 22J-N, 22P-Y, 23A-H, 23J-N, 23P-W, 24A-H, 24J-N, 24P-Z, 25A-H, 25J, and 25K are diagrammatic cross-sections through a variety of example linear connectors which connect planar tie 24 to panel 10.

Figure 21A:
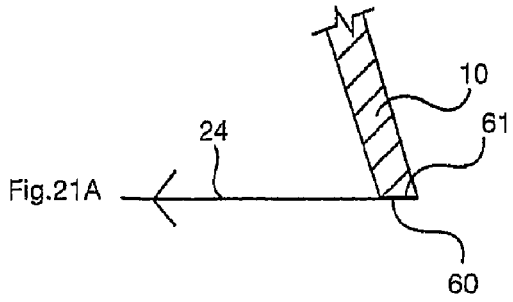
Figure 21B:
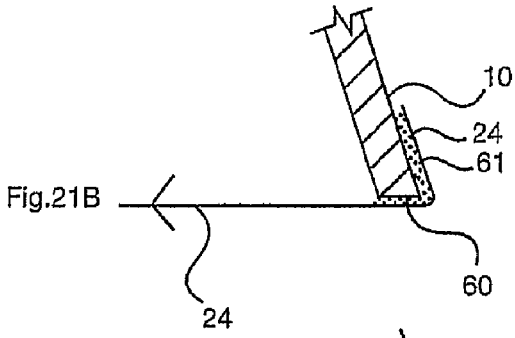
Figure 21C:
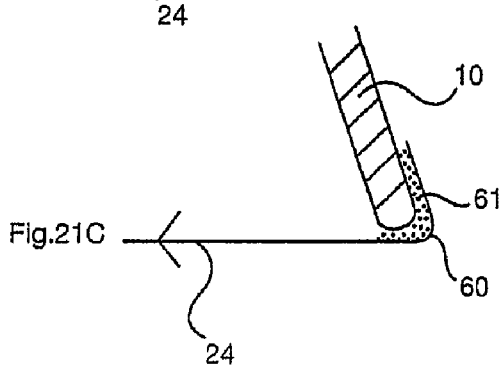
Figure 21D:
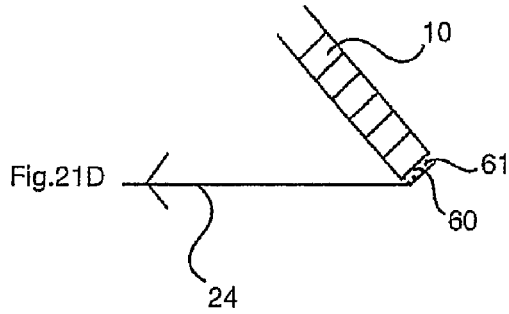
Figure 21E:
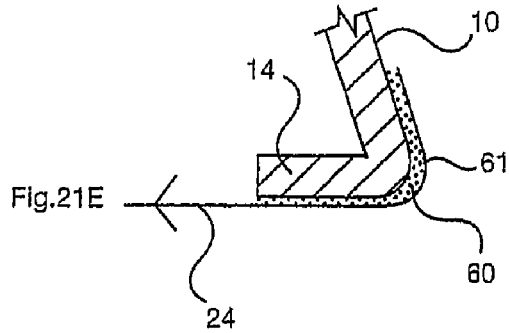

FIGS. 21A-E illustrate linear connectors 60 comprising a direct connection between a surface or surfaces of panel 10 and membrane tie 24. In FIG. 21A, membrane tie 24 is bonded to the edge of panel 10, for example by adhesive or weld 61. In FIG. 21B membrane tie 24 wraps around the edge of panel 10 providing a greater width of glueline or weld 61. FIG. 21C is similar to FIG. 21B but the end of the panel is formed into a smooth curve in cross-section and in FIG. 21D panel 10 is cut square the width of linear connector 60 is optionally increased by the provision of an edge return or stiffener 14, as illustrated in FIG. 21E, for example by hot wire bending of an acrylic panel 10. The adhesive 61 is selected to suit the membrane tie 24 and panel 10 components being directly connected over an area of each of their surfaces, for example an acrylic-based, pressure-sensitive adhesive 61 could be used to connect a polyester film membrane tie 24 to an acrylic panel 10.

Figure 22A:
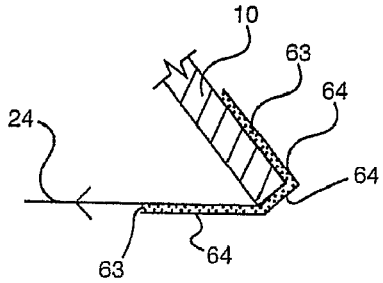
Figure 22B:
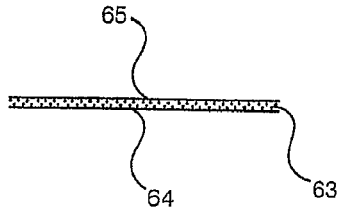
Figure 22C:
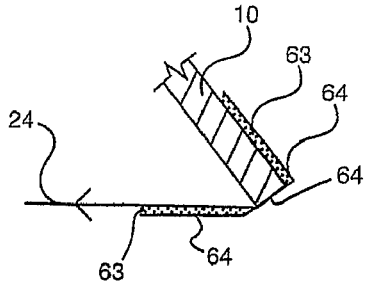
Figure 22D:
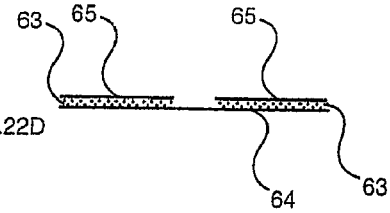
Figure 22E:
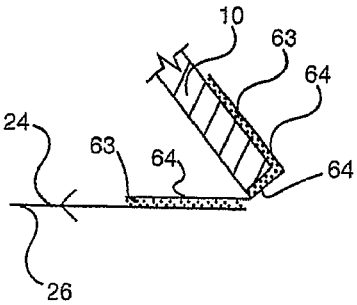
Figure 22F:
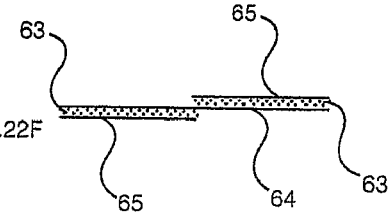
Figure 22G:
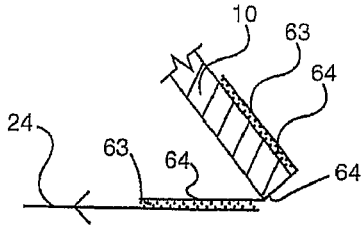
Figure 22H:
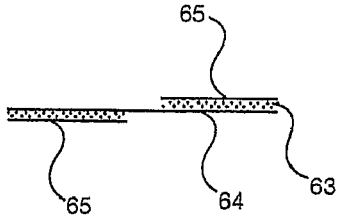
Figure 22J:
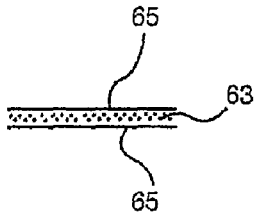
Figure 22K:
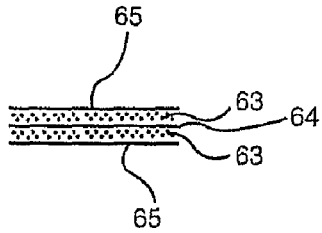
Figure 22L:
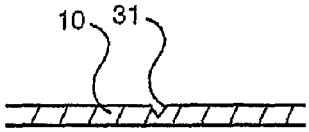
Figure 22M:
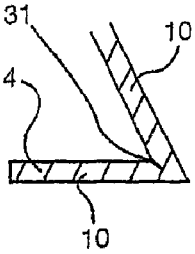
Figure 22N:
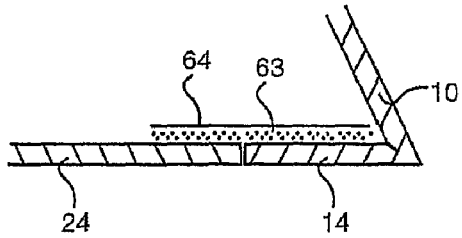
Figure 22P:
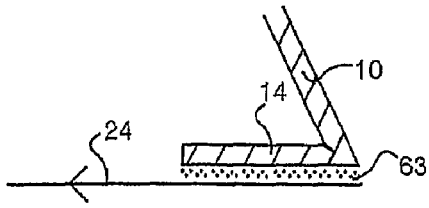
Figure 22Q:
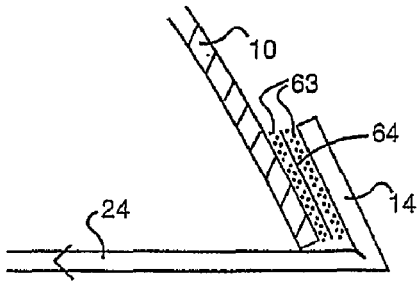
Figure 22R:
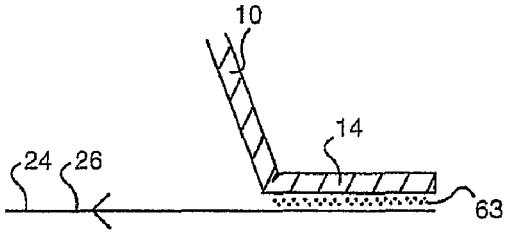
Figure 22S:
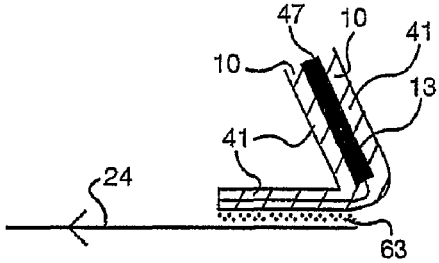
Figure 22T:
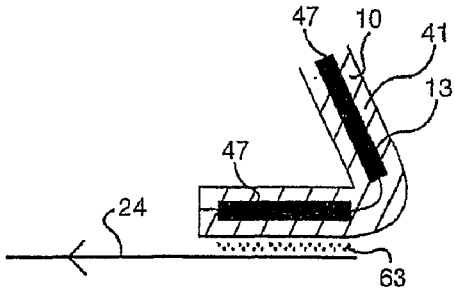
Figure 22U:
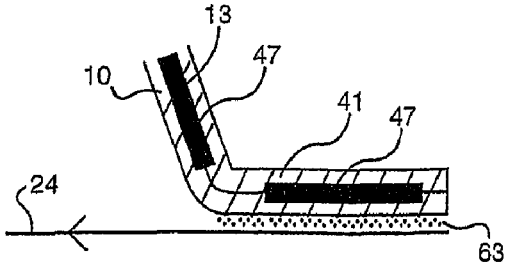

FIGS. 22A-H, 22J-N, and 22P-Y illustrate embodiments in which a self-adhesive tape 64, typically in conjunction with a pressure-sensitive adhesive 63 form a linear connector 60, for example FIG. 22A illustrates self-adhesive tape 64 wrapping around the outside of a connecting membrane tie 24 to panel 10 by means of pressure-sensitive adhesive 63 typically following removal of release liner 65 from a self-adhesive tape illustrated in FIG. 22B. FIG. 22C is similar to FIG. 22A, except that a customised self-adhesive assembly illustrated in FIG. 22D comprises spaced apart zones of lines of pressure-sensitive adhesive 63. FIG. 22E illustrates a novel type of self-adhesive assembly devised for use as a linear connector 60 of the present invention, in which off-set zones or lines of pressure-sensitive adhesive 63 are on opposing sides of self-adhesive tape 64, as shown in FIG. 22F. This novel arrangement enables the self-adhesive tape to obtain "purchase" from the outside of panel 10 but be located inside membrane tie 24, so as not to be visible from the front of membrane tie 24, which is especially desirable for aesthetic reasons and, for example, if membrane 24 comprises a membrane tie display sign 26. FIG. 22G is similar to FIG. 22E except that the novel self-adhesive tape of FIG. 22H comprises pressure-sensitive adhesive zones which are spaced apart as well as being on opposing surfaces of tape 64. FIG. 22J is a cross-section through so-called "transfer tape" comprising pressure-sensitive adhesive layer 63 and release liners 65 having different strengths of low adhesive connection to pressure-sensitive adhesive 63, such that one release liner 65 can be removed, the pressure-sensitive adhesive layer 63 applied to one surface, the other release liner 65 removed, enabling another surface to be adhered to pressure-sensitive adhesive 63, for example to provide a direct connection between panel 10 and return 14 of panel 10 and membrane tie 24, as illustrated in FIG. 22P. FIG. 22K illustrates so-called double-sided tape comprising pressure-sensitive adhesive 63 applied to both sides of tape 64 with release liners 65' of differential adhesion to the pressure-sensitive adhesive surfaces. This is used in a similar manner to the transfer tape of FIG. 22J but both layers of adhesive 63 and the intervening tape 64 are retained as illustrated in FIG. 22Q. Pressure-sensitive adhesive is of particular se in small embodiments of the invention, for example in displaying photographs or postcards, for which packs comprising pre-formed panels, for example of transparent acetate film, pre-scored to create a plastic hinge, fold or crease 31, as illustrated in FIGS. 22L and M, for example to be connected to the photograph or postcard acting as membrane tie 24 by self-adhesive tape in FIG. 22N or transfer tape as illustrated in FIG. 22P. Alternatively, the membrane tie 24 can be creased to form an upstanding return element 14, adhered to panel 10, for example by means of double-sided self-adhesive tape. FIG. 22R is a variant with stiffener 14 folded outwards, for example to create a frame effect to membrane tie display panel 26. FIGS. 22S-U illustrate linear connections to laminated film panels 10 using pressure-sensitive adhesive 63. FIG. 22V illustrates a laminated display panel 13 applied in place of a cut-out section of release liner 65, to assist easy subsequent application to panel 10 following removal of liner 65, as illustrated in FIG. 22W. FIG. 22X illustrates an adaptation of a prior art technique of forming self-adhesive tape into a "T" section to provide an effective adhesive capability to the inside surface of panel 10. FIG. 22Y illustrates the use of an intermediate triangular cross-section linear connector 60 with pressure-sensitive adhesive 63 on two surfaces in order to connect panel 10 with membrane tie 24.

Figure 23A:
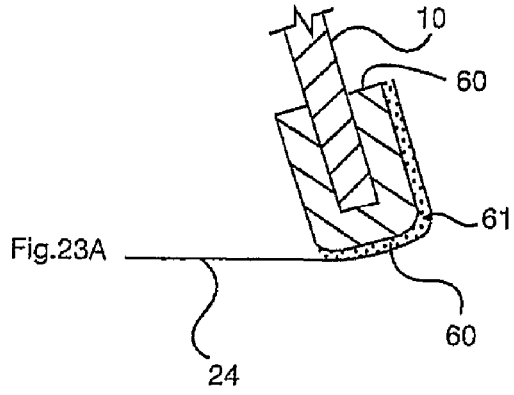
Figure 23B:
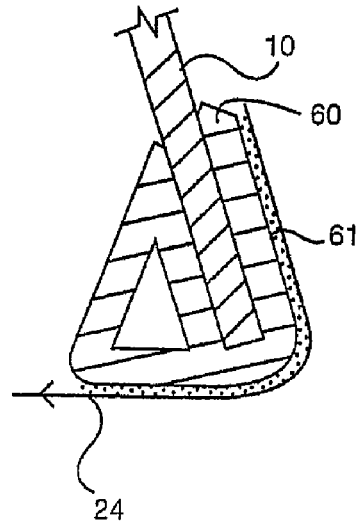
Figure 23C:
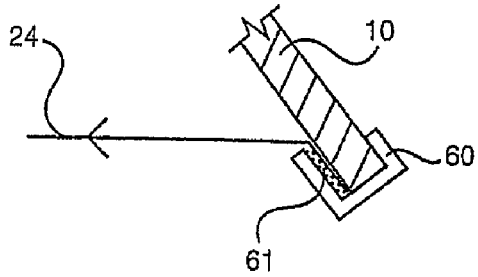
Figure 23D:
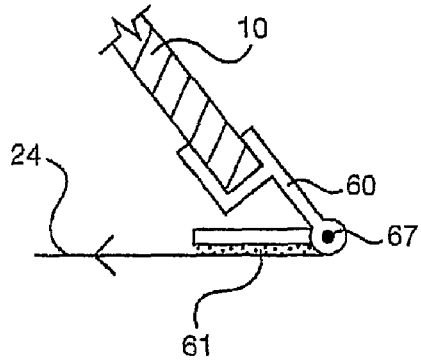
Figure 23E:
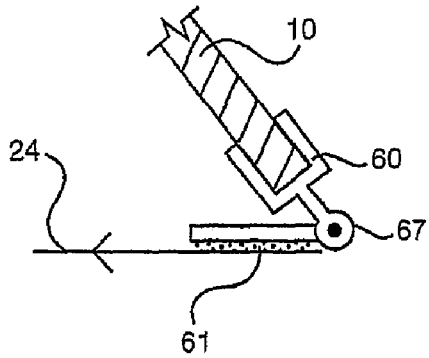
Figure 23F:
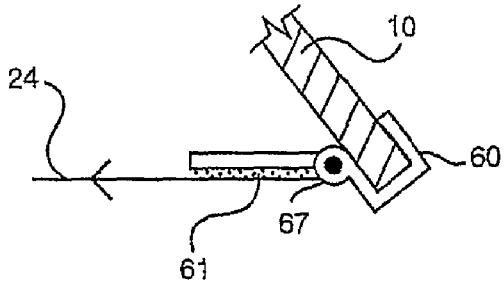
Figure 23G:
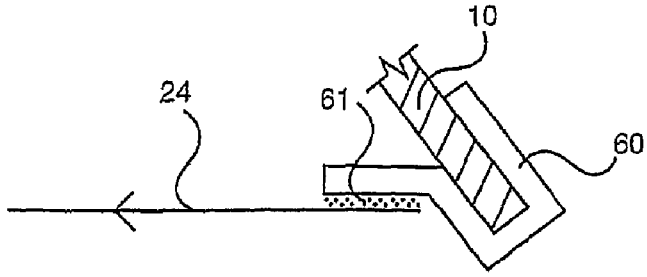
Figure 23H:
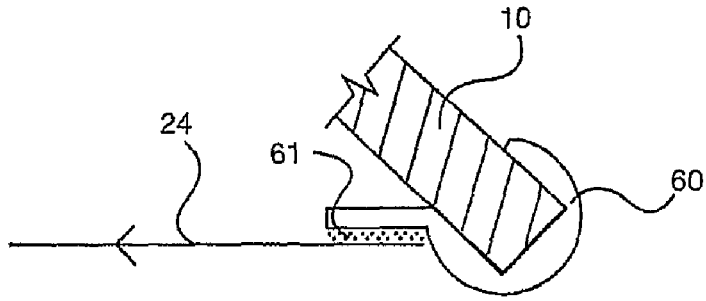
Figure 23J:
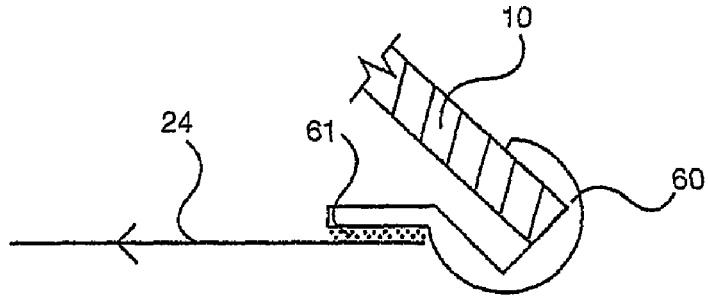
Figure 23K:
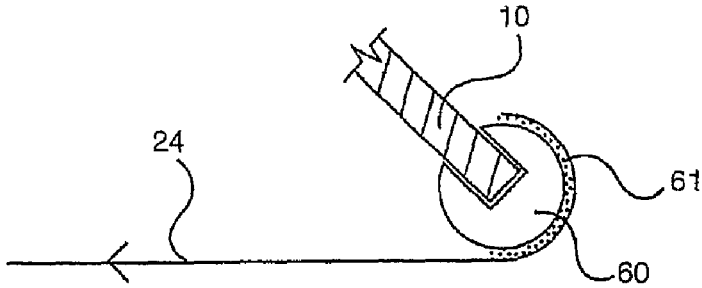
Figure 23L:
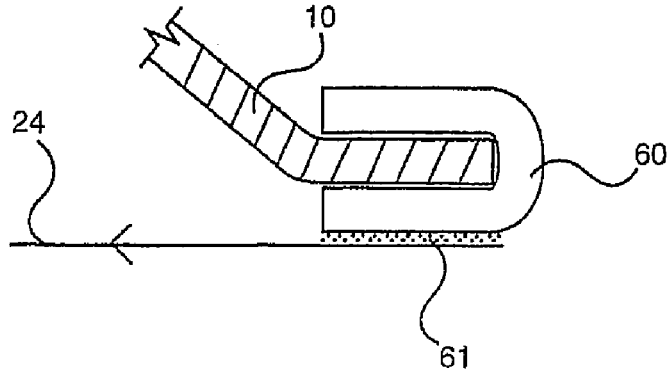
Figure 23M:
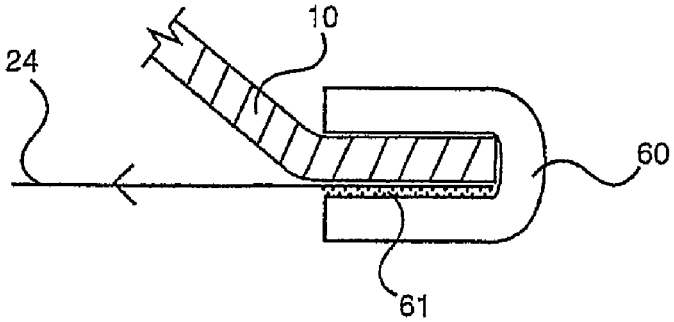
Figure 23N:
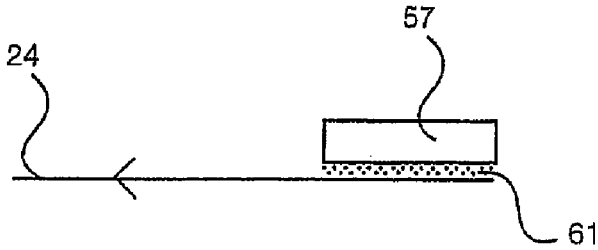
Figure 23P:
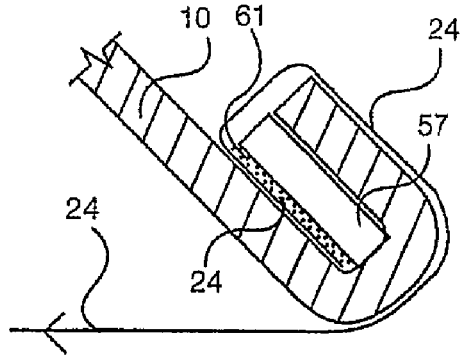
Figure 23Q:
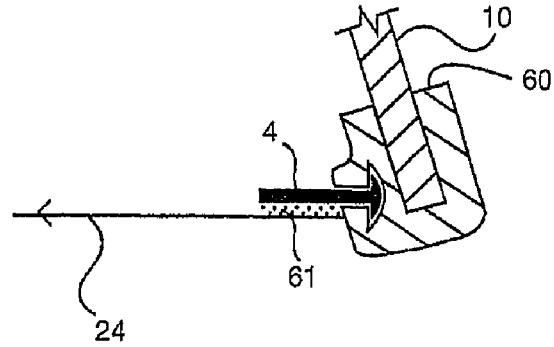
Figure 23R:
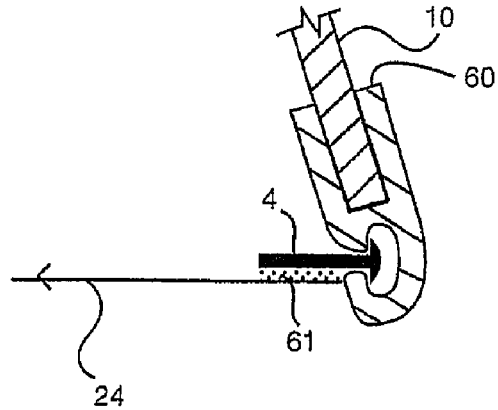
Figure 23S:
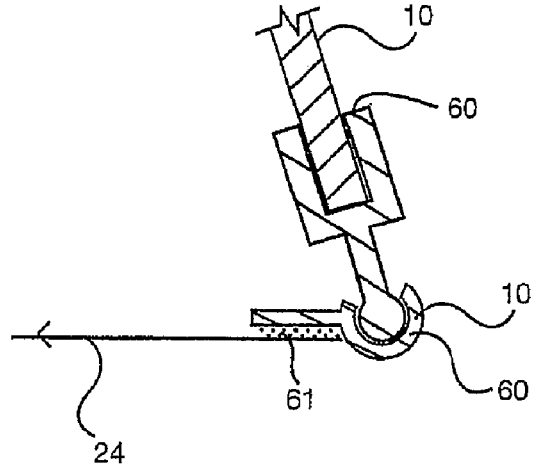
Figure 23T:
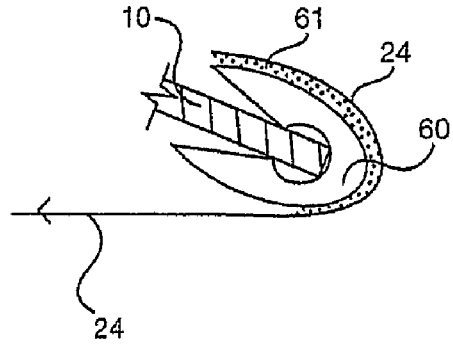
Figure 23U:
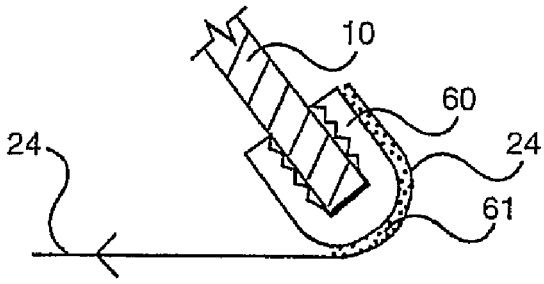
Figure 23V:
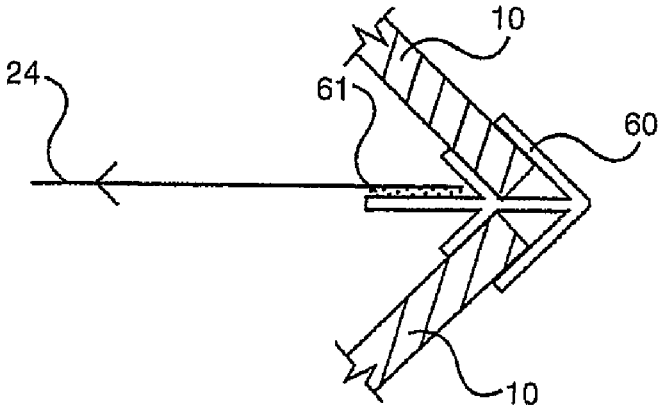
Figure 23W:
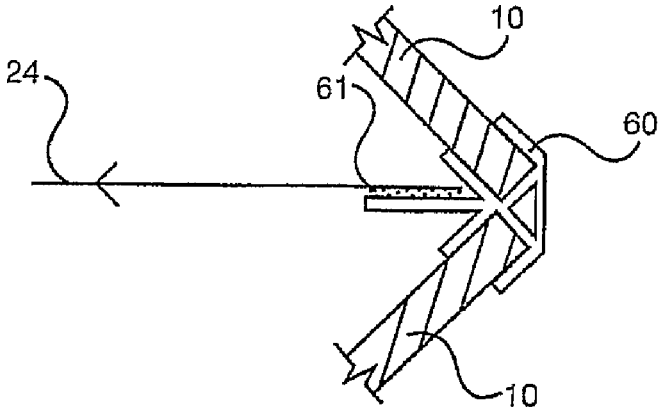

FIGS. 23A-H, 23J-N, and 23P-W illustrate linear connectors 60 comprising continuous profiled sections which surround the edge and part of each side of panel 10, typically provided with a suitable dimensional tolerance to allow the insertion of panel 10 into the profiled section. FIGS. 23A-C utilise adhesive 61, for example pressure-sensitive adhesive or heat-activated adhesive to join membrane tie 24 to profiled linear connector 60. FIGS. 23D-F illustrate linear connectors 60 comprising a hinge 67 to accommodate different angles of inter-section between a panel 10 and membrane tie 24. FIGS. 23G and 23H illustrate sections in which an adhesive connection 61 between linear connector 60 and membrane tie 24 is aligned with the lateral reaction of panel 10 against linear connector 60, whether the panel is sized to fill the opening in the connector, as illustrated in FIG. 23H, or of lesser thickness, as illustrated in FIG. 23J. Some linear connectors 60 accommodate eccentric loading induced by membrane tie 24, for example the slotted, cylindrical section of FIG. 23K acts like the end of a spanner in transmitting the purely tensile force of membrane tie 24 to panel 10, as does the u-shaped profile in FIG. 23L. However ideally, according to the present invention the linear connector should affect a joint between the panel 10 a membrane tie 24 close to their point of intersection, as illustrated in FIG. 23M. The end of panel 10 can be formed into a u-section and an efficient means of connection, for example remote from the manufacturing location can be effected by flat section 57 adhered to membrane tie 24, as illustrated in FIG. 23N to be located on site within the u-shaped return of panel 10, as illustrated in FIG. 23P. So-called mushroom section edge details two flexible panels are commonly used, for example to reinforced films or fabrics used to decorate the sides of trucks. These are typically welded or adhered to the film or fabric 24, as indicated diagrammatically by connecting weld or adhesive 61 in FIG. 23Q, in which mushroom insert section four is optionally slid into profile 60 as illustrated in FIG. 23Q or optionally pressed into profile 60 as illustrated in FIG. 23R. FIG. 23S illustrates an alternative edge section four which can be pressed onto section 60 to form a hinged linear connector. FIGS. 23T and U illustrate linear connectors 60 comprising a flexible plastic with "jaws" into which panel 10 can be squeezed. FIGS. 23V and W illustrate profiled sections to accommodate double panel embodiments, for example as illustrated in FIG. 15D, for example linear connector 60 being of extruded aluminium.

Figure 24U:
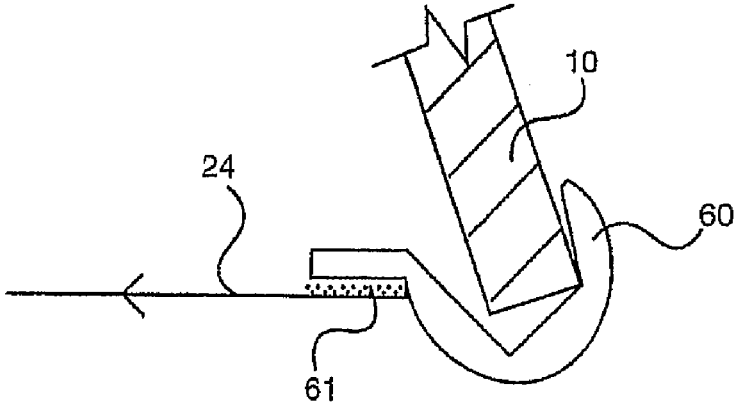
Figure 24V:
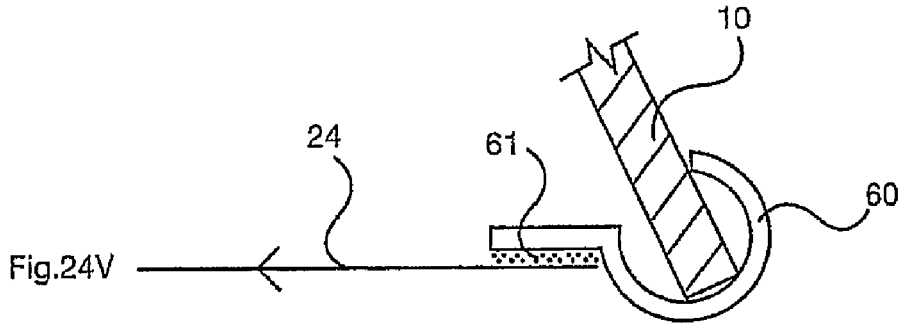
Figure 24W:
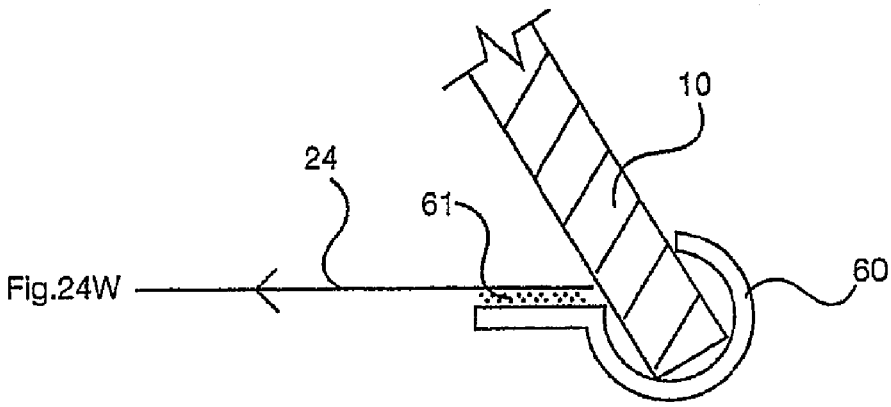
Figure 24X:
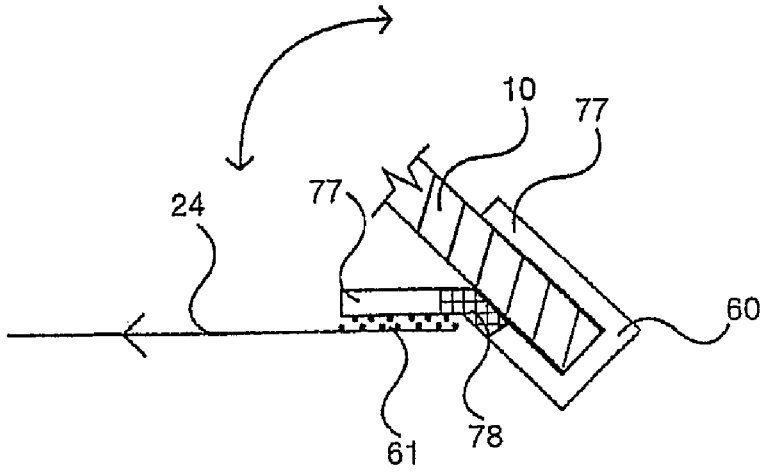
Figure 24Y:
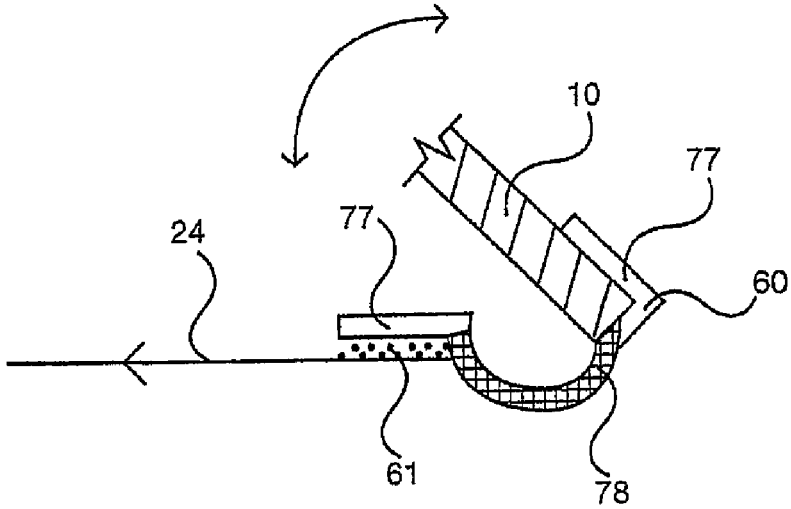
Figure 24Z:
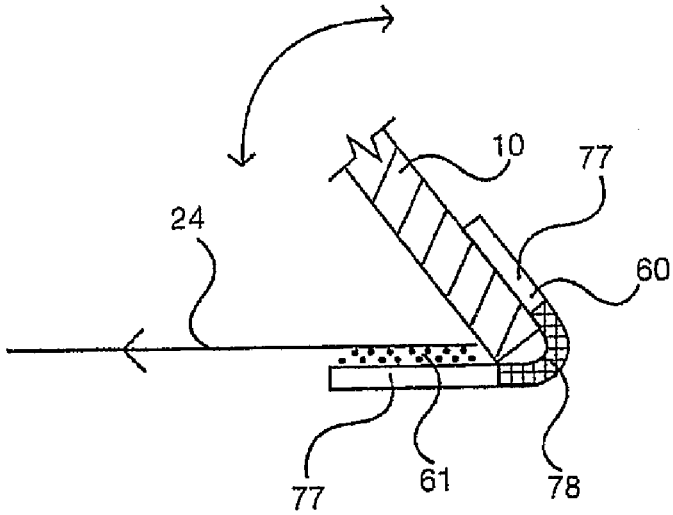

FIGS. 24A-H, 24J-N, and 24P-Z illustrate linear connectors which can be referred to as "open" connectors or "hook" connectors. FIG. 24A illustrates a membrane tie 24 formed with return edge 14, for example of cold-formed steel, which is strong enough to resist the lateral loading imposed by flexurally deformed panel 10, optionally with glueline 60. FIGS. 24B-H, 24J-N, and 24P-R and FIGS. 24T-Z all illustrate hook-profiled linear connectors 60 in arrangements which can easily be understood from the previous descriptions, using the same nomenclature. Of particular note are the profiled linear connectors of FIGS. 24M-N and 24P-R which comprise a novel hook profile of FIG. 24S devised for the purpose of this invention to provide a "universal" hook arrangement featuring an obtuse internal angle in direct line with membrane tie 24 which allows variation in both thickness and angle of panel 10 in relation to membrane tie 24, from $\theta_1$ to $\theta_2$, as further illustrated in FIG. 24T. The external surface of such "universal" hook linear connectors can be of different shape, as illustrated in FIG. 24U in which linear connector 60 has a curved external shape. These "universal" hook-profiled linear connectors provide a structural connection very similar to a "pure" pinned joint arrangement. FIGS.

Figure 25A:
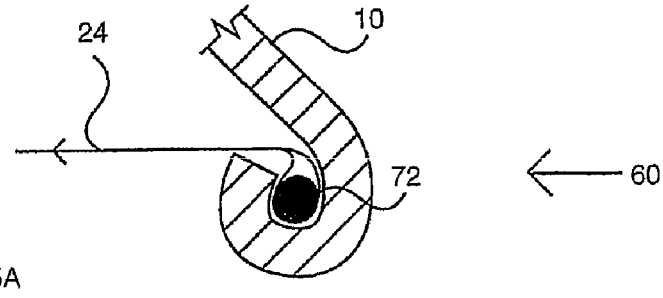
Figure 25B:
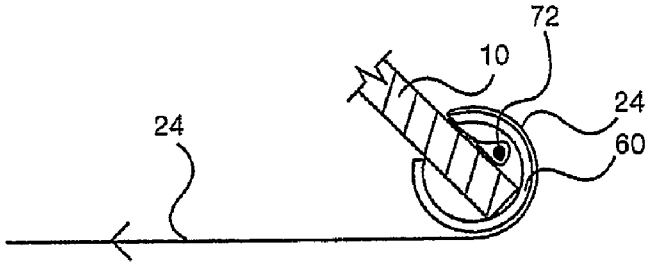
Figure 25C:
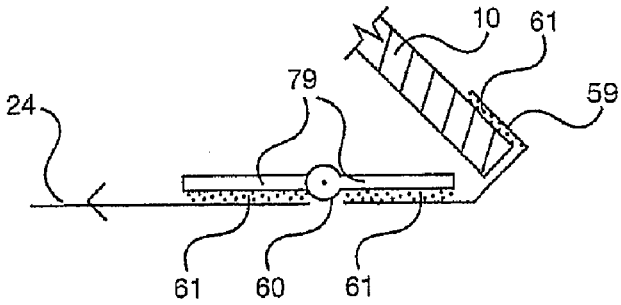
Figure 25D:
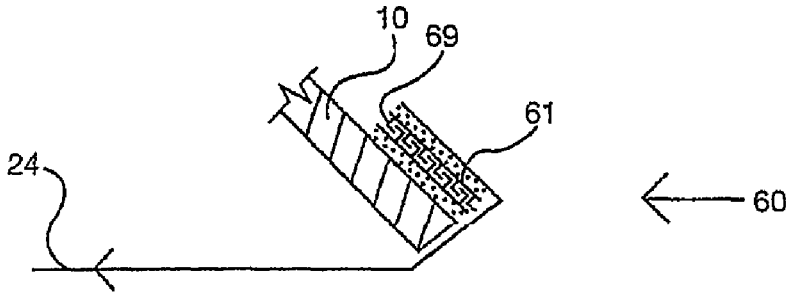
Figure 25E:
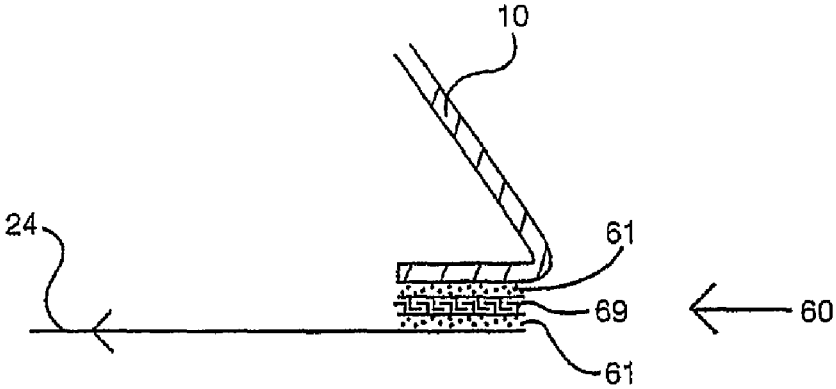
Figure 25F:
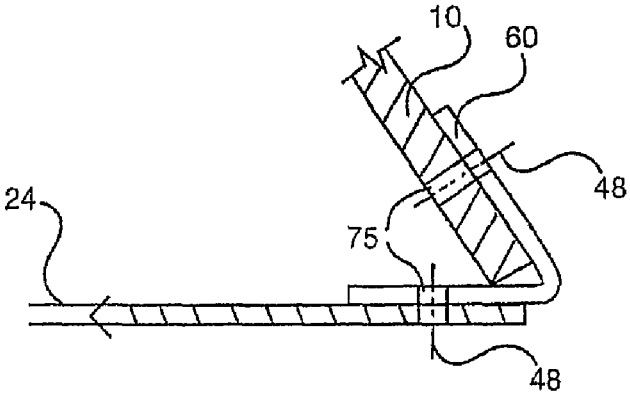
Figure 25G:
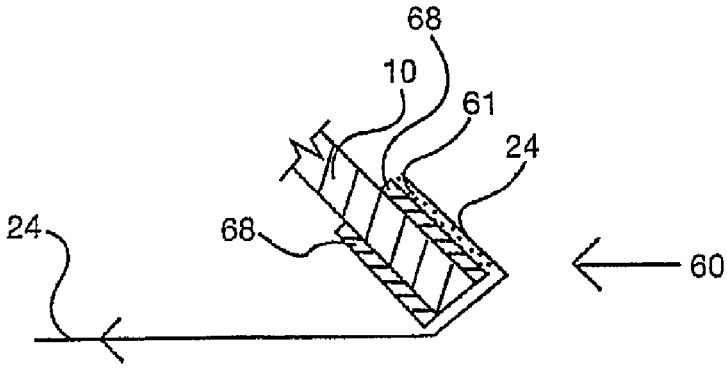
Figure 25H:
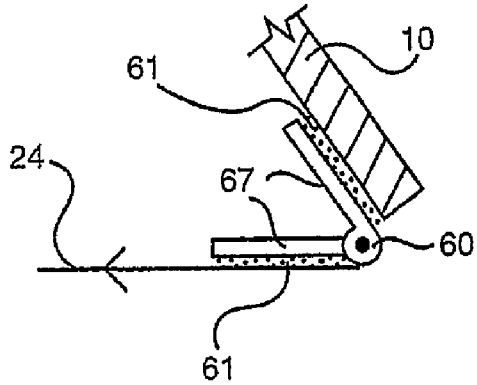

24X-Z show examples of plastic extrusions comprising a plurality of different types of plastic, typically dual or triple extrusions comprising semi-rigid plastic 77 highly flexible plastic 78, for example of pvc, ABS, HIPS, polycarbonate, TPR or acrylic, which combine to provide a hinge arrangement allowing a variable angle of intersection between panel 10 and membrane tie 24. FIGS. 25A-H and 25J illustrate miscellaneous linear connectors 60 comprising a means of inter-locking of components. In FIG. 25A, rope or cable 72 is contained within an edge seam of membrane tie 24, to be pressed into a suitable recess, for example a curved end to panel 10 as illustrated diagrammatically in FIG. 25A or a "split tube" linear connector 60, as illustrated in FIG. 25B. FIG. 25C is a diagrammatic representation of an inter-locking zip 79, typically having intervening flexible connections to panel 10 and membrane tie 24. The zip connection can optionally be provided on one side, both sides or in the centre of membrane tie 24. FIGS. 25D and E illustrate proprietary inter-locking connectors, for example interlocking closure systems, such as VELCRO®, a trademark of Velcro Industries B.V. or Dual Lock a trademark of 3M, and zips of any type. FIG. 25F illustrates angle profile 60 with lines of discrete fixings 48, for example bolts or rivets, through holes 75 in panel 10 and membrane tie 24. FIG. 25G illustrates a magnetic linear connector 60 in which strip magnet 68 is optionally adhered to one side of panel 10 (if panel 10 is not a suitable ferrous material), which is attracted towards magnet 68 adhered to linear tie 24 located on the other side of panel 10. FIG. 25H illustrates a hinge arrangement such as a "piano hinge" with direct surface connections to both panel 10 and membrane tie 24, for example by means of adhesive or frictional connections enabled by screws. FIGS. 25J and K illustrate a helical connector 60 threaded through holes, optionally reinforced holes 75 in panel 10 and membrane tie 24.

Figure 26Q:
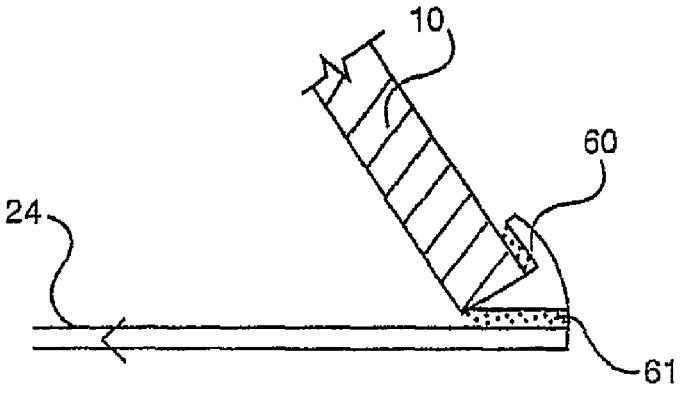

While some embodiments of the invention are easily assembled manually, others, especially larger embodiments, optionally benefit from the use of jigs and/or mechanical devices to assist assembly. For example, the sequence of assembly shown in FIGS. 26A-D utilises a wall or piece of furniture as a restraint to assist flexing of the panel. In FIG. 26A, the panel 10 and membrane tie 24 on floor 40 are connected at one end of the assembly located against wall 50. In FIG. 26B, suction pads connected by a hand bar to form suction grip 91, as used in the glazing industry, are used to lift the other end of the panel and flex it upwards and towards the wall, to be then lowered into position and secured to the other end of the membrane tie 24 by linear connector 60, as shown in FIG. 26C. The assembly can then be rotated manually through 90° and re-positioned laterally to its desired position, for example as a display comprising membrane tie display panel 26, as shown in FIG. 26D. As another example, a jig comprising two raised edges, for example parallel edges of two adjacent tables 89, as shown in FIG. 26E can be used to help flex the panel before positioning the membrane tie 24 and fixing linear connectors 60, as shown in FIG. 26F. As another example, one or more temporary tie cables 72 can be used to flex the panel, for example by means of clamps attached to edges of the panel or by forming sloping return ends 14 to the panel and a grip hoist or hoists to pull the ends of the panel together to an intermediate panel geometry 5, as shown in FIGS. 26G and H. This enables the membrane tie 24 to be positioned and linear connectors 60 effected, allowing removal of the temporary cable or cables and the panel to spread slightly, inducing tension in membrane tie 24, as shown in FIGS. 26J and K. As another example, as illustrated in FIG. 26L, a vertical restraint, for example wall 50, can be used in conjunction with a horizontal surface, for example table 89, to align and connect one end panel 10 to membrane tie 24, for example by pressure-sensitive adhesive 63, and then enable the other end of panel 10 to be pushed towards the wall until it is over and then down onto the other end of membrane tie 24 to effect their connection by means, for example, of pressure-sensitive adhesive 63. Assembly may also be assisted by multi-use of components, for example by means of a profiled linear connector 60, for example of extruded polycarbonate or aluminium, acting as a temporary stop to an edge of panel 10 which is being slid into place along the upper surface of membrane tie 24, as illustrated in both FIGS. 26M and P. The profiled linear connector 60 can then be easily rotated to engage the outside of panel 10, effecting a dimensionally stable connection with membrane tie 24, as illustrated in FIGS. 26N or FIG. 26Q respectively.

Following assembly, the structural performance of particular embodiments vary depending on their component sizes, their tied, flexurally deformed geometry, their material composition and with time owing to creep, unless both the panel and the membrane tie are only stressed within their elastic range and continue to be so during the serviceable life of the assembly, for example in the case of suitably stress-limited steel panels and membrane ties. With plastic materials, or natural materials, such as timber-based products, the assemblies will "creep", in other words continue to deflect even with no imposed loading and typically will exhibit "visco-elastic" behavior. In assemblies which creep, the induced bending stresses in the flexurally deformed panel and the tensile force in the membrane tie will decrease. Assemblies of the present invention typically have substantially better structural performance in the resistance of loads, for example in the resistance of vertical or lateral imposed loads, for example from accidental impact, than similarly proportional structures without pre-stress. For example, regarding the maintenance of desired geometry, for example, membrane tie graphic displays which are required to be maintained in a plane (flat) state, then structures of the present invention with its pre-stressed component parts will perform this function far better than similar components pre-formed to the same geometry but not pre-stressed. However, these benefits of a tied, flexed panel assembly reduce with creep of any plastic or other components which creep. The extent of such creep can be measured over time, for example by the use of prior art strain and deflection gauges. The bending stresses in the panel and the tension force in the membrane tie are typically related by the formula:

$$M=T\times H$$

where M is the bending moment at any point in the panel at height H above the membrane tie and T is the tensile force in the membrane tie, providing there is an effectively pinned connection at the position of the linear connector 60 between the panel 10 and membrane tie 24, as illustrated in FIG. 27A, as would be provided by many of the linear connectors illustrated in FIGS. 21A-E, 22A-H, 22J-N, 22P-Y, 23A-H, 23J-N, 23P-W, 24A-H, 24J-N, 24P-Z, 25A-H, 25J, and 25K, or if the membrane tie 24 was of much less flexural stiffness than panel 10.

However, there is great difficulty using the currently available means for structural analysis in pre-determining the tensile force in a membrane tie and therefore the bending moments and the shape of the curve along the length of a panel of an assembly for any given sizes and material properties of a panel and membrane tie. Most theories of structural design and the resultant analysis methods and their computational means rely on assumptions developed for the design of traditional structures, for example for buildings, bridges, etc in which it is desired to restrict the amount of deflection of the overall structure and individual element & for serviceability reasons for example which typically restrict the maximum deflection of a beam to span/250. The traditional "beam theory" for the design of conventional structures relies on a number of assumptions which are not satisfied by a typical assembly of the present invention, in which the deflection of the panel is grossly in excess of these assumptions, even the simplest assembly comprising materials which are maintained within their elastic range.

While some methods of analysis can theoretically be applied to any structure, for example finite element analysis, there are assumptions and requirements of such methods that do not ideally lend these methods to such grossly deformed, relatively thin elements. For example individual elements within a finite element analysis are conventionally not elongated but, for example, comprise a fine triangulated grid with individual triangles having sides of not dissimilar size. In seeking to predict the behaviour of a typical panel of the present invention, for example a panel lmeter long by 1 mm thick, or 10 meters length by 6 mm thickness, hundreds if not thousands of elements along the length of the panel would typically be required if a sufficiently fine grid is provided across the thickness of the panel to enable adequate analysis of resultant stresses.

There is no prior art in the field of structural engineering concerning the flexure of thin panels to induce tension in another structural element, in order to produce a stable, serviceable structural assembly. There is no established means of predicting the performance of such structures, as there has been no prior requirement. One of the reasons such structures have not been devised and used in the past may be because there is no accepted means of reliably predicting their performance by calculation.

These problems of analysis and predicting the performance of assemblies of the invention are even more complicated when plastic materials are incorporated, for example panel sheets of acrylic, polycarbonate or pvc, and/or membrane tie films of polyester or pvc. Creep of one element is interactive with the stresses in the other element or elements of the assembly and the problems of calculation already discussed are greatly worsened by the need for successive or iterative calculations predicting the resultant stresses in any point in time in the life-span of the assembly structure, which are continually changing with time in use. For some uses of the invention, for example small displays, for example table top displays of postcards or photographs, appropriate member sizes can be relatively easily established by testing, and the invention has been reduced to practice in many such cases, for example as previously described in relation to FIG. 2G for the display of photographs. For larger embodiments, for example for relatively large exhibition assemblies or building enclosures, it is considered that the best approach to computation of structural performance should be based on the intelligent application of existing theories of analysis and computational methods until a reliable correlation between predicted behaviour and measured structural performance enable more specific, tailored methods of analysis to be developed and proven in the future.

Perhaps the nearest practical problem in the art of structural engineering that has been considered from an analytical standpoint is the performance of thin steel plates in compression following buckling, in order to seek to establish the residual strength of a buckled plate with its subsequent gross deformation, for example in considering safety in a resultant collapse mode of a structure. However, the ultimate deflected form of such structures typically involves plastic hinge mechanisms which are not typically achieved in structures of the invention under any anticipated loading condition, and in such prior art analyses, lateral deflection of a failed plate in compression is not important, per se, only its residual strength (for example see: "The Stability of Flat Plates", P. S Bulson. Pages 406-423). In summary, there is no proven method for reliably predicting the initial stresses within and the subsequent behaviour of assemblies of the present invention and any logical approaches to solving the problem are in the realms of very advanced theoretical structural analysis.

Adopting the following nomenclature:

| | |
|---|---|
| panel | as previously described |
| E | Elastic Modulus |
| h | width of panel |
| t | panel thickness |
| l | length of panel |
| M | Bending Moment |
| N | Normal forces per unit length |
| P | applied force |
| q | intensity of a distributed load |
| s | panel deflection arc length |
| w | deflection of panel in z direction |
| X, Y | Body forces in main axis directions |
| x, y, z | coordinates |
| $\epsilon$ | strain |
| $\sigma$ | stress |
| $\delta$ | deflection |
| $\phi$ | panel deflected slope angle |
| $\nu$ | Poison's ratio |

Considering purely elastic behaviour, looking at the bending of a rectangular panel that is subjected to a transverse load and assuming that the material stays in the elastic state for large deflections, the deflection of an element of the panel is given by a differential equation that is similar to the deflection of a bent beam. Consider a panel of uniform thickness t and take xy plane as the middle of the panel and the width of the panel being denoted by h. As in ordinary theory of beams, it can be assumed that the cross-sections of the panel remain plane during bending, so that it undergoes only rotation with respect to the neutral axis.

The curvature of the deflection curve is given in Equation 1, assuming the deflection w is small compared to the length of the beam (which is not the case with typical panels of the present invention).

$$-\frac{d^2 w}{dx^2} \qquad \text{Equation 1}$$

The lateral strain, $\epsilon_y$, must be zero in order to maintain continuity in the panel during bending, from which it follows that the elastic strain, $\delta_x$, and stress, $\sigma_x$, is given by Equation 2 and Equation 3.

$$\varepsilon_x = \frac{(1-\nu^2)\sigma_x}{E} \qquad \text{Equation 2}$$

$$\sigma_x = \frac{E\varepsilon_x}{1-\nu^2} = -\frac{Ez}{1-\nu^2}\frac{d^2 w}{dx^2} \qquad \text{Equation 3}$$

Knowing the applied force P or bending moment M on the panel, the curvature of the bended plate is Equation 4 where EI is the flexural rigidity of the panel.

$$\frac{d^2 w}{dx^2} = -\frac{M}{EI} \quad \text{Equation 4}$$

In the above, it has been assumed that the panel is bent by lateral loads only. If in the addition to lateral loads there are forces acting on the middle plane of the panel, these must be considered in deriving the corresponding differential equation of the deflection surface. Timoshenko and Woinowsky proposed the differential equation in Equation 5 for the deflection of a beam where q is the intensity of a continuous distributed load and $N_x$, $N_y$ and $N_{xy}$ are the normal forces per unit length in an element of the panel. X and Y are body forces acting in the middle plane of the panel or are tangential forces distributed over the surfaces of the panel.

$$\frac{\partial^4 w}{\partial x^4} + 2\frac{\partial^4 w}{\partial x^2 \partial x^2} + \frac{\partial^4 w}{\partial y^4} = \frac{1}{EI}\left(q + N_x\frac{\partial^2 w}{\partial x^2} + N_y\frac{\partial^2 w}{\partial y^2} + 2N_{xy}\frac{\partial^2 w}{\partial x \partial y} - X\frac{\partial w}{\partial x} - Y\frac{\partial w}{\partial y}\right) \quad \text{Equation 5}$$

Equation 5 is simplified when the boundary conditions are known. Even in the simplest of cases this equation is non-linear and not easily solved. The use of numerical methods such as finite differences has been proposed to solve the non-linear differential equations.

According to "beam theory", the panel can be assumed to be a cantilever beam of length l, width h and thickness t, as proposed by Timoshenko. Using this assumption, the equations proposed by Bisshop and Drucker (Quarterly of Applied Mathematics, V 3(3), pp 272-275) for the large deflection of cantilever beams can be used to determine the curvature, deflection and horizontal displacement.

The derivation is based on the Bernoulli-Euler theorem, which states that the curvature is proportional to the bending moment (Equation 4). For wide beams, as considered in this case, the flexural rigidity is given by Equation 6.

$$B = \frac{EI}{1 - \nu^2} \quad \text{Equation 6}$$

The curvature of the beam is expressed in terms of the arc length s and slope angle $\phi$ in Equation 7. This equation leads to an elliptic integral that can be split up into complete and incomplete elliptic integrals of the first and second kind. In the notation of Jahnke and Emde, the relation for deflection $\delta$ and beam length l are given in Equation 8.

$$\frac{d\phi}{ds} = \sqrt{\frac{2P}{B}}\,(\sin\phi_0 - \sin\phi)^{1/2} \quad \text{Equation 7}$$

$$\frac{\delta}{l} = 1 - \frac{2}{\alpha}[E(k) - E(k, \theta_1)] \quad \text{Equation 8}$$

With the application of boundary conditions, the horizontal displacement of the loaded end of the beam is calculated with Equation 9 with $\phi_0$ the initial slope angle of the beam.

$$\frac{l - \Delta}{l} = \frac{\sqrt{2}}{\alpha}(\sin\phi_0)^{1/2} \quad \text{Equation 9}$$

Separately, theoretical curves of an end loaded pillar with pin-jointed ends under progressive axial loading are illustrated in FIG. 27B for which Southwell ("Theory of Elasticity" (Oxford) p. 430) proposes a compatible equation with those already considered. The solution of this equation also involves elliptic functions which is outside the realms of capability of a typical practicing structural engineer and, in any case, does not address inelastic behavior.

Considering plastic behaviour, in any particular loaded beam, if the load system is increased gradually, yielding would first occur at the extreme fibres of the weakest section in relation to its resultant bending moment. These fibres are then said to be in plastic state and further increase in loading will bring about a considerable increase in strain at this weakest section of the beam, with a redistribution of stress. When the whole cross-section at any point in a structure becomes plastic, no further increase in the moment of resistance is possible without excessive strain and a "plastic hinge" has been developed. So-called "work hardening" can subsequently result in increased moment of resistance.

The main aim 1s to calculate the bending moment required to form a plastic hinge for any particular cross-section and to determine the distribution of bending moment along the beam at the collapse load. The assumptions made in calculations are:

1. the material exhibits a marked yield and can undergo considerable strain at yield without further increase in stress.
2. the yield stress is the same in tension and compression
3. transverse cross-sections remain plane, so that strain is proportional to the distance from the neutral to the distance from the neutral axis, though in the plastic region stress will be constant and not proportional to strain.

The fully plastic moment is calculated with Equation 10 and the moment at first yield with Equation 11

$$M_P = \frac{ht^2}{4}\sigma_y \quad \text{Equation 10}$$

$$M_y = \frac{ht}{6}\sigma_y \quad \text{Equation 11}$$

The analytical calculations of deflections within the plastic region are uncertain at this stage and the use of numerical computation is suggested to determine the deflection of beams/plates when the material is within the plastic region. Equation 10 and Equation 11 gives an indication at what magnitude of loads plasticity will occur in the material.

In numerical modelling, plasticity theory provides a mathematical relationship that characterizes the elasto-plastic response of materials. There are three ingredients in the rate-independent plasticity theory: the yield criterion, flow rule and the hardening rule.

Numerical modelling is a novel method of applying engineering calculations to almost any engineering problem, be that of a structural, thermal, fluid, electromagnetic, etc. of nature or a combination of these fields. Numerical modelling has proved to be reliable in non-linear problems where the nonlinearities are introduced due to a change of status (contact), geometry (large deflections) and material nonlinearities (stress-strain curves).

The problem of large deflection of beams/plates will include geometrical and material nonlinearities. ANSYS (computer software owned by ANSYS, Inc., a US corporation), employs the "Newton-Raphson" approach to solve nonlinear problems. In this approach, the load is subdivided into a series of load increments. The load increments can be applied over several load steps.

A square panel has been modelled using beam elements. The models looked at the deflection and stress distribution of the panel in the Elastic state and then in the Plastic state. The effect of Creep on the stress relaxation and deformation of the initial curve has also been investigated.

For an Elastic analysis the material is assumed to be pure elastic and does not go into a plastic state no matter the amount of deflection. This type of analysis tends to over-predict the stress and strain calculations when the stresses go above the yield limit of the material. An Elastic analysis is the most basic structural analysis and is good for initial models due to the relatively quick calculations.

In a Plastic analysis the yield stress limit and tangent modulus of the plastic region needs to be specified. For an elastic-perfect plastic material a tangent modulus of 0 is specified and the stress results will not exceed the yield stress. A specified tangent modulus introduces a work hardening effect into the material.

The model consists of a beam with boundary conditions applied to the ends of the beam so that the one end (End 1) is free to move in the vertical direction and the other end (End 2) is free to move in the horizontal direction. End 1 is given a very small vertical displacement to initiate the direction of the desired curvature of the beam. End 2 is then given a large horizontal displacement inwards (towards the beam). This action results in the large deflection of the beam and represents a symmetrical model of a panel that has buckled under axial loads. FIG. 27C illustrates the deflected form of the beam with an inwards displacement of the beam, produced according to this method.

Creep is simply the time-dependent deformation of solids under stress. Many equations have been proposed for the calculation of creep strain. It needs to be emphasized that all the many equations proposed for creep can only be given some justification if the right material and test conditions are selected Creep strain equations can be temperature and stress-dependent.

Finite Element Modelling is capable of dealing with creep by using a constitutive law of creep that will be in a form in which the rate of creep strain is defined as some function of stress and total creep strain, β in Equation 12. Various functions for β exist for different material types, stress values and temperature dependence. Different functions also exist for the different stages of the creep: primary and secondary stages.

$$\dot{\varepsilon} = \frac{d\varepsilon_c}{dt} = \beta(\sigma, \varepsilon_c) \qquad \text{Equation 12}$$

In conclusion, this brief survey into analytical solutions of beams and plates undergoing large strain deflections indicate that solutions do exist but require a high level of mathematical skills to calculate the deflection and curvature of a panel for given boundary conditions with any degree of accuracy acceptable for commercial use.

Numerical modelling appears to be successful in determining the deflection of the panels. It also has the advantages of calculating stresses, strain, axial forces, bending moments, etc and the application of non-linear material properties such as plasticity, creep and visco-elasticity.

Visco-elasticity is important because in any given assembly in use, although subject to creep, the relationship M=T×H will still apply and substantial deflections within the panel will not typically occur in use, other than to accommodate the reduction in length of the membrane tie owing to the reduction of T. However, plastic materials will continue to suffer substantial reduction in bending stresses with consequent reductions in T by virtue of molecular level restructuring of the plastic material as it "relaxes" under continued flexure without substantial change in overall curvature or shape.

However, one aspect of many embodiments of the present invention is that the effects of creep degradation of the structural performance can be mitigated and even taken advantage of, by reversing the direction of the panel flexure. Referring to FIG. 2G, for example, when changing a display membrane tie display sign 26, the panel 10 can be flexed in the opposite direction to compensate for any creep relaxation of the panel that will have occurred since its assembly. In this way, the creep deflection which is not overcome on release of the panel can be used to induce greater pre-stress into both the panel and membrane tie by means of the reverse direction of bending.

Tests on small embodiments of the invention with a length of panel of 280 mm indicated an initial tension force immediately after assembly of not less than IN (one Newton).

Embodiments of the invention comprising transparent panels and/or membrane ties have many advantages. For example, displays comprising a frameless, clear plastic curved panel supporting a photograph enable the photograph to be illuminated from the rear, for example if located on a window cill, which adds impact and improved perception of the image in the manner of a backlit transparency. Secondly, it is a well-known phenomenon that a conventional, prior art frame surrounding a photograph, a realistic painting or other conventional picture has a negative effect on the perception of the 3-dimensional nature of subject matter in a 2-dimensional image. So-called "keys" to perceiving depth, for example size (greater in the foreground), perspective (leading to "vanishing points"), colour hue (towards purple in the distance) and intensity (stronger in the foreground) are all over-ridden or diminished by a frame which the brain "interprets" as the perimeter of a plane or 2-dimensional image. Prior art transparent framing systems have been developed to overcome this phenomenon, having anrays of dots in two different planes, for example on the front and rear of a frame cut from acrylic sheet, the resulting interference pattern offering the visual perception or illusion of the frame being in a substantially different plane to the framed image, to allow the 3-dimensional keys to be interpreted better by the observer's brain. An observer of a photograph or other image displayed by means of the present invention, without a frame and with only transparent means of support behind it, is able to interpret all such 3-dimensional keys without any prior art frame or any opaque means of support visible from any angle detracting from that perceived image. In the case of a postcard or other display with writing or other image on the reverse side, these reverse images are visible through a transparent panel and, in the case of writing or printed text, legible from the other side, which is not the case with conventional, prior art display systems providing an equivalent degree of structural stability.

The same advantages of transparent panels and/or membrane ties and/or linear connectors apply to larger displays, for example floor-mounted displays in a retail environment, as well as the invention enabling a cleaner, uncluttered, visual impression than conventional, prior art framing systems. In the case of semi-transparent displays, for example see-through graphics panels according to US RE37,186 or U.S. Pat. No. 6,212,805, there is an added benefit, in that there is little or no visual obstruction to the ambience and security safety aspects of the retail, exhibition or other environment surrounding the display.

However, there is no transparent material that can be flexed to the extent required to create a stable, pre-stressed structure of the present invention that does not exhibit creep and/or visco-elastic behaviour. If it is required to design an assembly of reliably predictable performance over an extended lifespan, very advanced methods of structural analysis are required, preferably including for reversible curvature of the panel where appropriate.

Another embodiment of the invention does not comprise a linear connector but a panel is restrained in its flexurally deformed geometry within a tubular membrane. The tubular membrane is plane and in tension between two remote edges of the panel. The term tubular membrane includes a tube of seamed or seamless flexible material, for example a plastic film or a fabric or a net or a perforated film material. The tubular membrane has two ends and preferably the panel is located entirely within the length of the tubular membrane between the two open ends of the tubular membrane. Optionally one or both ends of the tubular membrane are sealed, typically to use the tubular membrane and enclosed panel for packaging a product. Optionally, one end of the tubular membrane is sealed to form a bag and optionally the other end of the tubular membrane is sealed, typically to use the bag and enclosed flexed panel for packaging a product. The tubular membrane or bag is sealed, for example by adhesive, hot welding or a manual or mechanical sealing device, for example InnoSeal, supplied by InnoSeal Systems, Inc. US.

FIGS. 28A-F illustrate an embodiment in which tubular membrane 27 restrains flexed panel 10. The plane panel 10 of FIGS. 28A and 28B is flexurally deformed as illustrated in FIG. 28C and inserted within the flexible tubular membrane 27 diagrammatically represented in FIG. 28D, the intermediate flexural geometry of FIG. 28C being relaxed into the final, flexurally deformed geometry of FIG. 28E in which tubular membrane 27 is stretched between opposing sides of panel 10, as further illustrated diagrammatically in cross-section in FIG. 28F. In FIG. 28F, for clarity, tubular membrane tie 27 is shown separate to panel 10, whereas in reality they will be in intimate contact, as shown diagrammatically in the cross-section of FIG. 28G. In the assembly of FIGS. 28G, the part of the tubular membrane tie 27 which is not plane and tensioned between two sides of panel 10 transfers tensile force in the plane portion of the tubular-membrane 27 by friction to the edges and outer surface of panel 10, as indicated by the opposing arrow signs 21. Depending on the Coefficient of Friction between the outer surface of panel 10 and the inner surface of tubular membrane 27, there may be residual tension in the tubular membrane 27 at the crown 15 of panel 10.

These embodiments having a tubular tie have many practical applications, for example in the improved windsock of FIGS. 28H and 28J-L, comprising a panel with tapered sides, for example of polycarbonate, as shown in FIG. 28H, and a flexible tube, for example of polyester fabric, of tapered diameter, as shown in FIG. 28J. The windsock is assembled as shown in FIG. 28K with the flexed, tapered panel maintaining an open tapered tube, which is suspended from a pole with a projecting arm which is easily rotatable in the horizontal axis to indicate wind direction, as illustrated in FIG. 28L. The windsock is suspended such that the flexed panel is at the bottom of the stiffened tube and the strength of the wind or wind speed is indicated by the angle of the windsock, the wind gaining more "purchase" against the upper plane surface of the tube and the stable geometry providing more stable and consistent indications of wind direction and speed than prior art windsocks. FIGS. 28M and N illustrate a packaging application of an assembly comprising flexurally deformed panel 10 of, for example, biodegradable PLA (Polylactic Acid), semi-rigid sheet, within packaging film tubular membrane 27, for example of polyethelene film, which is sealed at each end by prior art "bag tie" 8.

Other embodiments of the invention use flexible film bags in place of a tubular membrane. A panel is flexed to an intermediate panel geometry, to enable it to be inserted into the bag, whereupon it is released to press against the inside of the bag in its intended flexurally deformed panel geometry, maintaining the bag in an open condition, prior to any required filling and sealing of the bag. Preferably, part of the open end of the bag extends beyond the extremities of the panel to maintain the bag in a substantially fixed geometry and reduce the likelihood of the bag slipping down the panel. A novel trash "bin-bag" assembly as illustrated in FIGS. 29A-G. The bin-bag assembly in FIG. 29G comprises base 18, post 17 and panel 10 with slide sleeve 16 fitting around post 17 enabling vertical adjustment of panel 10 on post 17. FIG. 29A is an elevational view of panel 10. FIG. 29B is an edge plan illustrating slide sleeve 16. In the plan view of FIG. 29C, panel 10 has been located with post 17 within slide sleeve 16 and the two sides of panel 10 flexurally deformed to accommodate a bag, for example a typical supermarket plastic carrier bag 28 in FIG. 29D with handles 29, which acts as tubular membrane 27. In FIG. 29E the bag is first located within the deformed panel but the upper edges of the bag are turned over around panel 10 with handle 29 located over post 17. In FIG. 29F the sides of panel 10 have been released and the overlapping top of the plastic bag 28 acts as tubular membrane 27 to restrain the top of the bag in an open position, as also illustrated in the perspective view of FIG. 29G. The height of the panel 10 can be adjusted to suit different sizes of bag, as illustrated by the arrow heads in FIG. 29G. When filled, the bag is released by inward flexure of the two sides of panel 10 enabling removal of the bag. This assembly enables the re-use of plastic carrier bags as trash bags. Additionally or alternatively, if used with a transparent bag, this assembly enables the contents of the bag to be visible, a potential security advantage.

FIGS. 29H and 29J-M illustrate a simple form of trash bin of the present invention. Panel 10 in FIGS. 29H and J, preferably with rounded corners, is temporarily flexed and inserted into the plastic bag 28, optionally with flaps 30 (see FIG. 29K), as shown diagrammatically in FIG. 29L. The panel 10 is then released with the top of the bag 28 or optionally just flaps 30 placed inwards, as shown in FIG. 29M, for example creating a light, stable trash bin which is easily emptied or the bag and contents removed, preferably by taking out for optional re-use panel 10. A large number of such trash bins can be stored and transported flat, for example to and from a special sports or other entertainment event, much more effectively and less costly than prior art trash bins. For large bins containers of the invention, for example large trash bins or storage containers or retail store bins containing products for sale, panel 10 is preferably a shaped panel 19, as illustrated in FIG. 29N with three projecting legs 51 for stability of the completed assembly and slots 20 to assist the initial temporary flexure of panel 10 and its insertion into bag 28, as illustrated in FIG. 29P, and the subsequent removal of panel 10 in order to replace bag 28. The bin-bag assemblies of FIGS. 29M and P have a particular advantage over prior art trash and other bins which are circular or square or on plan in that the plane surface of tubular membrane bag 28 can be located against a wall, desk or other vertical surface, the assembly not projecting as far into otherwise useable space as much as cylindrical or cuboid prior art bins of the same height and volume. FIG. 29Q illustrates bag 28 used for a packaging application, which only requires sealing at one end by "bag tie" 8. Such packaging applications, or example if transparent, allow visibility and spatia protection of the packaged goods, for example filled baguettes. Examples of tube or bag closure systems include zipper fasteners, bands or twist fasteners, clip ties, recloseable ties, drawstring closures, sealing, sewing and gluing.

FIGS. 30A-D illustrates an assembly with a "flying leg" which projects tangentially from flexurally deformed panel 10 in a completed assembly, for example to assist the support of a landscape format photograph or postcard (width greater than height).

FIG. 30A is a plan of panel 10, for example of transparent pvc, preferably with pre-formed crease indentations 31 with cuts 74 to provide "flying leg" 52, shown in cross-section AA in FIG. 30B.

FIG. 30C is an elevation showing membrane tie 24, typically a membrane tie display sign 26, for example a photograph or postcard, typically adhered to edge stiffeners 14 produced by folding panel 10 along crease lines 31, for example by pressure-sensitive adhesive 63. Panel 10 is flexed and "flying leg" 52 projects tangentially from panel 10 to provide a rear support to the assembly, as illustrated in the perspective of FIG. 30D. Linear connector 60 comprises, for example pressure-sensitive adhesive layer 63 applied over the width of edge stiffeners 14. FIG. 30E is an alternative panel 10 configuration comprising slots 73 around three sides of "flying leg" 52 maintaining continuity of the bottom portion of the panel and edge stiffening member 14. Optionally, assemblies similar to FIGS. 30A-D comprise a single panel with an additional fold between a portion comprising panel 10 and another portion comprising membrane tie 24, requiring only one linear connection between the other ends of panel 10 and membrane tie 24, for example comprising a single stiffening member 14 and pressure-sensitive adhesive 63.

Other embodiments may comprise "flying members", for example ventilation flaps or canopies which optionally project tangentially from a flexed panel forming part of, for example, a shelter such as that illustrated in FIGS. 19G and H.

The foregoing description is included to illustrate the operation of the preferred embodiments and is not meant to limit the scope of the invention. To the contrary, those skilled in the art should appreciate that varieties may be constructed and employed without departing from the scope of the invention, aspects of which are recited by the claims appended hereto.

What is claimed is:

1. An assembly comprising:

a panel comprising two principal panel surfaces and a plurality of panel edges;

a membrane tie comprising a membrane that includes two principal membrane tie surfaces and a plurality of membrane tie edges; and a linear connector, the panel being flexurally deformed from an initial geometry and restrained in a flexurally deformed geometry by the membrane tie and the linear connector, wherein said linear connector forms an elongated direct bond between one of said plurality of panel edges and one of said plurality of membrane tie edges, wherein said panel in said flexurally deformed geometry has a concave side, wherein said panel comprises a transparent plastic material, wherein said assembly comprises a display sign located on said concave side of said transparent plastic material, and wherein said display sign is visible from the side of said membrane tie remote from said panel.

2. An assembly as claimed in claim 1, wherein said membrane tie comprises said display sign.

3. An assembly as claimed in claim 2, wherein said membrane tie is a photograph.

4. An assembly as claimed in claim 3, wherein said photograph has a first side that is opposite a second side of the photograph, wherein said photograph comprises said display sign on said first side, and wherein said second side of said photograph is visible through said transparent plastic material.

5. An assembly as claimed in claim 2, wherein said membrane tie is a postcard.

6. An assembly as claimed in claim 5, wherein said postcard has a first side that is opposite a second side of the postcard, wherein said postcard comprises said display sign on said first side, and wherein said second side of said postcard is visible through said transparent plastic material.

7. An assembly as claimed in claim 1, wherein the membrane tie is transparent, and wherein said display sign is inserted intermediate said panel and said membrane tie, and wherein said display sign is visible through the membrane tie.

8. An assembly as claimed in claim 1, wherein another display sign is located within said assembly and said another display is visible from the side of the panel remote from the membrane tie.

9. An assembly as claimed in claim 8, wherein said panel is printed with one of said display sign and another display sign.

10. An assembly as claimed in claim 8, wherein said another display sign is visible by an observer through said transparent plastic material.

11. An assembly as claimed in claim 10, wherein said another display sign is inserted intermediate said panel and said membrane tie.

12. An assembly as claimed in claim 10, wherein said another display sign is located on said membrane tie.

13. An assembly as claimed in claim 8, wherein said membrane tie is printed with one of said display sign and another display sign.

14. An assembly as claimed in claim 1, wherein said panel comprises one of:

(i) acrylic,
(ii) polycarbonate,
(iii) polyvinyl chloride,
(iv) polyethylene,
(v) polyester,
(vi) copolyester, and
(vii) acetate.

15. An assembly as claimed in claim 1, wherein said membrane tie comprises a plastic material.

16. An assembly as claimed in claim 15, wherein said membrane tie comprises one of:

(i) polyester, and
(ii) polyvinyl chloride,
(iii) polycarbonate,
(iv) polyethylene,
(v) copolyester,
(vi) acrylic,
(vii) paper,
(viii) card, and
(ix) fabric.

17. An assembly as claimed in claim 15, wherein said plastic material comprises a plastic film material, wherein a thickness of said plastic film material is less than 0.1 mm.

18. An assembly as claimed in claim 17, wherein said thickness is less than 150 micron.

19. An assembly as claimed in claim 1, wherein said membrane tie comprises a transparent material.

20. An assembly as claimed in claim 1, wherein said linear connector comprises a transparent material.

21. An assembly as claimed in claim 1, wherein said assembly is suspended.

22. An assembly as claimed in claim 21, wherein said assembly is suspended by a suspension thread.

23. A combination comprising a plurality of assemblies as claimed in claim 22, wherein said plurality of assemblies are each part of a mobile, each of said plurality of assemblies being supported by a suspension thread and all of said plurality of assemblies being suspended from a single top suspension thread.

24. An assembly as claimed in claim 21, wherein said membrane tie comprises a membrane tie display panel orientated at an angle to vertical.

25. An assembly as claimed in claim 1, wherein the tensile force in said membrane tie is not less than 1N (one Newton).

26. An assembly as claimed in claim 1, wherein said assembly displays an object located between said panel and said membrane tie.

27. An assembly as claimed in claim 1, wherein said bond is provided by one of:

(i) a weld, and (ii) an adhesive layer.

28. An assembly as claimed in claim 27, wherein said bond is to said panel and comprises an elongate area substantially parallel to an edge of said panel of width not less than 3 mm.

29. An assembly as claimed in claim 27, wherein said bond is to said membrane tie and comprises an elongate area substantially parallel to an edge of said membrane tie of width not less than 3 mm.

30. An assembly as claimed in claim 1, wherein the flexural rigidity (EI) of said membrane tie is less than one hundredth of the flexural rigidity of said panel.

31. An assembly as claimed in claim 30, wherein the flexural rigidity of said membrane tie per cm width is less than one thousandth of the flexural rigidity of said panel.

32. An assembly as claimed in claim 1, wherein said linear connector comprises a layer of adhesive material.

33. An assembly as claimed in claim 32, wherein said layer of adhesive material comprises a plurality of discrete areas of adhesive material.

34. An assembly as claimed in claim 32, wherein said layer of adhesive material comprises a plurality of discrete areas without said adhesive material.

35. An assembly as claimed in claim 1, wherein said linear connector comprises a pressure-sensitive adhesive.

36. An assembly as claimed in claim 35, wherein said linear connector comprises a self-adhesive tape.

37. An assembly as claimed in claim 36, wherein said self-adhesive tape comprises a filmic material and a layer of pressure-sensitive adhesive material and wherein said filmic material comprises two principal surfaces and said layer of pressure-sensitive adhesive material comprises two principal surfaces, and wherein one of said principal surfaces of said layer of pressure-sensitive adhesive is adhered to one of said principal surfaces of said filmic material.

38. An assembly as claimed in claim 37, wherein one part of the other of said principal surfaces of said layer of pressure-sensitive adhesive material is adhered to said panel and another part of the other of said principal surfaces of said pressure-sensitive material is adhered to said membrane tie.

39. An assembly as claimed in claim 36, wherein said self-adhesive tape comprises another layer of pressure-sensitive material comprising two principal surfaces and a first of said principal surfaces of said another layer of pressure-sensitive material is applied to the other principal surface of said filmic material.

40. An assembly as claimed in claim 39, wherein said other principal surface of said layer of pressure-sensitive material is adhered to said panel and the second of said principal surfaces of said another layer of pressure-sensitive material is adhered to said membrane tie.

41. An assembly as claimed in claim 39, wherein said filmic material comprises a length greater than its width and both said length and width are greater than its thickness, and where said layer of pressure-sensitive adhesive is located on one part of the width of said filmic material and said another layer of pressure-sensitive adhesive is located on another part of said width of said filmic material.

42. An assembly as claimed in claim 35, wherein said pressure-sensitive adhesive bonds said membrane tie to an edge flap attached to said panel.

43. An assembly as claimed in claim 35, wherein said pressure-sensitive adhesive bonds said panel to an edge flap attached to said membrane tie.

44. An assembly as claimed in claim 1, wherein said linear connector comprises a linear weld.

45. An assembly as claimed in claim 1, wherein said linear connector comprises a profiled section.

46. An assembly as claimed in claim 45, wherein said profiled section comprises one of:

aluminum alloy, (ii) plastics material, and (iii) a plurality of plastics materials.

47. An assembly as claimed in claim 45, wherein said panel comprises a panel edge and said profiled section comprises an inside surface and an outside surface, and wherein said panel edge is non-adhesively located adjacent to said inside surface and bears against said inside surface of said profiled section.

48. An assembly as claimed in claim 1, wherein said panel comprises two edges not directly connected to said membrane tie, and wherein one of said two edges is curved inwards towards the other of said two edges.

49. An assembly as claimed in claim 1, wherein said panel comprises two edges not directly connected to said membrane tie, and wherein one of said two edges is curved outwards away from the other of said two edges.

50. An assembly as claimed in claim 1, wherein said assembly comprises another linear connector.

51. An assembly as claimed in claim 1, wherein said assembly comprises an edge flap connected to one of said panel and said membrane tie, said edge flap being adhered to the other of said panel and said membrane tie.

52. An assembly as claimed in claim 51, wherein said edge flap is connected to said panel and is adhered to said membrane tie.

53. An assembly as claimed in claim 51, wherein said edge flap is connected to said membrane tie and is adhered to said panel.

54. An assembly as claimed in claim 1, wherein said panel is corrugated.

55. An assembly as claimed in claim 1, wherein said display sign is laminated to said membrane tie.

56. An assembly as claimed in claim 1, wherein said display sign is planar throughout its area.

57. An assembly as claimed in claim 1, wherein said membrane tie is planar throughout its area.

58. An assembly as claimed in claim 1, wherein said panel is flexed throughout its area.

59. An assembly as claimed in claim 1, wherein said panel comprises said display sign.

60. An assembly as claimed in claim 1, wherein said display sign comprises paper or card.

61. An assembly comprising:

a panel comprising a transparent material, the panel comprising two surfaces;

a membrane tie comprising a membrane; and a linear connector, the panel being flexurally deformed from an initial geometry and restrained in a flexurally deformed geometry by the membrane tie and the linear connector, wherein said linear connector connects the panel to the membrane tie, wherein said panel in said flexurally deformed geometry has a concave side, wherein said assembly comprises a display sign located on said concave side, and wherein said display sign is visible from the side of said membrane tie remote from said panel, wherein said linear connector forms an elongated direct bond between an edge of the panel and an edge of the membrane tie.

62. An assembly as claimed in claim 61, wherein said membrane tie comprises said display sign.

63. An assembly as claimed in claim 61, wherein said membrane tie comprises a sheet of flexible material.

64. An assembly as claimed in claim 61, wherein said membrane tie comprises a transparent material.

65. An assembly as claimed in claim 64, wherein said display sign is located between the panel and the membrane tie, and wherein said display sign is viewable through the membrane tie.

66. An assembly as claimed in claim 61, wherein said panel comprises a transparent plastic material.

* * * * *